US005620651A

United States Patent [19]

Sikka et al.

[11] Patent Number: 5,620,651

[45] Date of Patent: Apr. 15, 1997

[54] IRON ALUMINIDE USEFUL AS ELECTRICAL RESISTANCE HEATING ELEMENTS

[75] Inventors: Vinod K. Sikka; Seetharama C. Deevi, both of Oak Ridge, Tenn.; Grier S. Fleischhauer, Midlothian, Va.; Mohammad R. Hajaligol, Richmond, Va.; A. Clifton Lilly, Jr., Chesterfield, Va.

[73] Assignee: Philip Morris Incorporated, New York, N.Y.

[21] Appl. No.: 426,006

[22] Filed: Apr. 20, 1995

Related U.S. Application Data

[63] Continuation-in-part of Ser. No. 365,952, Dec. 29, 1994.

[51] Int. Cl.[6] ..... C22C 38/06

[52] U.S. Cl. ..... 420/81; 148/328

[58] Field of Search ..... 420/81; 148/328

[56] References Cited

U.S. PATENT DOCUMENTS

| | | |
|---|---|---|
| 1,550,508 | 8/1925 | Cooper . |
| 1,990,650 | 2/1935 | Jasper . |
| 2,768,915 | 10/1956 | Nachman et al. . |
| 3,026,197 | 3/1962 | Schramm . |
| 3,676,109 | 7/1972 | Cooper . |
| 4,391,634 | 7/1983 | Kelly et al. . |
| 4,961,903 | 10/1990 | McKamey et al. . |
| 5,032,190 | 7/1991 | Suarez et al. . |
| 5,084,109 | 1/1992 | Sikka . |
| 5,158,744 | 10/1992 | Nazmy . |
| 5,238,645 | 8/1993 | Sikka et al. . |
| 5,320,802 | 6/1994 | Liu et al. . |

FOREIGN PATENT DOCUMENTS

| | | |
|---|---|---|
| 648140 | 9/1962 | Canada . |
| 648141 | 9/1962 | Canada . |

OTHER PUBLICATIONS

*Microstructure and Tensile Properties of Fe–40 Al Pct Al Alloys with C, Zr, Hf, and B Additions*, Metallurgical Transactions A, vol. 20A, pp. 1701–1714, D.J. Gaydosh, S.L. Draper and M.V. Nathal (1989).

*Powder Production, Processing, and Properties of $Fe_3Al$*, Powder Metallurgy Conf. and Exhibition, May 20–23, 1990, Pittsburgh, PA, pp. 1–11, V.K. Sikka, R.H. Baldwin and C.R. Howell.

*Microstructure and Mechanical Properties of P/M $Fe_3Al$ Alloys*, Advances in Powder Metallurgy, vol. 2, pp. 219–231, J.R. Knibloe, R.N. Wright and V.K. Sikka (1990).

*Powder Processing of $Fe_3Al$–Based Iron–Aluminide Alloys*, Mat. Res. Soc. Symposium Proc., Nov. 27–30, 1990, Boston, MA, vol. 213, pp. 901–906, V.K. Sikka, R.H. Baldwin, J.H. Reinshagen, J.R. Knibloe and R.N. Wright.

(List continued on next page.)

*Primary Examiner*—Deborah Yee

*Attorney, Agent, or Firm*—Burns, Doane, Swecker & Mathis, LLP

[57] ABSTRACT

The invention relates generally to aluminum containing iron-base alloys useful as electrical resistance heating elements. The aluminum containing iron-base alloys have improved room temperature ductility, electrical resistivity, cyclic fatigue resistance, high temperature oxidation resistance, low and high temperature strength, and/or resistance to high temperature sagging. The alloy has an entirely ferritic microstructure which is free of austenite and includes, in weight %, over 4% Al, ≦1% Cr and either ≧0.05% Zr or $ZrO_2$ stringers extending perpendicular to an exposed surface of the heating element or ≧0.1% oxide dispersoid particles. The alloy can contain 14–32% Al, ≦2% Ti, ≦2% Mo, ≦1% Zr, ≦1% C, ≦0.1% B, ≦30% oxide dispersoid and/or electrically insulating or electrically conductive covalent ceramic particles, ≦1% rare earth metal, ≦1% oxygen, ≦3% Cu, balance Fe.

55 Claims, 31 Drawing Sheets

OTHER PUBLICATIONS

*Mechanical Behaviour of $FeAl_{40}$ Intermetallic Alloys*, Proceedings of International Symposium on Intermetallic Compounds—Structure and Mechanical Properties (JIMIS-6), Jun. 17–20, 1991, Sendai, Japan, pp. 579–583.

*Influences of Compositional Modifications on the Corrosion of Iron Aluminides By Molten Nitrate Salts*, P.F. Tortorelli and P.S. Bishop (1991), pp. 1–29.

*A review of recent developments in $Fe_3Al$–based alloys*, J. Mater. Res., vol. 6, No. 8, C.G. McKamey, J.H. DeVan, P.F. Tortorelli and V.K. Sikka (1991), pp. 1779–1805.

Data Package on $Fe_3Al$*–and Fe–Al–Based Alloys Developed at ORNL*, Oak Ridge National Laboratory, Vinod K. Sikka (1993).

*The Effect of Ternary Additions on the Vacancy Hardening and Defect Structure of FeAl*, Proceedings of a Symposium held by the Minerals, Metals and Materials Society, Feb. 27–Mar. 3, 1994, San Francisco, CA, C.H. Kong and P.R. Munroe (1994), pp. 231–239.

*Impact Behavior of FeAl Alloy FA–350*, Proceedings of a Symposium held by the Minerals, Metals and Materials Society, Feb. 27–Mar. 3, 1994, San Francisco, CA, D.J. Alexander (1994), pp. 193–202.

*Selected Properties of Iron Aluminides,* Proceedings of a Symposium held by the Minerals, Metals and Materials Society, Feb. 27–Mar. 3, 1994, San Francisco, CA, J.H. Schneibel (1994), pp. 329–341.

*Flow and Fracture of FeAl*, Proceedings of a Symposium held by the Minerals, Metals and Materials Society, Feb. 27–Mar. 3, 1994, San Francisco, CA, I. Baker (1994), pp. 101–115.

*Production and Properties of CSM FeAl Intermetallic Alloys*, D. Pocci, O. Tassa and C. Testani, presented at Symposium entitled Processing, Properties, and Applications of Iron Aluminides, held by the Minerals, Metals and Materials Society, Feb. 27–Mar. 3, 1994, San Francisco, CA, (1994), pp. 19–30.

IRON ALUMINIDE USEFUL AS ELECTRICAL RESISTANCE HEATING ELEMENTS

The United States Government has rights in this invention pursuant to Contract No. DE-AC05-84OR21400 between the United States Department of Energy and Martin Marietta Energy Systems, Inc.

The present Application is a continuation-in-part of commonly owned U.S. patent application Ser. No. 08/365,952 filed Dec. 29, 1994 now allowed.

FIELD OF THE INVENTION

The invention relates generally to aluminum containing iron-base alloys useful as electrical resistance heating elements.

BACKGROUND OF THE INVENTION

Iron base alloys containing aluminum can have ordered and disordered body centered crystal structures. For instance, iron aluminide alloys having intermetallic alloy compositions contain iron and aluminum in various atomic proportions such as $Fe_3Al$, FeAl, $FeAl_2$, $FeAl_3$, and $Fe_2Al_5$. $Fe_3Al$ intermetallic iron aluminides having a body centered cubic ordered crystal structure are disclosed in U.S. Pat. Nos. 5,320,802; 5,158,744; 5,024,109; and 4,961,903. Such ordered crystal structures generally contain 25 to 40 atomic % Al and alloying additions such as Zr, B, Mo, C, Cr, V, Nb, Si and Y.

An iron aluminide alloy having a disordered body centered crystal structure is disclosed in U.S. Pat. No. 5,238,645 wherein the alloy includes, in weight %, 8–9.5 Al, ≦7 Cr, ≦4 Mo, ≦0.05 C, ≦0.5 Zr and ≦0.1 Y, preferably 4.5–5.5 Cr, 1.8–2.2 Mo, 0.02–0.032 C and 0.15–0.25 Zr. Except for three binary alloys having 8.46, 12.04 and 15.90 wt % Al, respectively, all of the specific alloy compositions disclosed in the '645 patent include a minimum of 5 wt % Cr. Further, the '645 patent states that the alloying elements improve strength, room-temperature ductility, high temperature oxidation resistance, aqueous corrosion resistance and resistance to pitting. The '645 patent does not relate to electrical resistance heating elements and does not address properties such as thermal fatigue resistance, electrical resistivity or high temperature sag resistance.

Iron-base alloys containing 3–18 wt % Al, 0.05–0.5 wt % Zr, 0.01–0.1 wt % B and optional Cr, Ti and Mo are disclosed in U.S. Pat. No. 3,026,197 and Canadian Pat. No. 648,140. The Zr and B are stated to provide grain refinement, the preferred Al content is 10–18 wt % and the alloys are disclosed as having oxidation resistance and workability. However, like the '645 patent, the '197 and Canadian patents do not relate to electrical resistance heating elements and do not address properties such as thermal fatigue resistance, electrical resistivity or high temperature sag resistance.

U.S. Pat. No. 3,676,109 discloses an iron-base alloy containing 3–10 wt % Al, 4–8 wt % Cr, about 0.5 wt % Cu, less than 0.05 wt % C, 0.5–2 wt % Ti and optional Mn and B. The '109 patent discloses that the Cu improves resistance to rust spotting, the Cr avoids embrittlement and the Ti provides precipitation hardening. The '109 patent states that the alloys are useful for chemical processing equipment. All of the specific examples disclosed in the '109 patent include 0.5 wt % Cu and at least 1 wt % Cr, with the preferred alloys having at least 9 wt % total Al and Cr, a minimum Cr or Al of at least 6 wt % and a difference between the Al and Cr contents of less than 6 wt %. However, like the '645 patent, the '109 patent does not relate to electrical resistance heating elements and does not address properties such as thermal fatigue resistance, electrical resistivity or high temperature sag resistance.

Iron-base aluminum containing alloys for use as electrical resistance heating elements are disclosed in U.S. Pat. Nos. 1,550,508; 1,990,650; and 2,768,915 and in Canadian Pat. No. 648, 141. The alloys disclosed in the '508 patent include 20 wt % Al, 10 wt % Mn; 12–15 wt % Al, 6–8 wt % Mn; or 12–16 wt % Al, 2–10 wt % Cr. All of the specific examples disclosed in the '508 patent include at least 6 wt % Cr and at least 10 wt % Al. The alloys disclosed in the '650 patent include 16–20 wt % Al, 5–10 wt % Cr, ≦0.05 wt % C, ≦0.25 wt % Si, 0.1–0.5 wt % Ti, ≦1.5 wt % Mo and 0.4–1.5 wt % Mn and the only specific example includes 17.5 wt % Al, 8.5 wt % Cr, 0.44 wt % Mn, 0.36 wt % Ti, 0.02 wt % C and 0.13 wt % Si. The alloys disclosed in the '915 patent include 10–18 wt % Al, 1–5 wt % Mo, Ti, Ta, V, Cb, Cr, Ni, B and W and the only specific example includes 16 wt % Al and 3 wt % Mo. The alloys disclosed in the Canadian patent include 6–11 wt % Al, 3–10 wt % Cr, ≦4 wt % Mn,<1 wt % Si, ≦0.4 wt % Ti, ≦0.5 wt % C, 0.2–0.5 wt % Zr and 0.05–0.1 wt % B and the only specific examples include at least 5 wt % Cr.

Resistance heaters of various materials are disclosed in U.S. Pat. No. 5,249,586 and in U.S. patent application Nos. 07/943,504, 08/118,665, 08/105,346 and 08/224,848.

U.S. Pat. No. 4,334,923 discloses a cold-rollable oxidation resistant iron-base alloy useful for catalytic converters containing ≦0.05% C, 0.1–2% Si, 2–8% Al, 0.02–1% Y, <0.009% P, <0.006% S and <0.009% 0.

U.S. Pat. No. 4,684,505 discloses a heat resistant iron-base alloy containing 10–22% Al, 2–12% Ti, 2–12% Mo, 0.1–1.2% Hf, ≦1.5% Si, ≦0.3% C, ≦0.2% B, ≦1.0% Ta, ≦0.5% W, ≦0.5% V, ≦0.5% Mn, ≦0.3% Co, ≦0.3% Nb, and ≦0.2% La. The '505 patent discloses a specific alloy having 16% Al, 0.5% Hf, 4% Mo, 3% Si, 4% Ti and 0.2% C.

Japanese Laid-open Pat. Application No. 53-119721 discloses a wear resistant, high magnetic permeability alloy having good workability and containing 1.5–17% Al, 0.2–15% Cr and 0.01–8% total of optional additions of <4% Si, <8% Mo, <8% W, <8% Ti, <8% Ge, <8% Cu, <8% V, <8% Mn, <8% Nb, <8% Ta, <8% Ni, <8% Co, <3% Sn, <3% Sb, <3% Be, <3% Hf, <3% Zr, <0.5% Pb, and <3% rare earth metal. Except for a 16% Al, balance Fe alloy, all of the specific examples in Japan '721 include at least 1% Cr and except for a 5% Al, 3% Cr, balance Fe alloy, the remaining examples in Japan '721 include ≧10% Al.

A 1990 publication in Advances in Powder Metallurgy, Vol. 2, by J.R. Knibloe et al., entitled "Microstructure And Mechanical Properties of P/M $Fe_3Al$ Alloys", pp. 219–231, discloses a powder metallurgical process for preparing $Fe_3Al$ containing 2 and 5% Cr by using an inert gas atomizer. This publication explains that $Fe_3Al$ alloys have a $DO_3$ structure at low temperatures and transform to a B2 structure above about 550° C. To make sheet, the powders were canned in mild steel, evacuated and hot extruded at 1000° C. to an area reduction ratio of 9:1. After removing from the steel can, the alloy extrusion was hot forged at 1000° C. to 0.340 inch thick, rolled at 800° C. to sheet approximately 0.10 inch thick and finish rolled at 650° C. to 0.030 inch. According to this publication, the atomized powders were generally spherical and provided dense extrusions and room temperature ductility approaching 20% was achieved by maximizing the amount of B2 structure.

A 1991 publication in Mat. Res. Soc. Syrup. Proc., Vol. 213, by V.K. Sikka entitled "Powder Processing of $Fe_3Al$-Based Iron-Aluminide Alloys," pp. 901–906, discloses a process of preparing 2 and 5% Cr containing $Fe_3Al$-based iron-aluminide powders fabricated into sheet. This publication states that the powders were prepared by nitrogen-gas atomization and argon-gas atomization. The nitrogen-gas atomized powders had low levels of oxygen (130 ppm) and nitrogen (30 ppm). To make sheet, the powders were canned in mild steel and hot extruded at 1000° C. to an area reduction ratio of 9:1. The extruded nitrogen-gas atomized powder had a grain size of 30 μm. The steel can was removed and the bars were forged 50% at 1000° C., rolled 50% at 850° C. and finish rolled 50% at 650° C. to 0.76 mm sheet.

A paper by V.K. Sikka et al., entitled "Powder Production, Processing, and Properties of $Fe_3Al$", pp. 1–11, presented at the 1990 Powder Metallurgy Conference Exhibition in Pittsburgh, Pa., discloses a process of preparing $Fe_3Al$ powder by melting constituent metals under a protective atmosphere, passing the metal through a metering nozzle and disintegrating the melt by impingement of the melt stream with nitrogen atomizing gas. The powder had low oxygen (130 ppm) and nitrogen (30 ppm) and was spherical. An extruded bar was produced by filling a 76 mm mild steel can with the powder, evacuating the can, heating 1½ hr at 1000° C. and extruding the can through a 25 mm die for a 9:1 reduction. The grain size of the extruded bar was 20 μm. A sheet 0.76 mm thick was produced by removing the can, forging 50% at 1000° C., rolling 50% at 850° C. and finish rolling 50% at 650° C.

Oxide dispersion strengthened iron-base alloy powders are disclosed in U.S. Pat. Nos. 4,391,634 and 5,032,190. The '634 patent discloses Ti-free alloys containing 10–40% Cr, 1–10% Al and ≦10% oxide dispersoid. The '190 patent discloses a method of forming sheet from alloy MA 956 having 75% Fe, 20% Cr, 4.5% Al, 0.5% Ti and 0.5% $Y_2O_3$.

A publication by A. LeFort et al., entitled "Mechanical Behavior of $FeAl_{40}$ Intermetallic Alloys" presented at the Proceedings of International Symposium on Intermetallic Compounds—Structure and Mechanical Properties (JIMIS-6), pp. 579–583, held in Sendai, Japan on June 17–20, 1991, discloses various properties of FeAl alloys (25 wt % Al) with additions of boron, zirconium, chromium and cerium. The alloys were prepared by vacuum casting and extruding at 1100° C. or formed by compression at 1000° C. and 1100° C. This article explains that the excellent resistance of FeAl compounds in oxidizing and sulfidizing conditions is due to the high Al content and the stability of the B2 ordered structure.

A publication by D. Pocci et al., entitled "Production and Properties of CSM FeAl Intermetallic Alloys" presented at the Minerals, Metals and Materials Society Conference (1994 TMS Conference) on "Processing, Properties and Applications of Iron Aluminides", pp. 19–30, held in San Francisco, Calif. on Feb. 27–Mar. 3, 1994, discloses various properties of $Fe_{40}Al$ intermetallic compounds processed by different techniques such as casting and extrusion, gas atomization of powder and extrusion and mechanical alloying of powder and extrusion and that mechanical alloying has been employed to reinforce the material with a fine oxide dispersion. The article states that FeAl alloys were prepared having a B2 ordered crystal structure, an Al content ranging from 23 to 25 wt % (about 40 at %) and alloying additions of Zr, Cr, Ce, C, B and $Y_2O_3$. The article states that the materials are candidates as structural materials in corrosive environments at high temperatures and will find use in thermal engines, compressor stages of jet engines, coal gasification plants and the petrochemical industry.

A publication by J. H. Schneibel entitled "Selected Properties of Iron Aluminides", pp. 329–341, presented at the 1994 TMS Conference discloses properties of iron aluminides. This article reports properties such as melting temperatures, electrical resistivity, thermal conductivity, thermal expansion and mechanical properties of various FeAl compositions.

A publication by J. Baker entitled "Flow and Fracture of FeAl", pp. 101–115, presented at the 1994 TMS Conference discloses an overview of the flow and fracture of the B2 compound FeAl. This article states that prior heat treatments strongly affect the mechanical properties of FeAl and that higher cooling rates after elevated temperature annealing provide higher room temperature yield strength and hardness but lower ductility due to excess vacancies. With respect to such vacancies, the articles indicates that the presence of solute atoms tends to mitigate the retained vacancy effect and long term annealing can be used to remove excess vacancies.

A publication by D.J. Alexander entitled "Impact Behavior of FeAl Alloy FA-350", pp. 193–202, presented at the 1994 TMS Conference discloses impact and tensile properties of iron aluminide alloy FA-350. The FA-350 alloy includes, in atomic %, 35.8% Al, 0.2% Mo, 0.05% Zr and 0.13% C.

A publication by C.H. Kong entitled "The Effect of Ternary Additions on the Vacancy Hardening and Defect Structure of FeAl", pp. 231–239, presented at the 1994 TMS Conference discloses the effect of ternary alloying additions on FeAl alloys. This article states that the B2 structured compound FeAl exhibits low room temperature ductility and unacceptably low high temperature strength above 500° C. The article states that room temperature brittleness is caused by retention of a high concentration of vacancies following high temperature heat treatments. The article discusses the effects of various ternary alloying additions such as Cu, Ni, Co, Mn, Cr, V and Ti as well as high temperature annealing and subsequent low temperature vacancy-relieving heat treatment.

SUMMARY OF THE INVENTION

The invention provides an aluminum-containing iron-based alloy useful as an electrical resistance heating element. The alloy has improved room temperature ductility, resistance to thermal oxidation, cyclic fatigue resistance, electrical resistivity, low and high temperature strength and/or high temperature sag resistance. In addition, the alloy preferably has low thermal diffusivity.

The heating element according to the invention can comprise, in weight %, over 4% Al, ≧0.1% oxide dispersoid particles or ≦1% Cr and >0.05% Zr or $ZrO_2$stringers oriented perpendicular to an exposed surface of the heating element. The alloy can comprise, in weight %, 14–32% Al, ≦2.0% Ti, ≦2.0% Si, ≦30% Ni, ≦0.5% Y, ≦1% Nb, ≦1% Ta, ≦10% Cr, ≦2.0% Mo, ≦1% Zr, ≦1% C, ≦0.1% B, ≦30% oxide dispersoid, ≦1% rare earth metal, ≦1% oxygen, ≦3% Cu, balance Fe.

According to various preferred aspects of the invention, the alloy can be Cr-free, Mn-free, Si-free, and/or Ni-free. The alloy preferably has an entirely ferritic austenite-free microstructure which optionally may contain electrically insulating and/or electrically conductive ceramic particles such as $Al_2O_3$, $Y_2O_3$, SiC, SiN, AlN, etc. Preferred alloys include 20.0–31.0% Al, 0.05–0.15% Zr, ≦0.1% B and 0.01–0.1% C; 14.0–20.0% Al, 0.3–1.5% Mo, 0.05–1.0% Zr and ≦0.1% C, ≦0.1% B and ≦2.0% Ti; and 20.0–31.0% Al, 0.3–0.5% Mo, 0.05–0.3% Zr, ≦0.1% C, ≦0.1% B and ≦0.5% Y.

The electrical resistance heating element can be used for products such as heaters, toasters, igniters, heating elements in electrical cigarette smoking system, etc. wherein the alloy has a room temperature resistivity of 80–400 μΩ·cm, preferably 90–200 μΩ·cm. The alloy preferably heats to 900° C. in less than 1 second when a voltage up to 10 volts and up to 6 amps is passed through the alloy. When heated in air to 1000° C. for three hours, the alloy preferably exhibits a weight gain of less than 4%, more preferably less than 2%. The alloy can have a contact resistance of less than 0.05 ohms and a total heating resistance in the range of 0.5 to 7, preferably 0.6 to 4 ohms throughout a heating cycle between ambient and 900° C. The alloy preferably exhibits thermal fatigue resistance of over 10,000 cycles without breaking when pulse heated from room temperature to 1000° C. for 0.5 to 5 seconds.

With respect to mechanical properties, the alloy has a high strength to weight ratio (i.e., high specific strength) and should exhibit a room temperature ductility of at least 3%. For instance, the alloy can exhibit a room temperature reduction in area of at least 14%, and a room temperature elongation of at least 15%. The alloy preferably exhibits a room temperature yield strength of at least 50 ksi and a room temperature tensile strength of at least 80 ksi. With respect to high temperature properties, the alloy preferably exhibits a high temperature reduction in area at 800° C. of at least 30%, a high temperature elongation at 800° C. of at least 30%, a high temperature yield strength at 800° C. of at least 7 ksi, and a high temperature tensile strength at 800° C. of at least 10 ksi.

According to one aspect of the invention, an electrical resistance heating element formed from an iron aluminide alloy includes, in weight percent, over 4% Al and Zr in an amount effective to form zirconium oxide stringers perpendicular to an exposed surface of the heating element and pin surface oxide on the heating element during temperature cycling between ambient and temperatures over 500° C.

According to another aspect of the invention, an electrical resistance heating element of an iron based alloy includes, in weight percent, over 4% Al and at least 0.1% oxide dispersoid, the oxide being present as discrete oxide dispersoid particles having sizes such as 0.01 to 0.1 μm in a total amount of up to 30% and the dispersoid particles comprising oxides such as $Al_2O_3$ and $Y_2O_3$.

The invention also provides a process of making an alloy suitable for an electrical resistance heating element. The process includes forming an oxide coated powder by water atomizing an aluminum-containing iron-based alloy and forming powder having an oxide coating thereon, forming a mass of the powder into a body, and deforming the body sufficiently to break up the oxide coating into oxide particles and distribute the oxide particles as stringers in a plastically deformed body. According to various aspects of the method, the body can be formed by placing the powder in a metal can and sealing the metal can with the powder therein. Alternatively, the body can be formed by mixing the powder with a binder and forming a powder mixture. The deforming step can be carried out by hot extruding the metal can and forming an extrusion or extruding the powder mixture and forming an extrusion. The extrusion can be rolled and/or sintered. The iron-based alloy can be a binary alloy and the powder can contain in excess of 0.1 wt % oxygen. For instance, the oxygen content can be 0.2–5%, preferably 0.3–0.8%. In order to provide an electrical resistance heating element which heats to 900° C. in less than one second when a voltage of up to 10 volts and up to 6 amps is passed through the alloy, the plastically deformed body preferably has a room temperature resistivity of 80–400 μΩ·cm. Due to the water atomizing of the powder, the powder is irregular in shape and the oxide particles consist essentially of $AL_2O_3$. The powder can have any suitable particle size such as 5–30 μm.

The electric resistance heating material can be prepared in various ways. For instance, the raw ingredients can be mixed with a sintering additive prior to thermomechanically working the material such as by extrusion. The material can be prepared by mixing elements which react during the sintering step to form insulating and/or electrically conductive metal compounds. For instance, the raw ingredients can include elements such as Mo, C and Si, the Mo, C and Si forming $MoSi_2$ and SiC during the sintering step. The material can be prepared by mechanical alloying and/or mixing prealloyed powder comprising pure metals or compounds of Fe, Al, alloying elements and/or carbides, nitrides, borides, silicides and/or oxides of metallic elements such as elements from groups IVb, Vb and VIb of the periodic table. The carbides can include carbides of Zr, Ta, Ti, Si, B, etc., the borides can include borides of Zr, Ta, Ti, Mo, etc., the silicides can include silicides of Mg, Ca, Ti, V, Cr, Mn, Zr, Nb, Mo, Ta, W, etc., the nitrides can include nitrides of Al, Si, Ti, Zr, etc., and the oxides can include oxides of Y, Al, Si, Ti, Zr, etc. In the case where the FeAl alloy is oxide dispersion strengthened, the oxides can be added to the powder mixture or formed in situ by adding pure metal such as Y to a molten metal bath whereby the Y can be oxidized in the molten bath, during atomization of the molten metal into powder and/or by subsequent treatment of the powder.

The invention also provides a powder metallurgical process of making an electrical resistance heating element by atomizing an aluminum-containing iron-based alloy, forming a mass of the powder into a body, and deforming the body into an electrical resistance heating element. The body can be formed by placing the powder in a metal can, sealing the metal can with the powder therein followed by subjecting the can to hot isostatic pressing. The body can also be formed by slip casting wherein the powder is mixed with a binder and formed into a powder mixture. The deforming step can be carried out in various manners such as by cold isostatic pressing or extruding the body. The process can further include rolling the body and sintering the powder in an inert gas atmosphere, preferably a hydrogen atmosphere. If the powder is pressed, the powder is preferably pressed to a density of at least 80% so as to provide a porosity of no greater than 20% by volume, preferably a density of at least 95% and a porosity of no greater than 5%. The powder can have various shapes such as an irregular shape or spherical shape.

BRIEF DESCRIPTION OF THE DRAWINGS

FIG. 16*b* is an iron map where dark areas are low in iron, FIG. 16*c* is an aluminum map showing the areas that were low in iron and enriched in aluminum, and FIG. 16*d* is an oxygen map showing its concentration where aluminum is enriched and iron is low;

FIGS. 21*a–e* show creep data for alloys 35, 46, 48 and 56, wherein FIG. 21*a* shows creep data for alloy 35 after annealing at 1050° C. for two hours in vacuum, FIG. 21*b* shows creep data for alloy 46 after annealing at 700° C. for one hour and air cooling, FIG. 21*c* shows creep data for alloy 48 after annealing at 1100° C. for one hour in vacuum and wherein the test is carried out at 1 ksi at 800° C., FIG. 21*d* shows the sample of FIG. 21*c* tested at 3 ksi and 800° C. and FIG. 21*e* shows alloy 56 after annealing at 1100° C. for one hour in vacuum and tested at 3 ksi and 800° C.

FIGS. 22*a–c* show graphs of hardness (Rockwell C) values for alloys 48, 49, 51, 52, 53, 54 and 56 wherein FIG. 22*a* shows hardness versus annealing for 1 hour at temperatures of 750°–1300° C. for alloy 48; FIG. 22*b* shows hardness versus annealing at 400° C. for times of 0–140 hours for alloys 49, 51 and 56; and FIG. 22*c* shows hardness versus annealing at 400° C. for times of 0–80 hours for alloys 52, 53 and 54;

FIGS. 23*a–e* show graphs of creep strain data versus time for alloys 48, 51 and 56, wherein FIG. 23*a* shows a comparison of creep strain at 800° C. for alloys 48 and 56, FIG. 23*b* shows creep strain at 800° C. for alloy 48, FIG. 23*c* shows creep strain at 800° C., 825° C. and 850° C. for alloy 48 after annealing at 1100° C. for one hour, FIG. 23*d* shows creep strain at 800° C., 825° C. and 850° C. for alloy 48 after annealing at 750° C. for one hour, and FIGS. 23*e* shows creep strain at 850° C. for alloy 51 after annealing at 400° C. for 139 hours;

FIGS. 24*a–b* show graphs of creep strain data versus time for alloy 62 wherein FIG. 24*a* shows a comparison of creep strain at 850° C. and 875° C. for alloy 62 in the form of sheet and FIG. 24*b* shows creep strain at 800° C., 850° C. and 875° C. for alloy 62 in the form of bar; and FIGS. 25*a–b* show graphs of electrical resistivity versus temperature for alloys 46 and 43 wherein FIG. 25*a* shows electrical resistivity of alloys 46 and 43 and FIG. 24*b* shows effects of a heating cycle on electrical resistivity of alloy 43.

DETAILED DESCRIPTION OF THE PREFERRED EMBODIMENTS

Figure 1A:
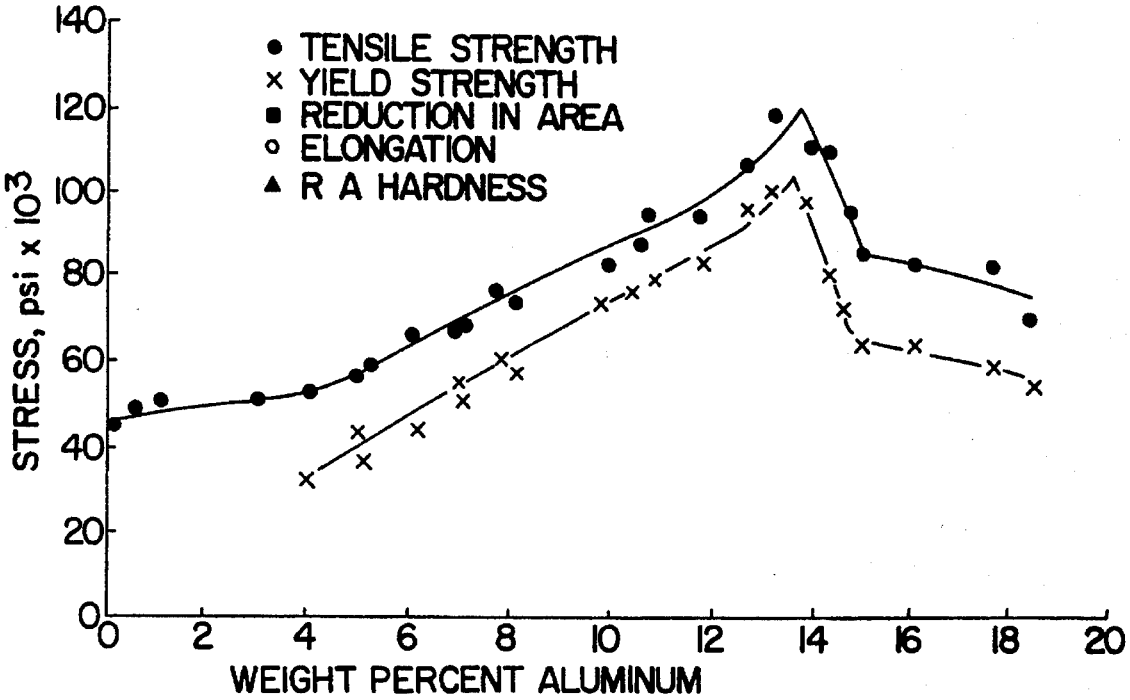
FIG. 1 shows the effect of changes in Al content on room-temperature properties of an aluminum containing iron-base alloy.
Figure 1B:
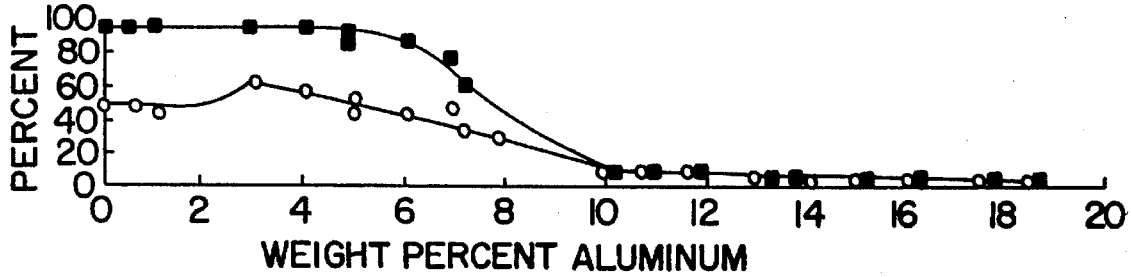
Figure 1C:
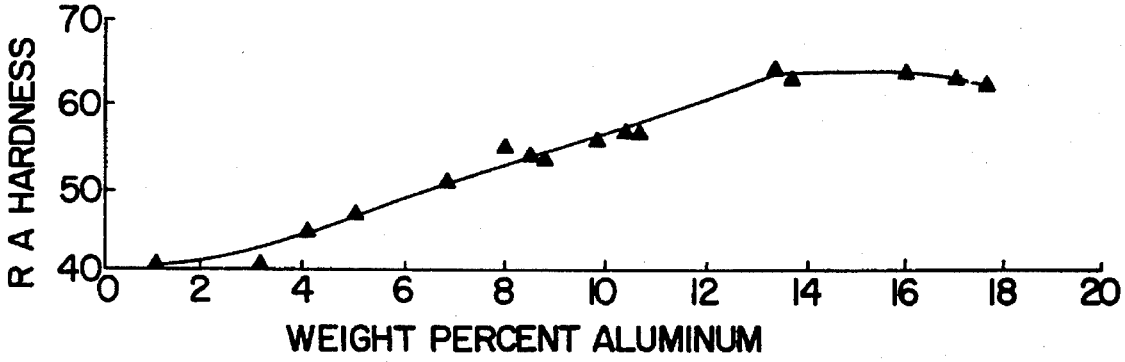
Figure 1D:
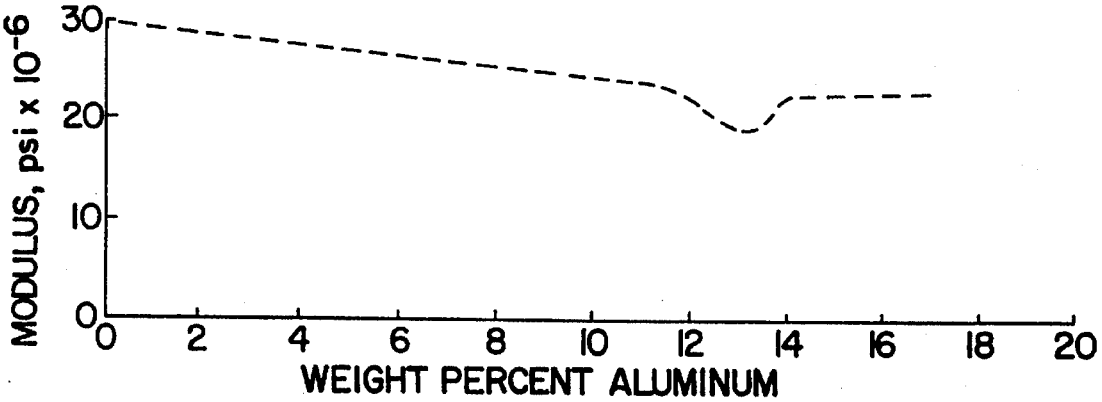

The present invention is directed to improved aluminum containing iron-base alloys which contain at least 4% by weight (wt %) of aluminum and are characterized by a $Fe_3Al$ phase having a $DO_3$ structure or an FeAl phase having a B2 structure. The alloys of the present invention preferably are ferritic with an austenite-free microstructure and may contain one or more alloy elements selected from molybdenum, titanium, carbon, rare earth metal such as yttrium or cerium, boron, chromium, oxide such as $AL_2O_3$ or $Y_2O_3$, and a carbide former (such as zirconium, niobium and/or tantalum) which is useable in conjunction with the carbon for forming carbide phases within the solid solution matrix for the purpose of controlling grain size and/or precipitation strengthening.

According to one aspect of the invention the aluminum concentration in the Fe-Al alloys can range from 14 to 32% by weight (nominal) and the Fe—Al alloys when wrought or powder metallurgically processed can be tailored to provide selected room temperature ductilities at a desirable level by annealing the alloys in a suitable atmosphere at a selected temperature greater than about 700° C. (e.g., 700° –1100° C.) and then furnace cooling, air cooling or oil quenching the alloys while retaining yield and ultimate tensile strengths, resistance to oxidation and aqueous corrosion properties.

The concentration of the alloying constituents used in forming the Fe—Al alloys of the present invention is expressed herein in nominal weight percent. However, the nominal weight of the aluminum in these alloys essentially corresponds to at least about 97% of the actual weight of the aluminum in the alloys. For example, in the Fe—Al alloy of the preferred composition, as will be described below, a nominal 18.46 wt % may provide an actual 18.27 wt % of aluminum, which is about 99% of the nominal concentration.

The Fe—Al alloys of the present invention can be processed or alloyed with one or more selected alloying elements for improving properties such as strength, room-temperature ductility, oxidation resistance, aqueous corrosion resistance, pitting resistance, thermal fatigue resistance, electrical resistivity, high temperature sag or creep resistance and resistance to weight gain. Effects of various alloying additions and processing are shown in the drawings, Tables 1–6 and following discussion.

According to the invention, aluminum containing iron based alloys can be provided which are useful as electrical resistance heating elements. For instance, the alloy of the invention can be used to make the heating element described in commonly owned U.S. Patent Application filed concurrently herewith and entitled "Heater For Use In An Electrical Smoking System" (PM 1768). However, the alloy compositions disclosed herein can be used for other purposes such as in thermal spray applications wherein the alloys could be used as coatings having oxidation and corrosion resistance. Also, the alloys could be used as oxidation and corrosion resistant electrodes, furnace components, chemical reactors, sulfidization resistant materials, corrosion resistant materials for use in the chemical industry, pipe for conveying coal slurry or coal tar, substrate materials for catalytic converters, exhaust pipes for automotive engines, porous filters, etc.

According to one aspect of the invention, the geometry of the alloy can be varied to optimize heater resistance according to the formula: $R=\rho(L/W\times T)$ wherein R=resistance of the heater, ρ=resistivity of the heater material, L=length of heater, W=width of heater and T=thickness of heater. The resistivity of the heater material can be varied by adjusting the aluminum content of the alloy, processing of the alloy or incorporating alloying additions in the alloy. For instance, the resistivity can be significantly increased by incorporating particles of alumina in the heater material. The alloy can optionally include other ceramic particles to enhance creep resistance and/or thermal conductivity. For instance, the heater material can include particles or fibers of electrically conductive material such as nitrides of transition metals (Zr, Ti, Hf), carbides of transition metals, borides of transition of metals and $MoSi_2$ for purposes of providing good high temperature creep resistance up to 1200° C. and also excellent oxidation resistance. The heater material may also incorporate particles of electrically insulating material such as $Al_2O_3$, $Y_2O_3$, $Si_3N_4$, $ZrO_2$ for purposes of making the heater material creep resistant at high temperature and also enhancing thermal conductivity and/or reducing the thermal coefficient of expansion of the heater material. The electrically insulating/conductive particles/fibers can be added to a powder mixture of Fe, Al or iron aluminide or such particles/fibers can be formed by reaction synthesis of elemental powders which react exothermically during manufacture of the heater element.

The heater material can be made in various ways. For instance, the heater material can be made from a prealloyed powder or by mechanically alloying the alloy constituents. The creep resistance of the material can be improved in various ways. For instance, a prealloyed powder can be mixed with $Y_2O_3$ and mechanically alloyed so as to be sandwiched in the prealloyed powder. The mechanically alloyed powder can be processed by conventional powder metallurgical techniques such as by canning and extruding, slip casting, centrifugal casting, hot pressing and hot isostatic pressing. Another technique is to use pure elemental powders of Fe, Al and optional alloying elements with or without ceramic particles such as $Y_2O_3$ and cerium oxide and mechanically alloying such ingredients. In addition to the above, the above mentioned electrically insulating and/or electrically conductive particles can be incorporated in the powder mixture to tailor physical properties and high temperature creep resistance of the heater material.

The heater material can be made by conventional casting or powder metallurgy techniques. For instance, the heater material can be produced from a mixture of powder having different fractions but a preferred powder mixture comprises particles having a size smaller than minus 100 mesh. According to one aspect of the invention, the powder can be produced by gas atomization in which case the powder may have a spherical morphology. According to another aspect of the invention, the powder can be made by water atomization in which case the powder may have an irregular morphology. In addition, the powder produced by water atomization can include an aluminum oxide coating on the powder particles and such aluminum oxide can be broken up and incorporated in the heater material during thermomechanical processing of the powder to form shapes such as sheet, bar, etc. The alumina particles are effective in increasing resistivity of the iron aluminum alloy and while the alumina is effective in increasing strength and creep resistance, the ductility of the alloy is reduced.

When molybdenum is used as one of the alloying constituents it can be added in an effective range from more than incidental impurities up to about 5.0% with the effective amount being sufficient to promote solid solution hardening of the alloy and resistance to creep of the alloy when exposed to high temperatures. The concentration of the molybdenum can range from 0.25 to 4.25% and in one preferred embodiment is in the range of about 0.3 to 0.5%. Molybdenum additions greater than about 2.0% detract from the room-temperature ductility due to the relatively large extent of solid solution hardening caused by the presence of molybdenum in such concentrations.

Titanium can be added in an amount effective to improve creep strength of the alloy and can be present in amounts up to 3%. When present, the concentration of titanium is preferably in the range of ≦2.0%.

When carbon and the carbide former are used in the alloy, the carbon is present in an effective amount ranging from more than incidental impurities up to about 0.75% and the carbide former is present in an effective amount ranging from more than incidental impurities up to about 1.0% or more. The carbon concentration is preferably in the range of about 0.03% to about 0.3%. The effective amount of the carbon and the carbide former are each sufficient to together provide for the formation of sufficient carbides to control grain growth in the alloy during exposure thereof to increasing temperatures. The carbides may also provide some precipitation strengthening in the alloys. The concentration of the carbon and the carbide former in the alloy can be such that the carbide addition provides a stoichiometric or near stoichiometric ratio of carbon to carbide former so that essentially no excess carbon will remain in the finished alloy.

Zirconium can be incorporated in the alloy to improve high temperature oxidation resistance. If carbon is present in the alloy, an excess of a carbide former such as zirconium in the alloy is beneficial in as much as it will help form a spallation-resistant oxide during high temperature thermal cycling in air. Zirconium is more effective than Hf since Zr forms oxide stringers perpendicular to the exposed surface of the alloy which pins the surface oxide whereas Hf forms oxide stringers which are parallel to the surface.

The carbide formers include such carbide-forming elements as zirconium, niobium, tantalum and hafnium and combinations thereof. The carbide former is preferably zirconium in a concentration sufficient for forming carbides with the carbon present within the alloy with this amount being in the range of about 0.02% to 0.6%. The concentrations for niobium, tantalum and hafnium when used as carbide formers essentially correspond to those of the zirconium.

In addition to the aforementioned alloy elements the use of an effective amount of a rare earth element such as about 0.05–0.25% cerium or yttrium in the alloy composition is beneficial since it has been found that such elements improve oxidation resistance of the alloy.

Improvement in properties can also be obtained by adding up to 30 wt % of oxide dispersoid particles such as $Y_2O_3$, $AL_2O_3$or the like. The oxide dispersoid particles can be added to a melt or powder mixture of Fe, Al and other alloying elements. Alternatively, the oxide can be created in situ by water atomizing a melt of an aluminum-containing iron-based alloy whereby a coating of alumina or yttria on iron-aluminum powder is obtained. During processing of the powder, the oxides break up and are arranged as stringers in the final product. Incorporation of the oxide particles in the iron-aluminum alloy is effective in increasing the resistivity of the alloy. For instance, by incorporating about 0.5–0.6 wt % oxygen in the alloy, the resistivity can be raised from around 100 μΩ·cm to about 160 μΩ·cm.

In order to improve thermal conductivity and/or resistivity of the alloy, particles of electrically conductive and/or electrically insulating metal compounds can be incorporated in the alloy. Such metal compounds include oxides, nitrides, silicides, borides and carbides of elements selected from groups IVb, Vb and VIb of the periodic table. The carbides can include carbides of Zr, Ta, Ti, Si, B, etc., the borides can include borides of Zr, Ta, Ti, Mo, etc., the silicides can include silicides of Mg, Ca, Ti, V, Cr, Mn, Zr, Nb, Mo, Ta, W, etc., the nitrides can include nitrides of Al, Si, Ti, Zr, etc., and the oxides can include oxides of Y, Al, Si, Ti, Zr, etc. In the case where the FeAl alloy is oxide dispersion strengthened, the oxides can be added to the powder mixture or formed in situ by adding pure metal such as Y to a molten metal bath whereby the Y can be oxidized in the molten bath, during atomization of the molten metal into powder and/or by subsequent treatment of the powder. For instance, the heater material can include particles of electrically conductive material such as nitrides of transition metals (Zr, Ti, Hf), carbides of transition metals, borides of transition of metals and $MoSi_2$ for purposes of providing good high temperature creep resistance up to 1200° C. and also excellent oxidation resistance. The heater material may also incorporate particles of electrically insulating material such as $Al_2O_3$, $Y_2O_3$, $Si_3N_4$, $ZrO_2$ for purposes of making the heater material creep resistant at high temperature and also enhancing thermal conductivity and/or reducing the thermal coefficient of expansion of the heater material.

Additional elements which can be added to the alloys according to the invention include Si, Ni and B. For instance, small amounts of Si up to 2.0% can improve low and high temperature strength but room temperature and high temperature ductility of the alloy are adversely affected with additions of Si above 0.25 wt %. The addition of up to 30 wt % Ni can improve strength of the alloy via second phase strengthening but Ni adds to the cost of the alloy and can reduce room and high temperature ductility thus leading to fabrication difficulties particularly at high temperatures. Small amounts of B can improve ductility of the alloy and B can be used in combination with Ti and/or Zr to provide titanium and/or zirconium boride precipitates for grain refinement. The effects to Al, Si and Ti are shown in FIGS. 1–7.

FIG. 1 shows the effect of changes in Al content on room temperature properties of an aluminum containing iron-base alloy. In particular, FIG. 1 shows tensile strength, yield strength, reduction in area, elongation and Rockwell A hardness values for iron-base alloys containing up to 20 wt % Al.

Figure 2A:
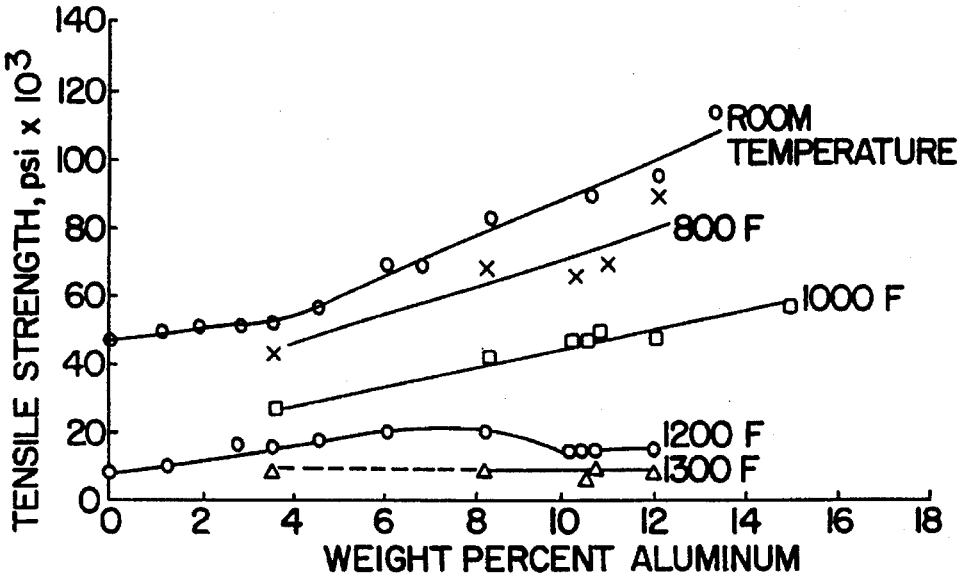
FIG. 2 shows the effect of changes in Al content on room temperature and high-temperature properties of an aluminum containing iron-base alloy.
Figure 2B:
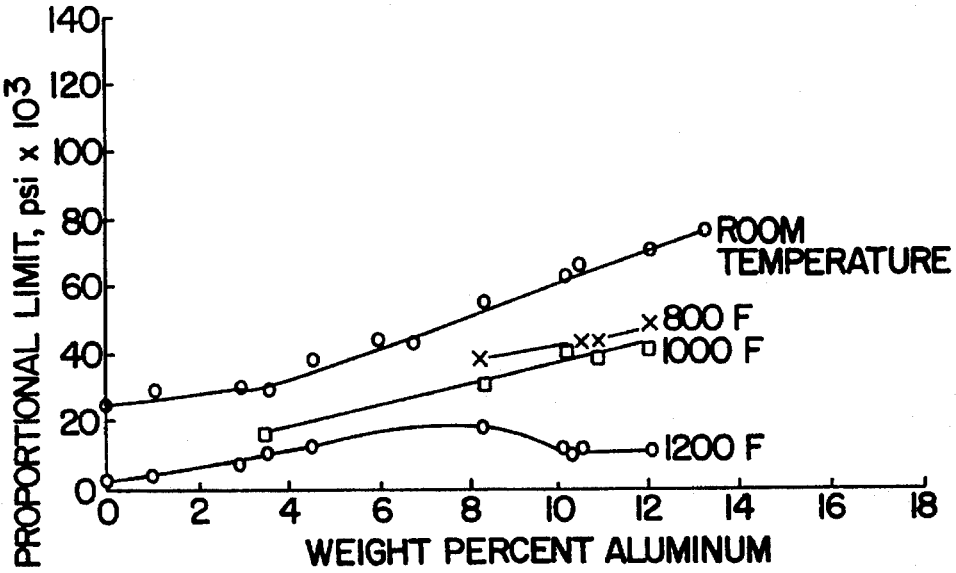

FIG. 2 shows the effect of changes in Al content on high-temperature properties of an aluminum containing iron-base alloy. In particular, FIG. 2 shows tensile strength and proportional limit values at room temperature, 800° F., 1000° F., 1200° F. and 1350° F. for iron-base alloys containing up to 18 wt % Al.

Figure 3A:
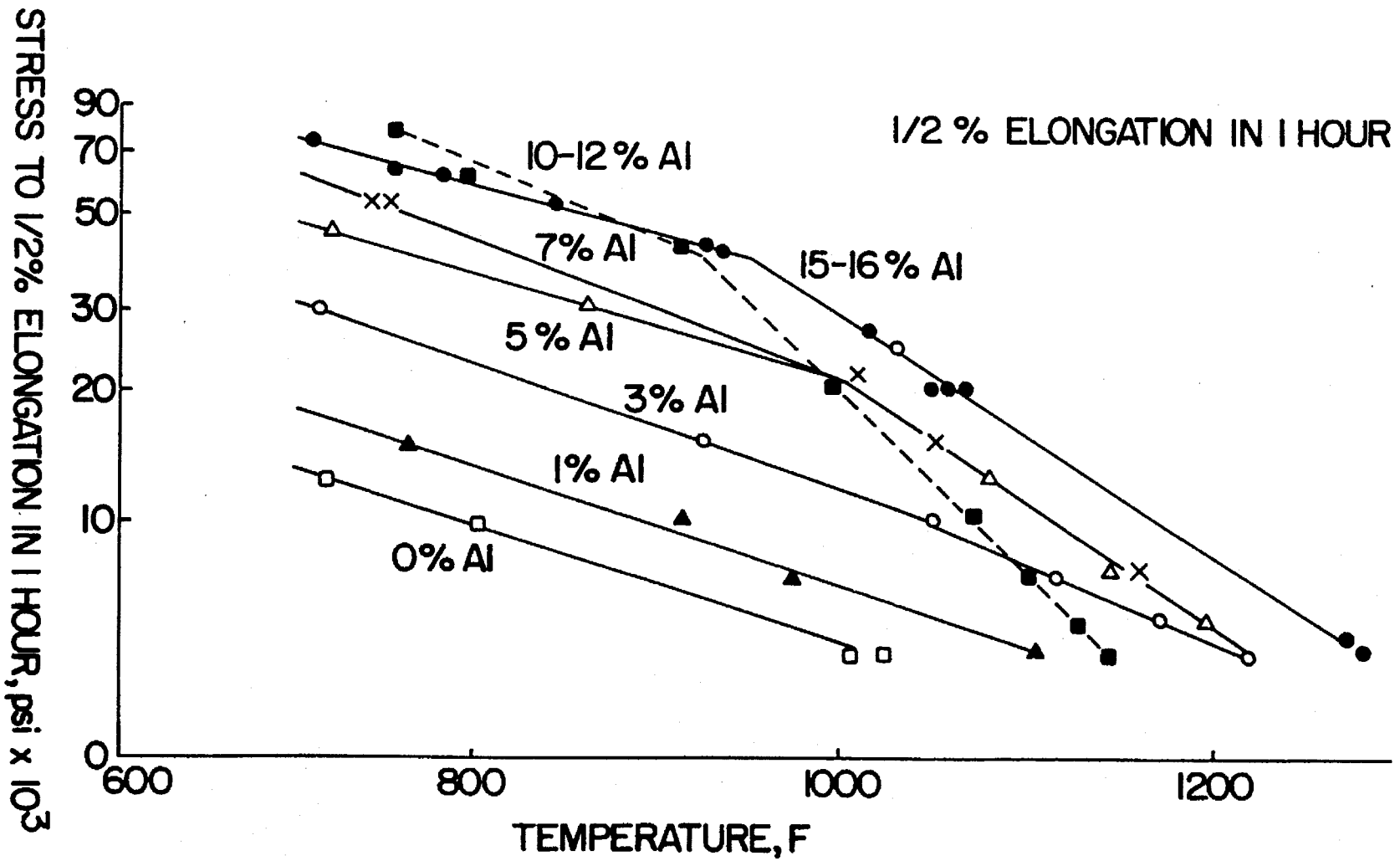
FIG. 3 shows the effect of changes in Al content on high temperature stress to elongation of an aluminum containing iron-base alloy.
Figure 3B:
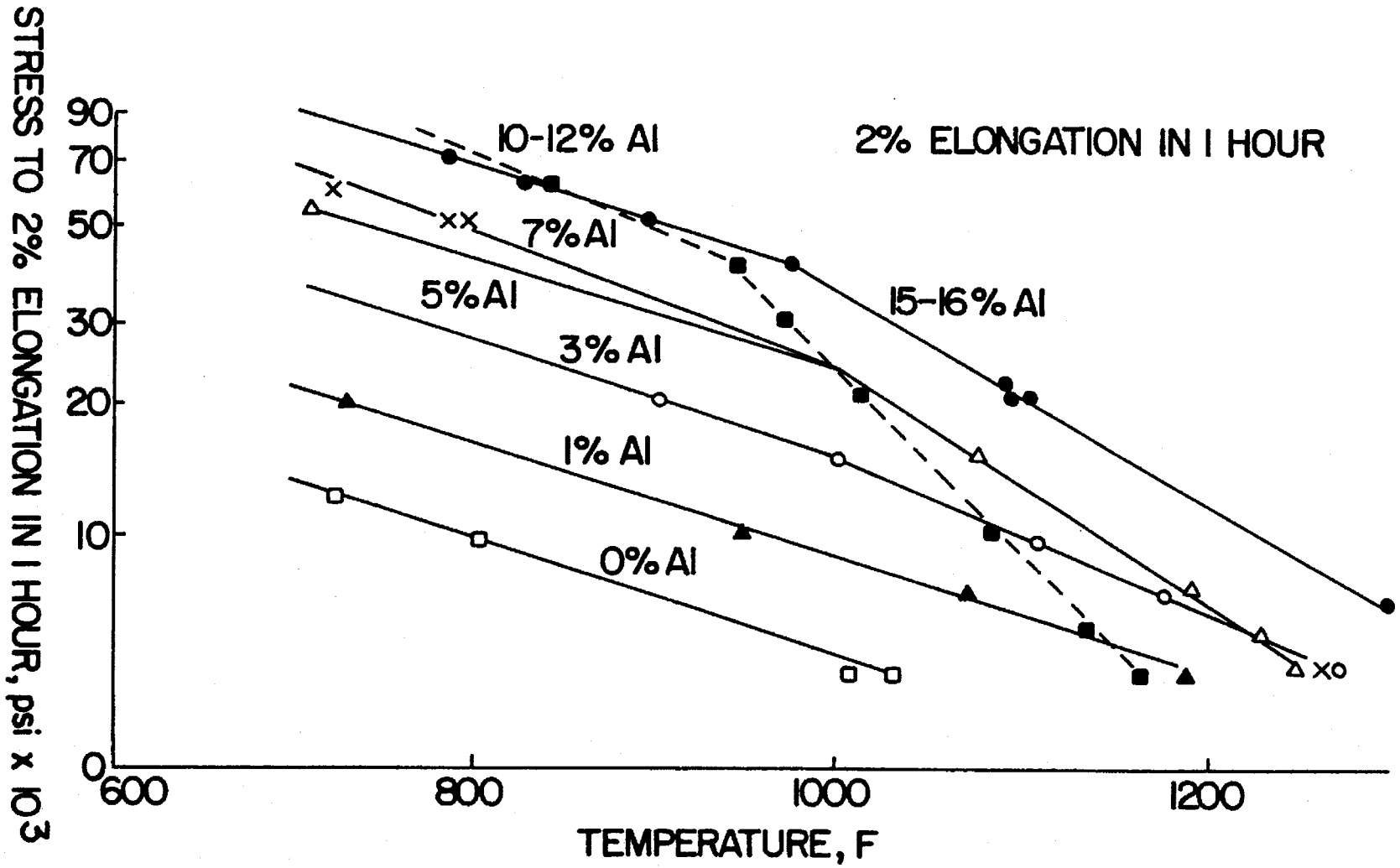

FIG. 3 shows the effect of changes in Al content on high temperature stress to elongation of an aluminum containing iron-base alloy. In particular, FIG. 3 shows stress to ½% elongation and stress to 2% elongation in 1 hour for iron-base alloys containing up to 15–16 wt % Al.

Figure 4A:
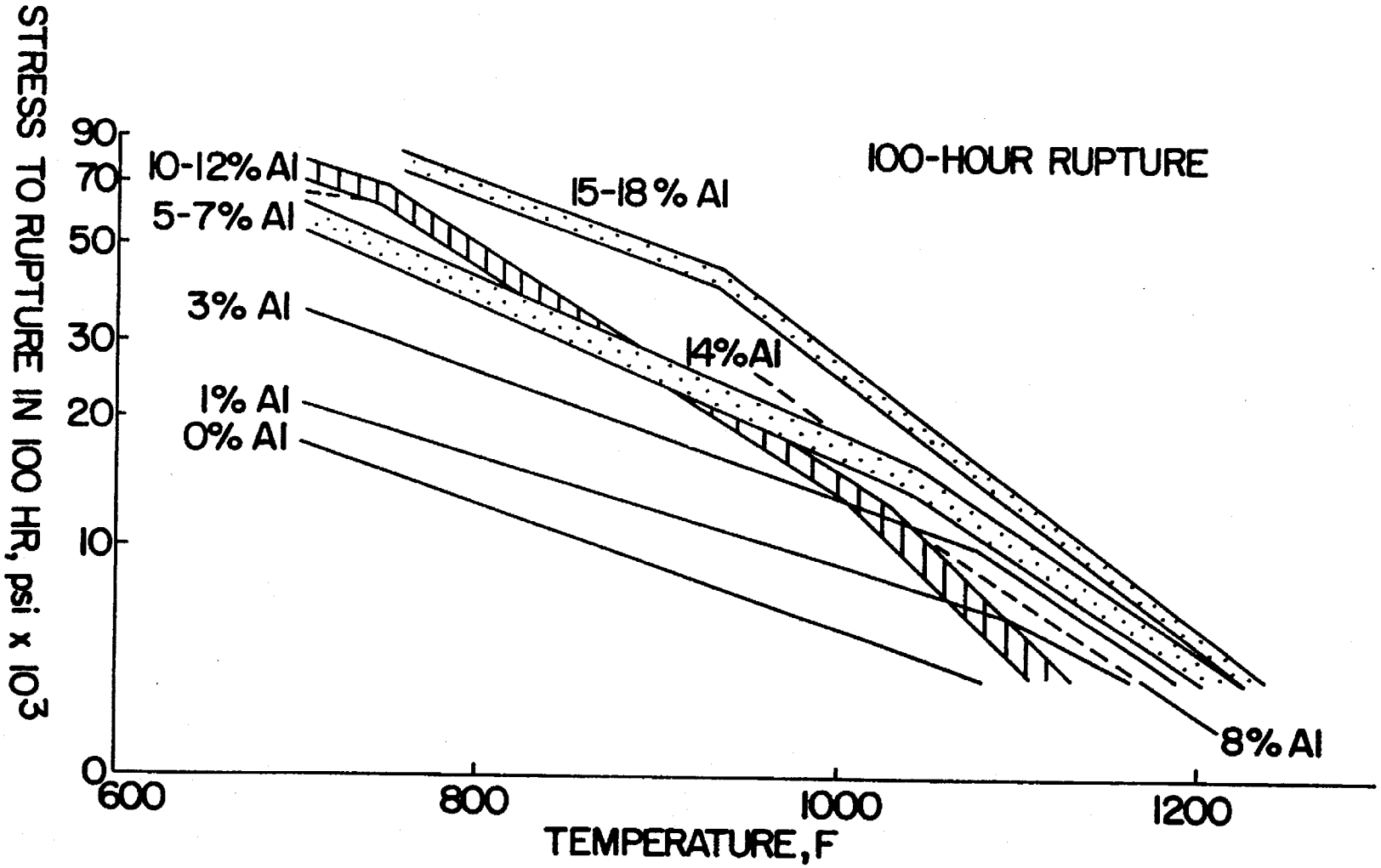
FIG. 4 shows the effect of changes in Al content on stress to rupture (creep) properties of an aluminum containing iron-base alloy.
Figure 4B:
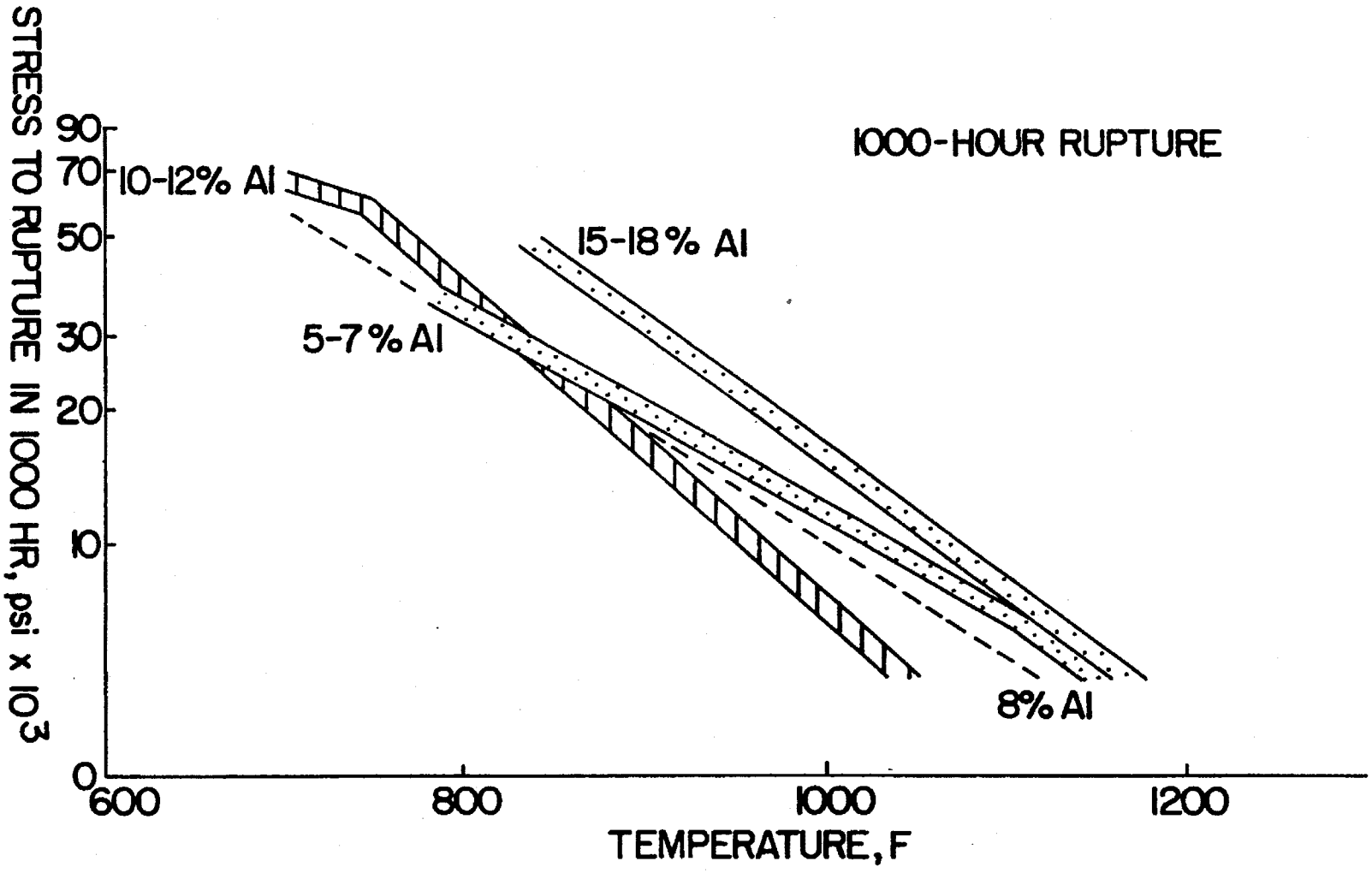

FIG. 4 shows the effect of changes in Al content on creep properties of an aluminum containing iron-base alloy. In particular, FIG. 4 shows stress to rupture in 100 hr. and 1000 hr. for iron-base alloys containing up to 15–18 wt % Al.

Figure 5A:
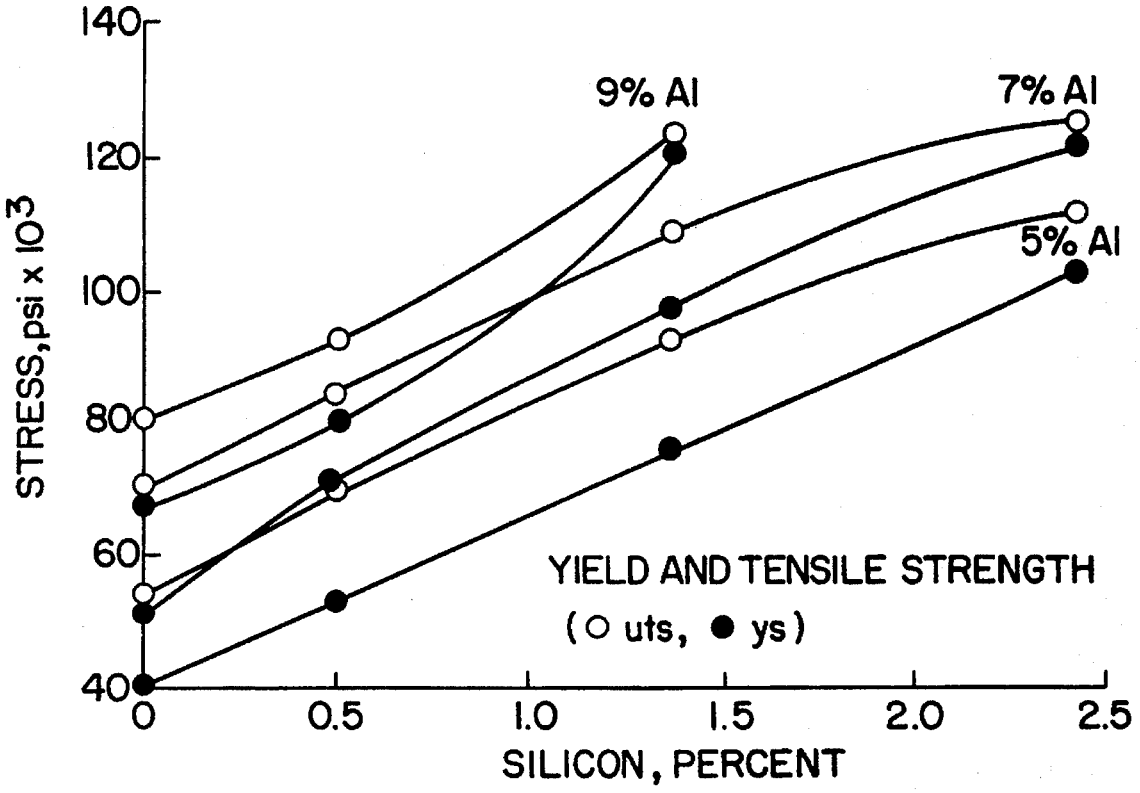
FIG. 5 shows the effect of changes in Si content on room-temperature tensile properties of an Al and Si containing iron-base alloy.
Figure 5B:
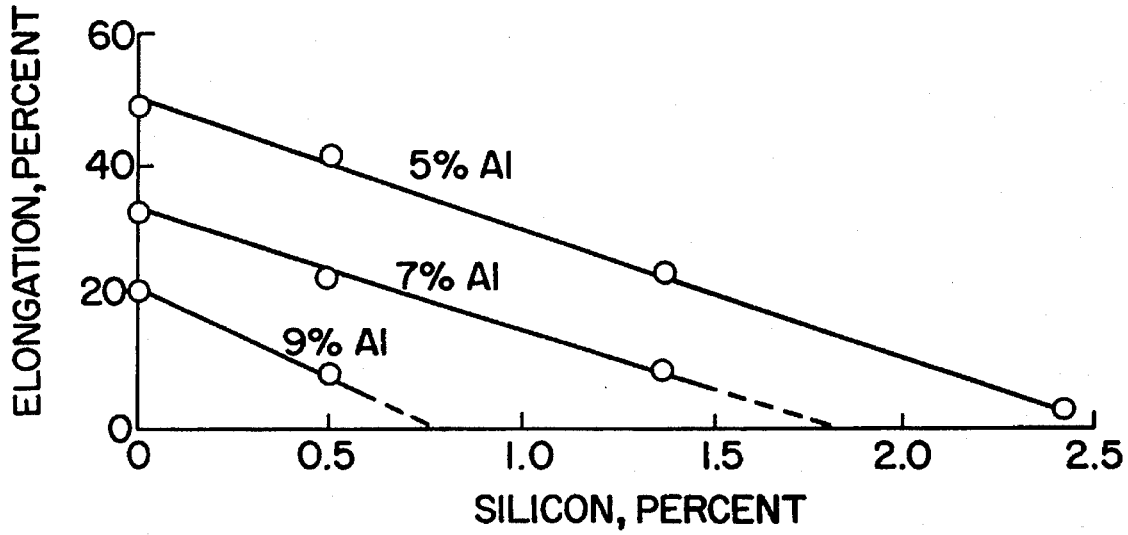

FIG. 5 shows the effect of changes in Si content on room temperature tensile properties of an Al and Si containing iron-base alloy. In particular, FIG. 5 shows yield strength, tensile strength and elongation values for iron-base alloys containing 5.7 or 9 wt % Al and up to 2.5 wt % Si.

Figure 6A:
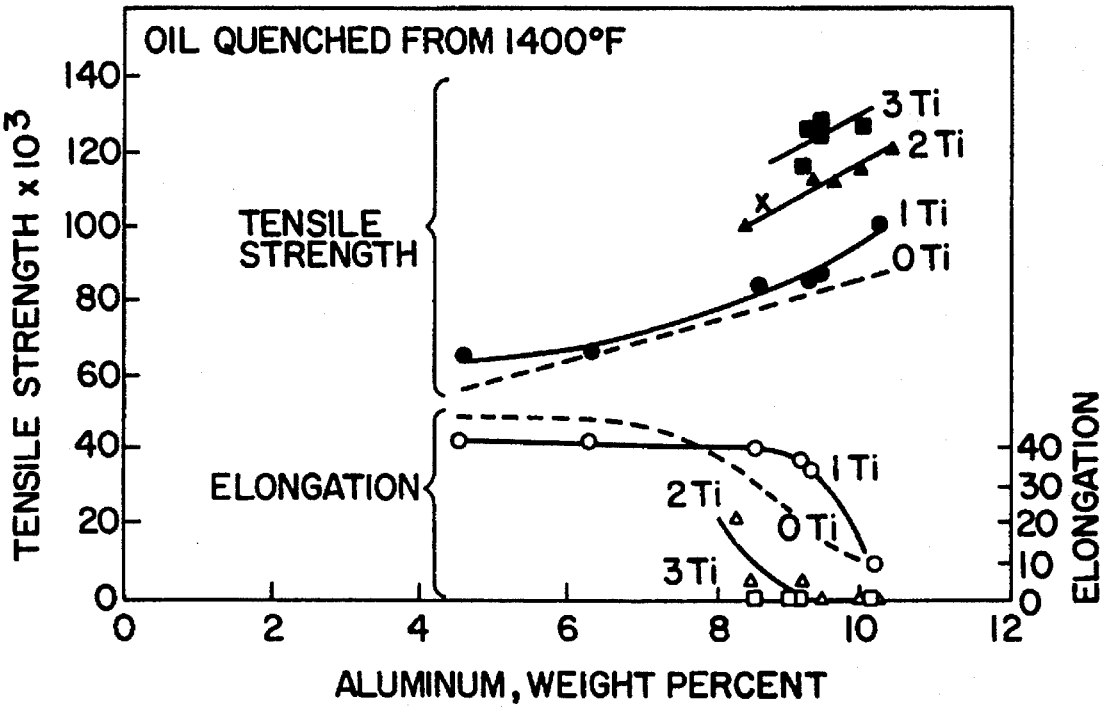
FIG. 6 shows the effect of changes in Ti content on room-temperature properties of an Al and Ti containing iron-base alloy.
Figure 6B:
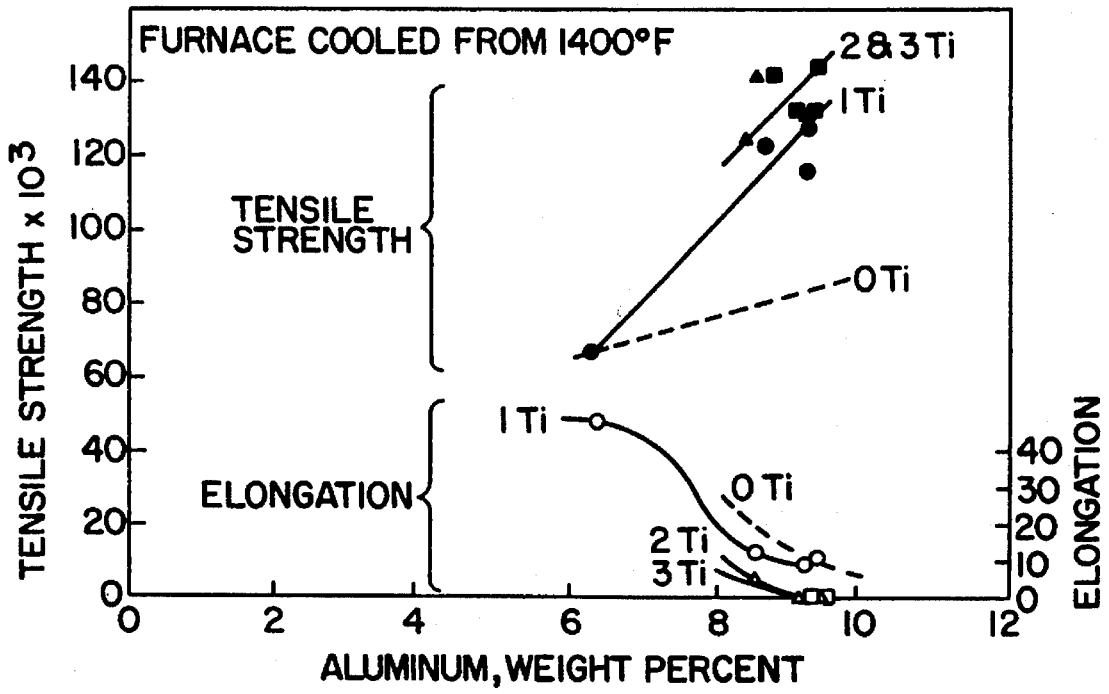

FIG. 6 shows the effect of changes in Ti content on room temperature properties of an Al and Ti containing iron-base alloy. In particular, FIG. 6 shows tensile strength and elongation values for iron-base alloys containing up to 12 wt % Al and up to 3 wt % Ti.

Figure 7:
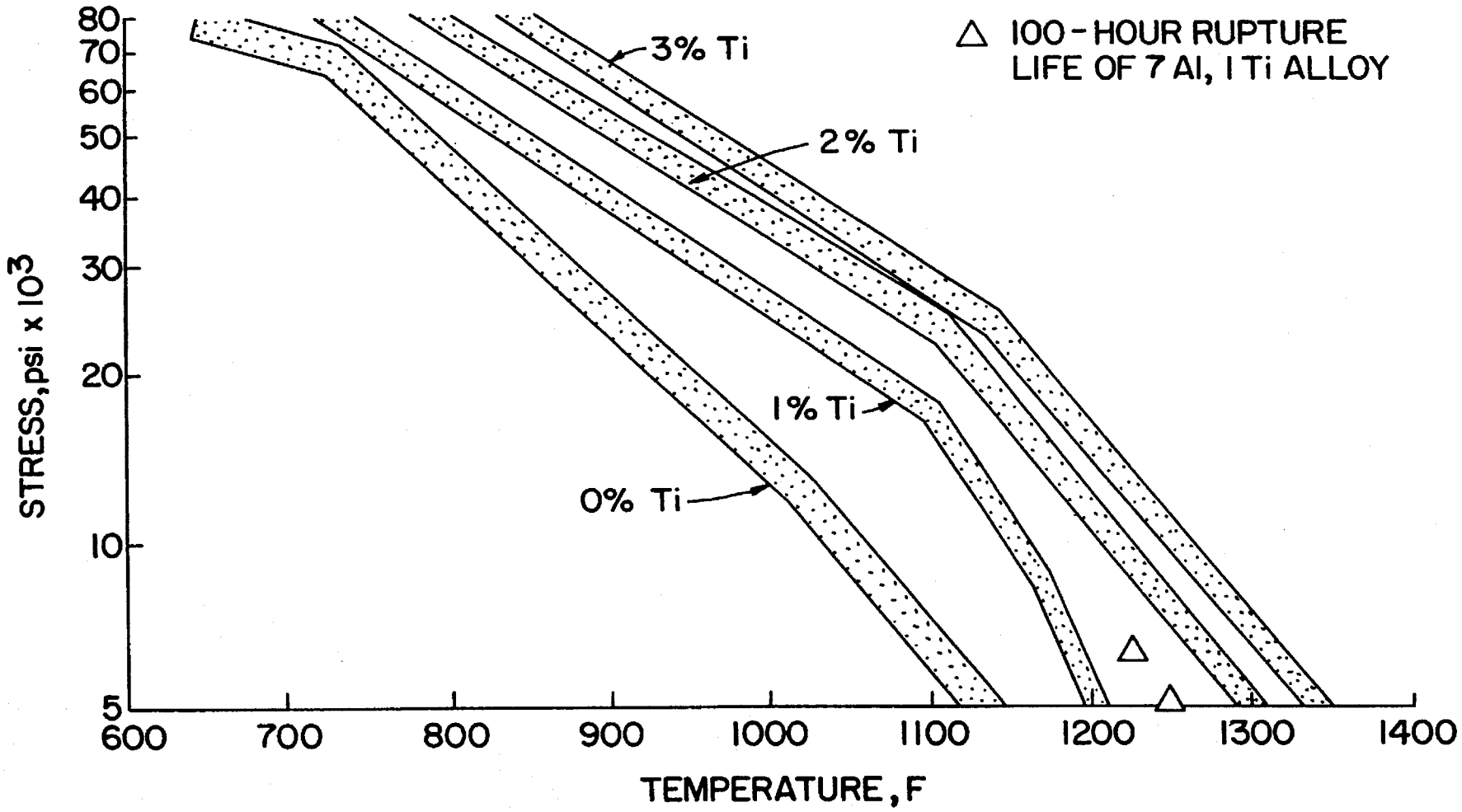
FIG. 7 shows the effect of changes in Ti content on creep rupture properties of a Ti containing iron-base alloy.
Figure 8A:
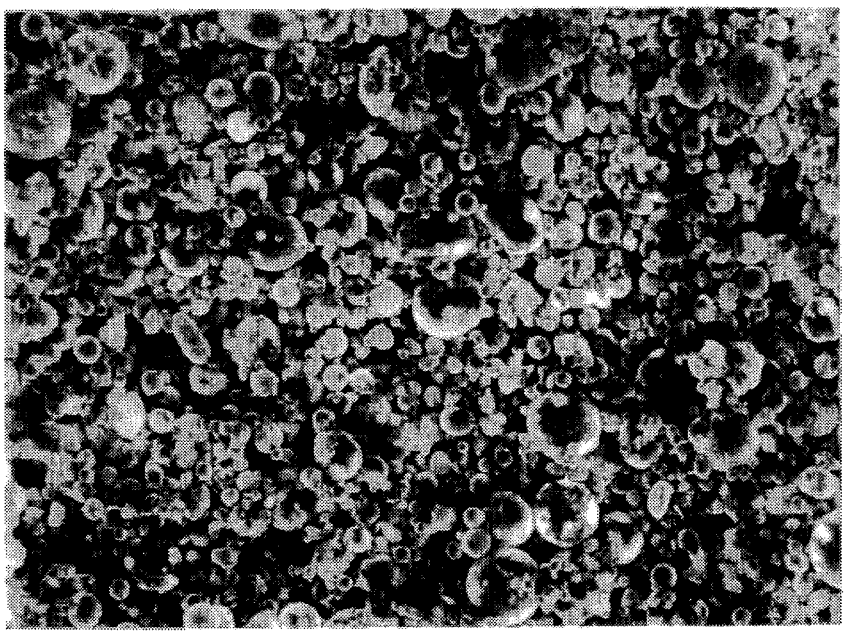
FIGS. 8*a–b* show the morphology of gas-atomized $Fe_3Al$ powder at magnifications of 200× and 1000×, respectively.
Figure 8B:
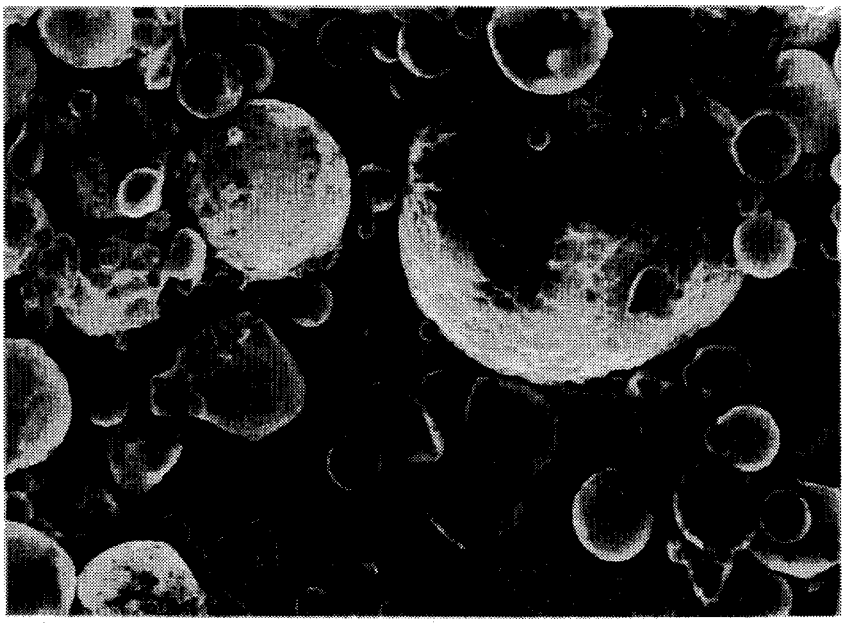
Figure 9A:
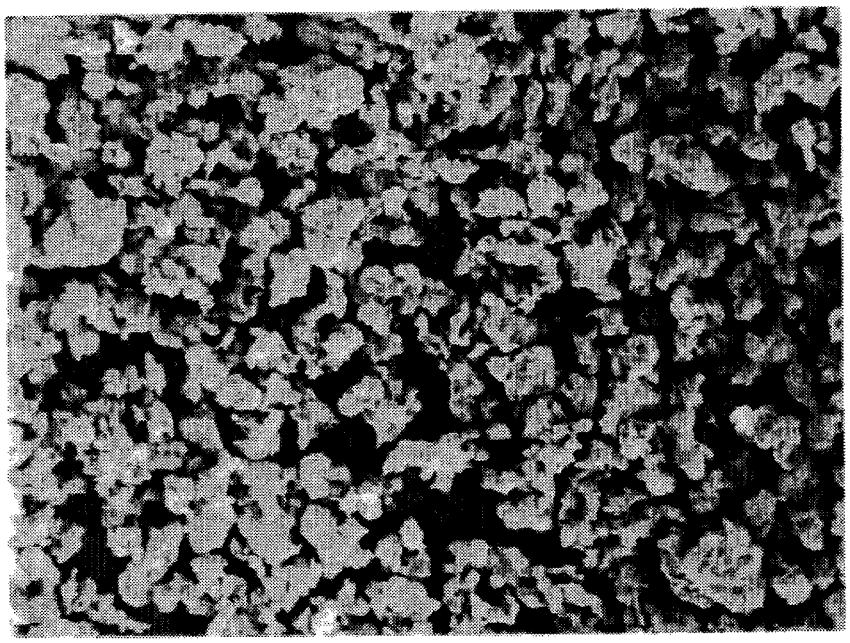
FIGS. 9*a–b* show the morphology of water-atomized $Fe_3Al$ powder at magnifications of 50× and 100×, respectively.
Figure 9B:
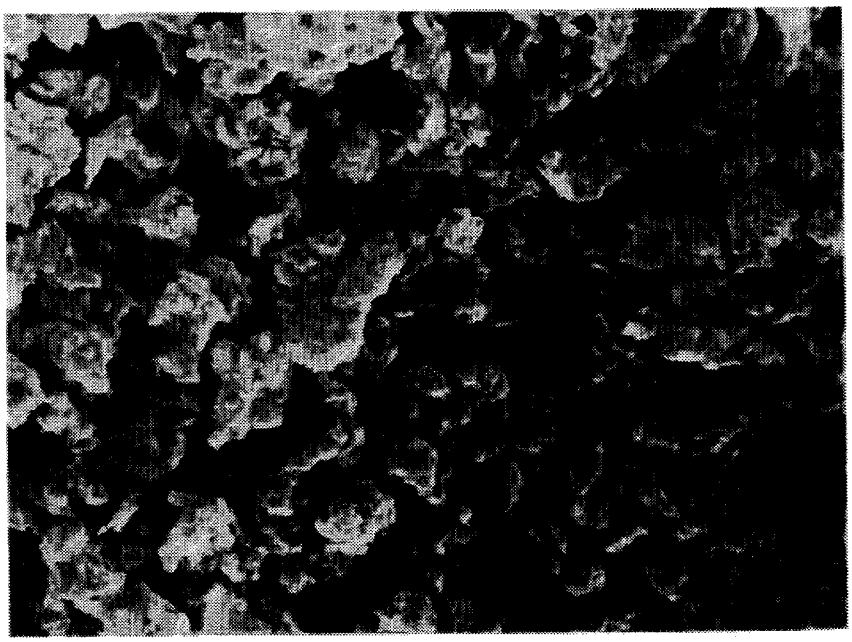

FIG. 7 shows the effect of changes in Ti content on creep rupture properties of a Ti containing iron-base alloy. In particular, FIG. 7 shows stress to rupture values for iron-base alloys containing up to 3 wt % Ti at temperatures of 700° to 1350° F.

FIGS. *8a–b* show the morphology of gas-atomized $Fe_3Al$ powder at magnifications of 200× and 1000×, respectively. As shown in these figures, the gas-atomized powder has a spherical morphology. The gas atomized powder can be obtained by atomizing a stream of molten metal in an inert gas atmosphere such as argon or nitrogen.

FIGS. *9a–b* show the morphology of water-atomized $Fe_3Al$ powder at magnifications of 50× and 100×, respectively. As illustrated in these figures, the water-atomized powder has a highly irregular shape. Further, when the powder is water-atomized an aluminum oxide coating is provided on the powder particles. Sintering of such powder without prior thermal mechanical processing of such powder can provide a product having oxide particles 0.1–20 μm in size. However, by thermomechanical processing of such powder it is possible to break up the oxides and provide a much finer dispersion of oxides having a size of 0.01–0.1 μm in the final product. FIGS. 10–16 show details of a water-atomized powder of iron-aluminide containing 16 wt % Al, balance Fe. The powder includes on the order of 0.5 wt % aluminum oxide with essentially no iron oxide formed as a result of water atomizing the powder.

Figure 10A:
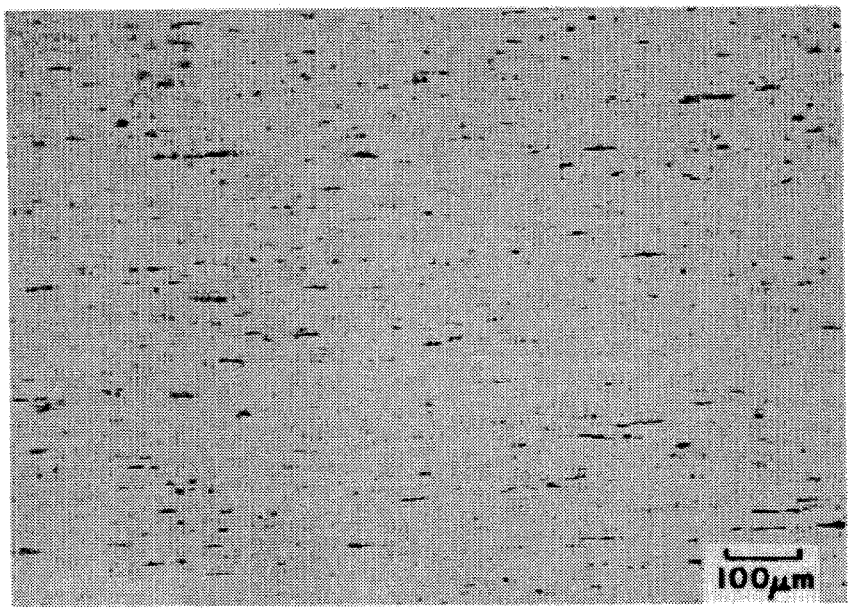
FIGS. 10*a–b* show the presence of oxide stringers in an as-extruded bar of water-atomized powder of iron-aluminide containing 16 wt % Al, balance Fe in an unetched, longitudinal section at magnifications of 100× and 1000×, respectively.
Figure 10B:
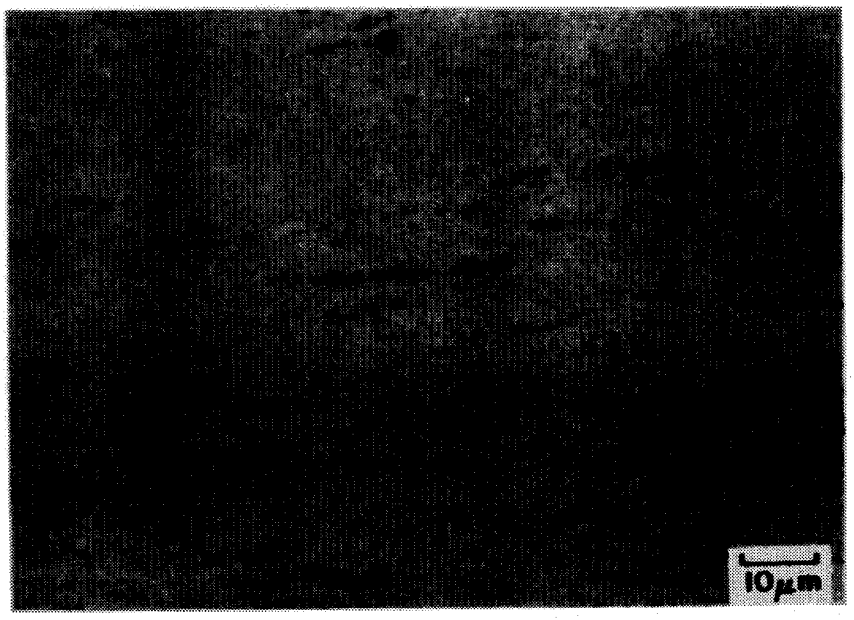
Figure 11A:
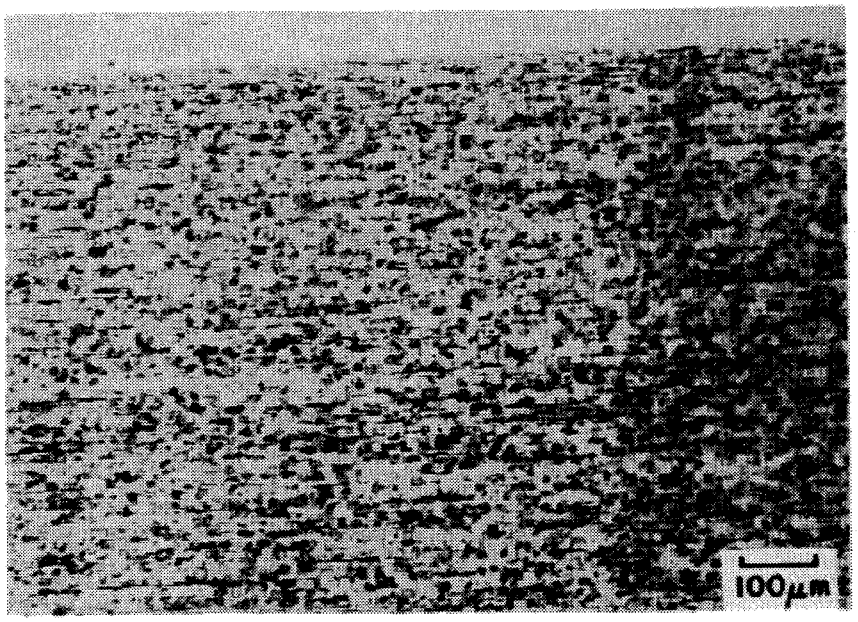
FIGS. 11*a–b* show the microstructure of the as-extruded bar of FIG. 10 in an etched, near edge longitudinal section at magnifications of 100× and 1000×, respectively.
Figure 11B:
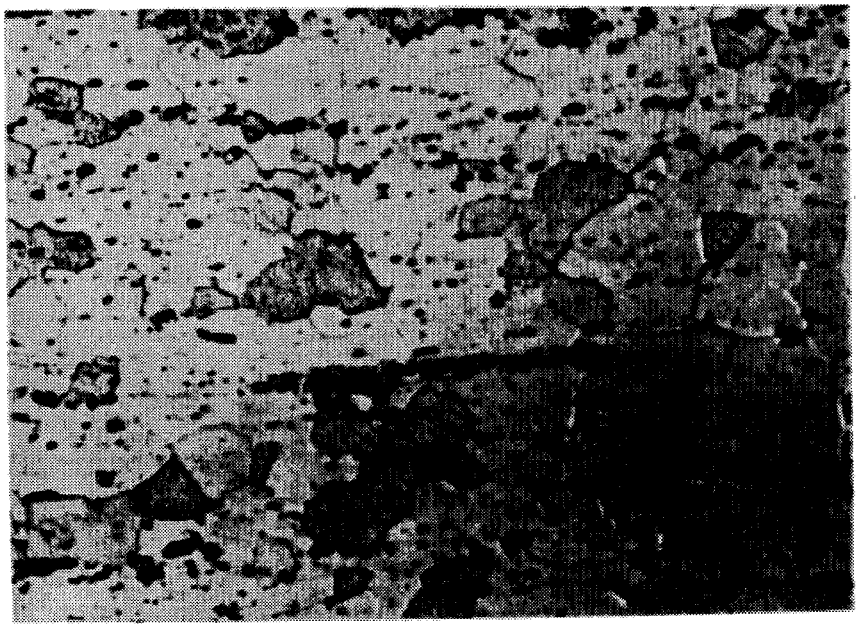
Figure 12A:
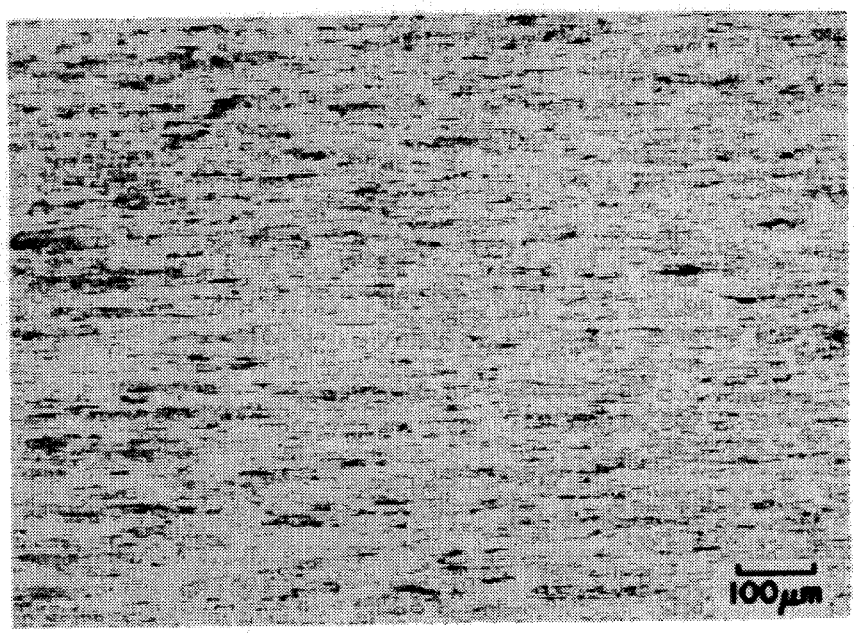
FIGS. 12*a–b* show the as-extruded bar of FIG. 10 in an etched, near center longitudinal section at magnifications of 100× and 1000×, respectively.
Figure 12B:
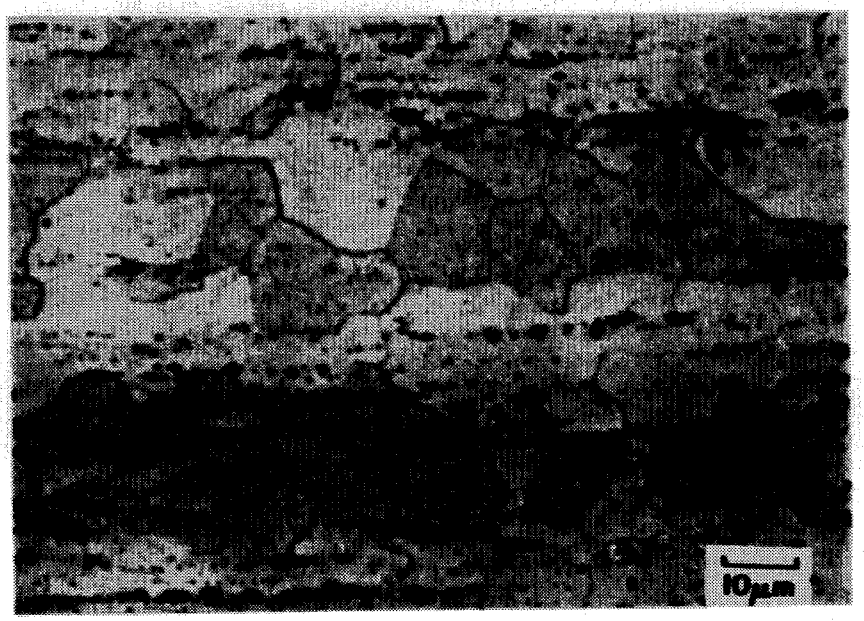
Figure 13A:
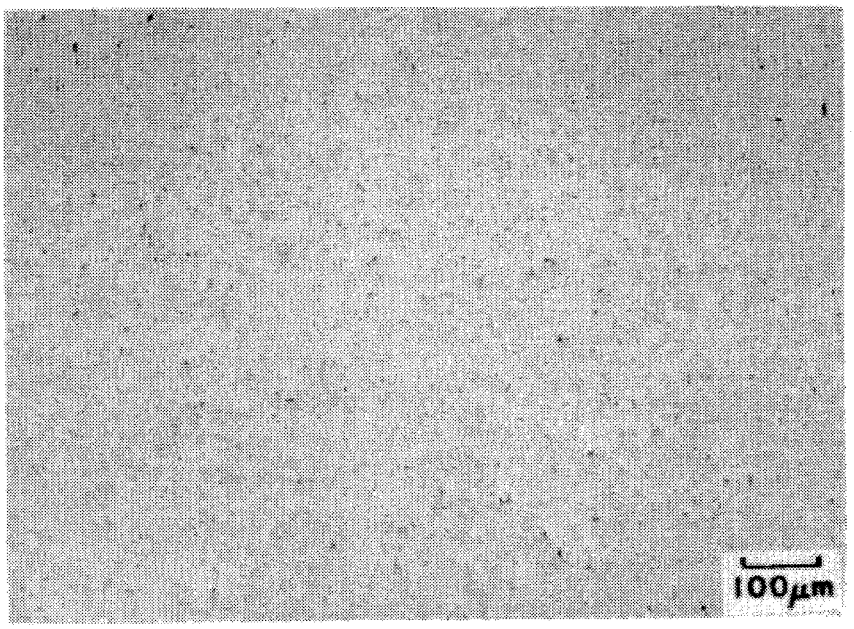
FIGS. 13*a–b* show the as-extruded bar of FIG. 10 in an unetched, transverse section at magnifications of 100× and 1000×, respectively.
Figure 13B:
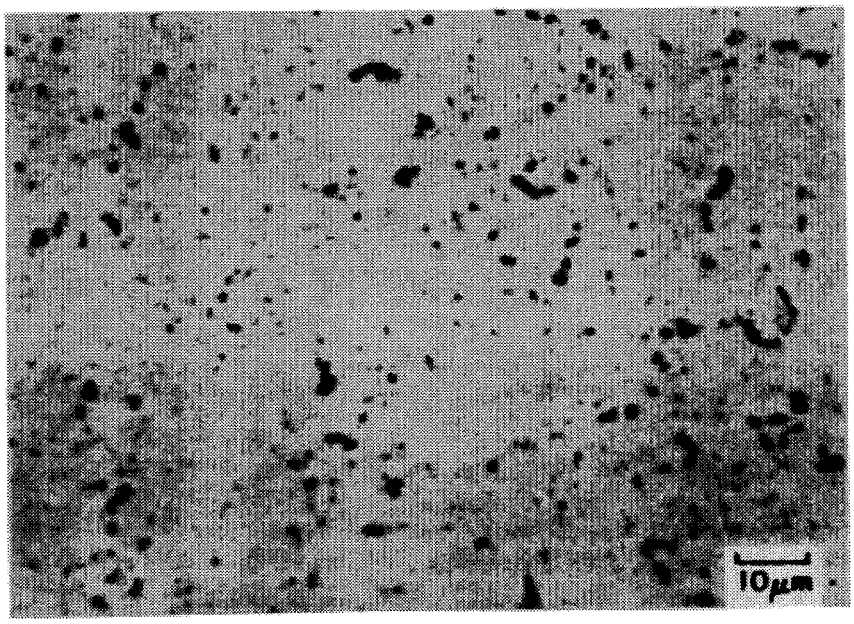
Figure 14A:
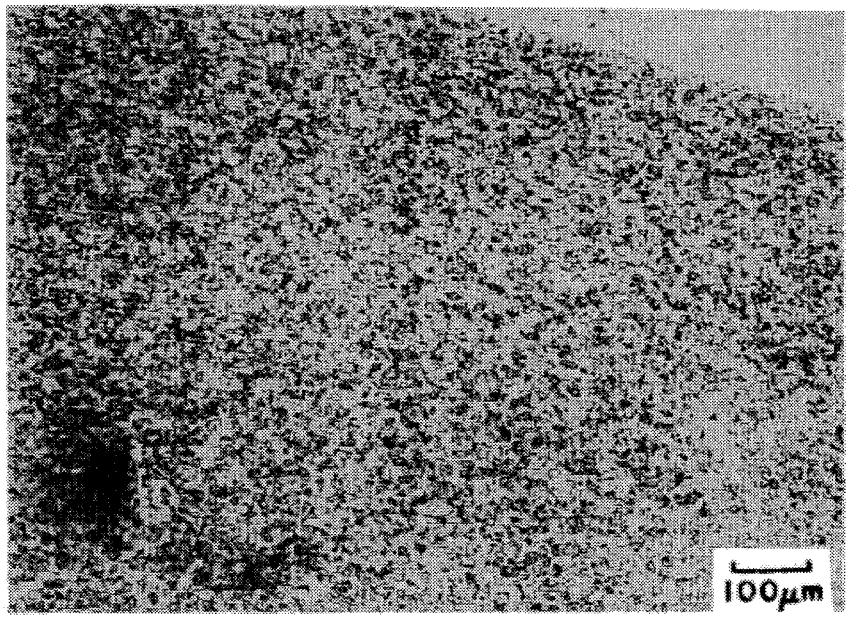
FIGS. 14*a–b* show the as-extruded bar of FIG. 10 in an etched, transverse section at magnifications of 100× and 1000×, respectively.
Figure 14B:
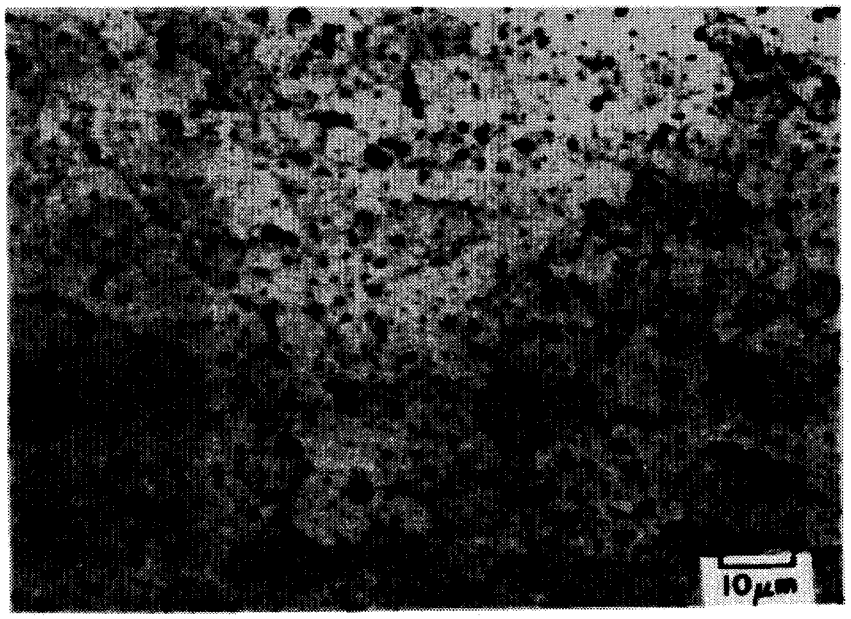
Figure 15A:
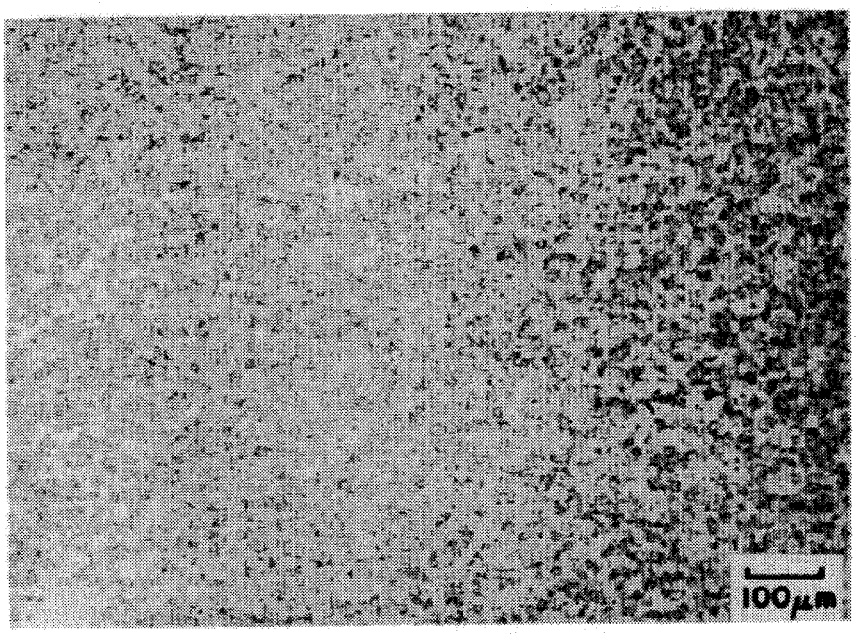
FIGS. 15*a–b* show the as-extruded bar of FIG. 10 in an etched, near center transverse section at magnifications of 100× and 1000×, respectively.
Figure 15B:
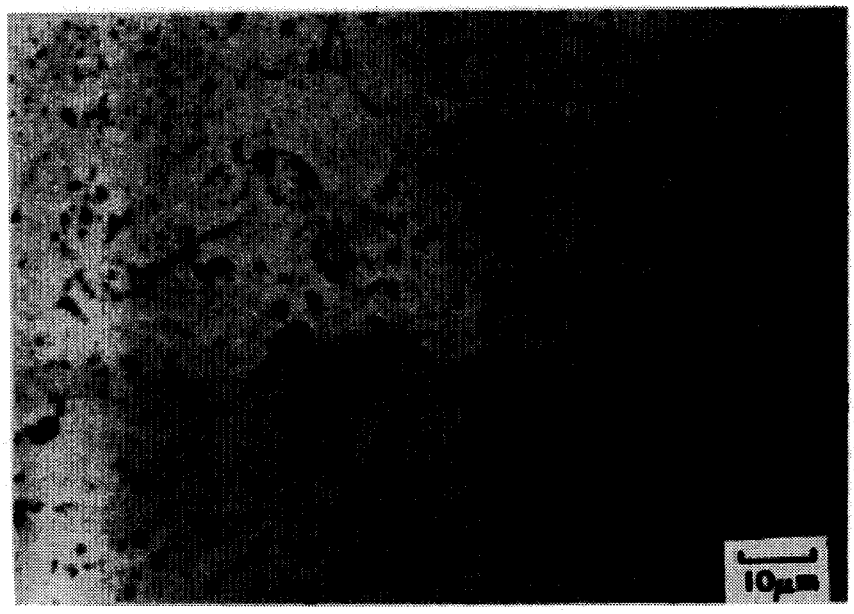
Figure 16A:
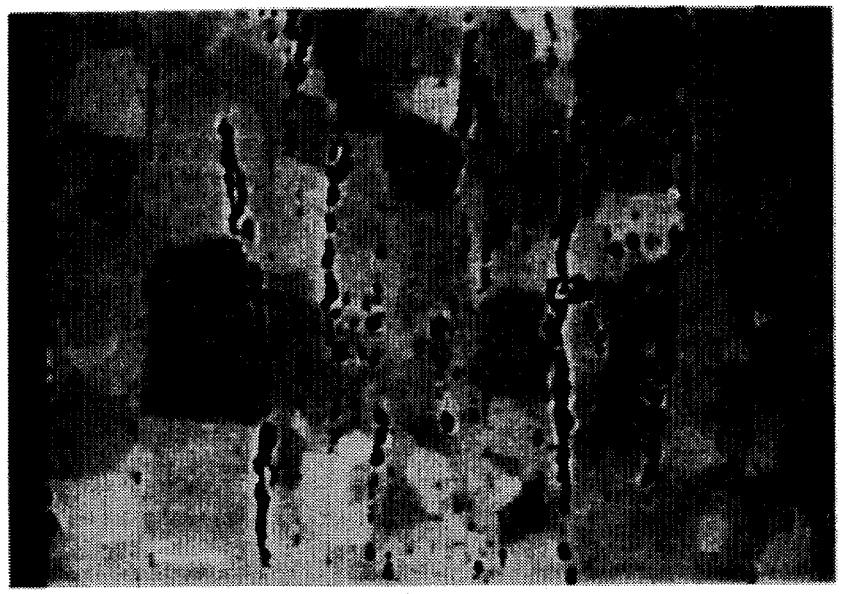
FIGS. 16*a–d* show photomicrographs of the as-extruded bar of FIG. 10 wherein FIG. 16 a shows a back scattered electron image of the oxide features.
Figure 16B:
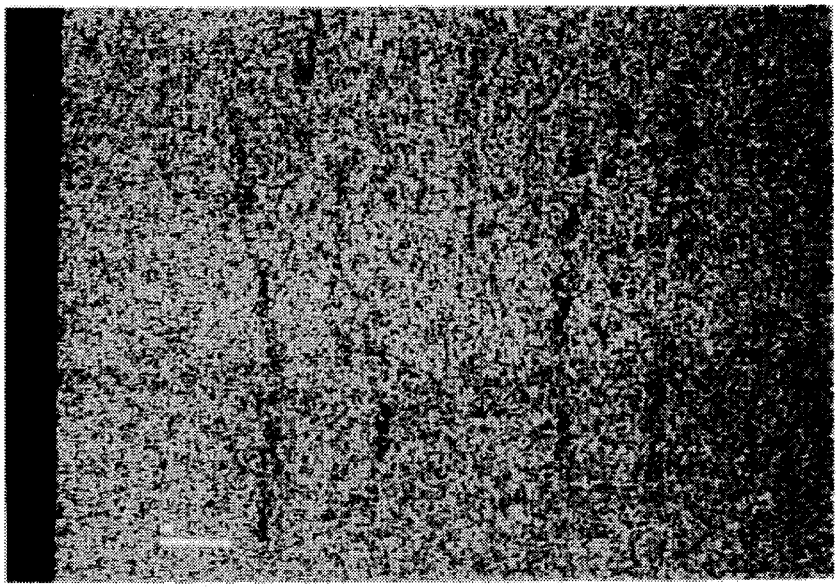
Figure 16C:
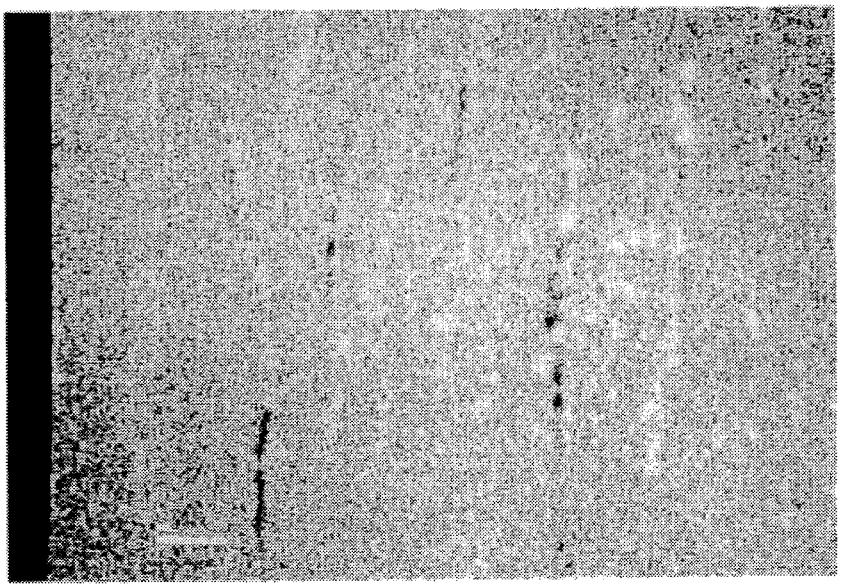
Figure 16D:
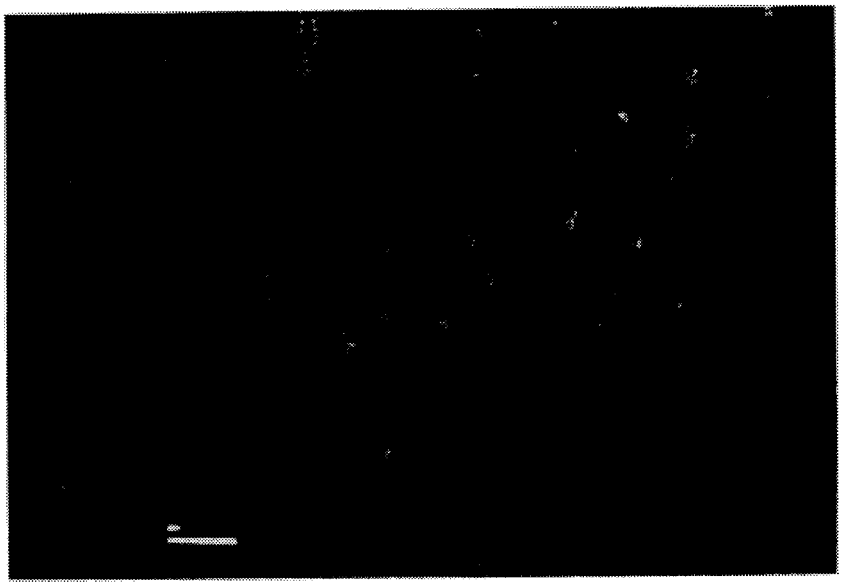
Figure 17A:
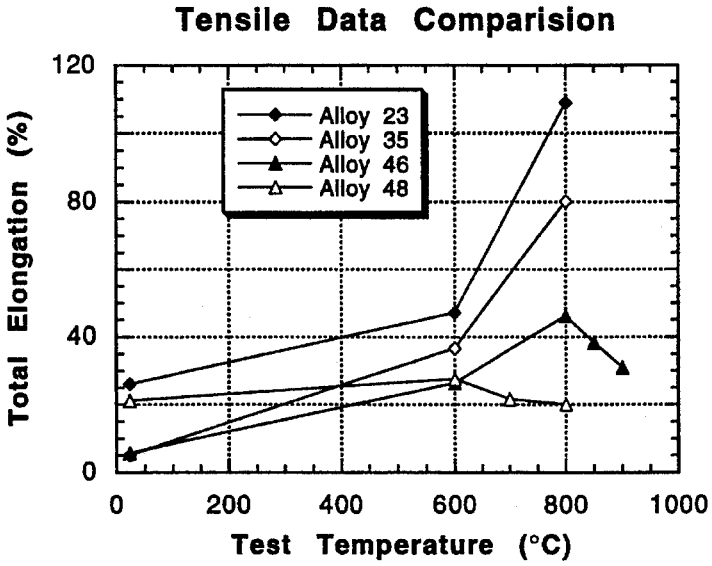
FIGS. 17*a–c* show yield strength, ultimate tensile strength and total elongation for alloy numbers 23, 35, 46 and 48.
Figure 17B:
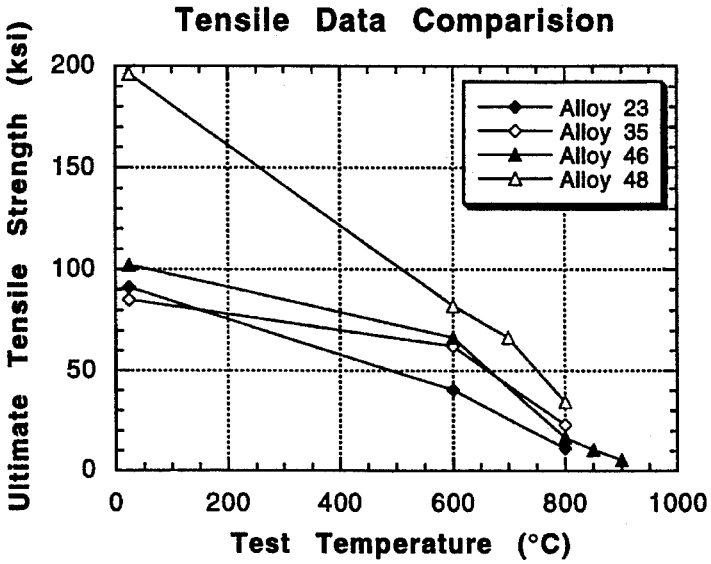
Figure 17C:
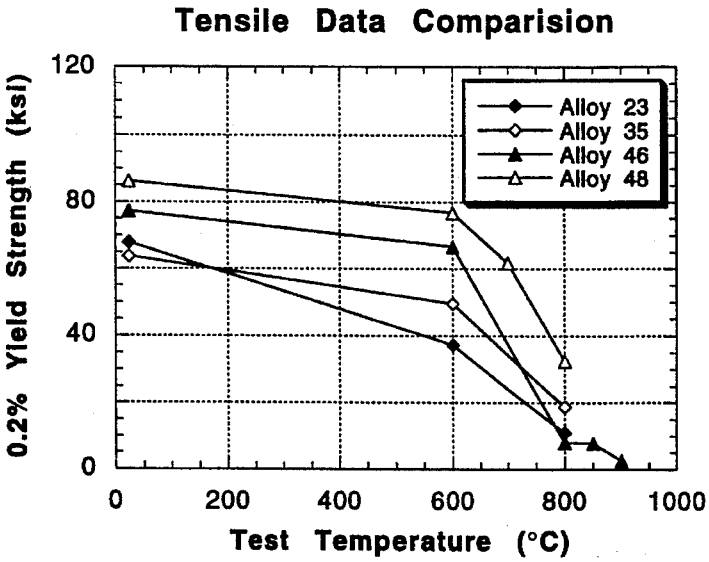
Figure 18A:
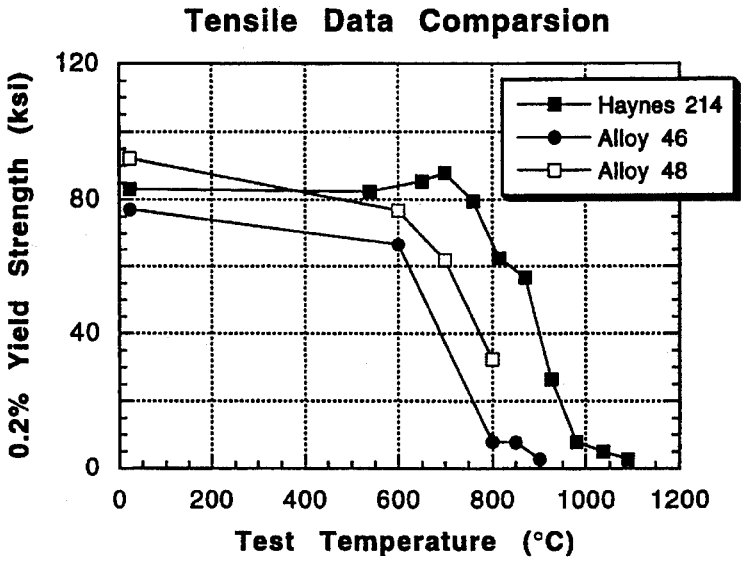
FIGS. 18*a–c* show yield strength, ultimate tensile strength and total elongation for commercial alloy Haynes 214 and alloys 46 and 48.
Figure 18B:
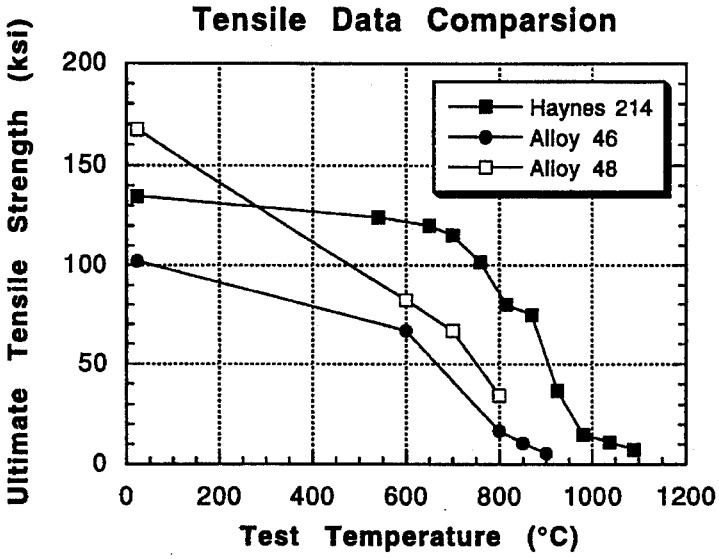
Figure 18C:
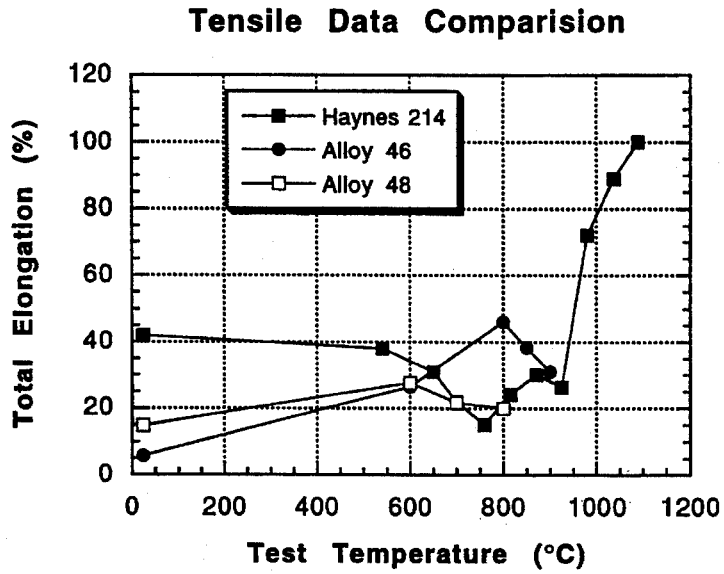
Figure 19A:
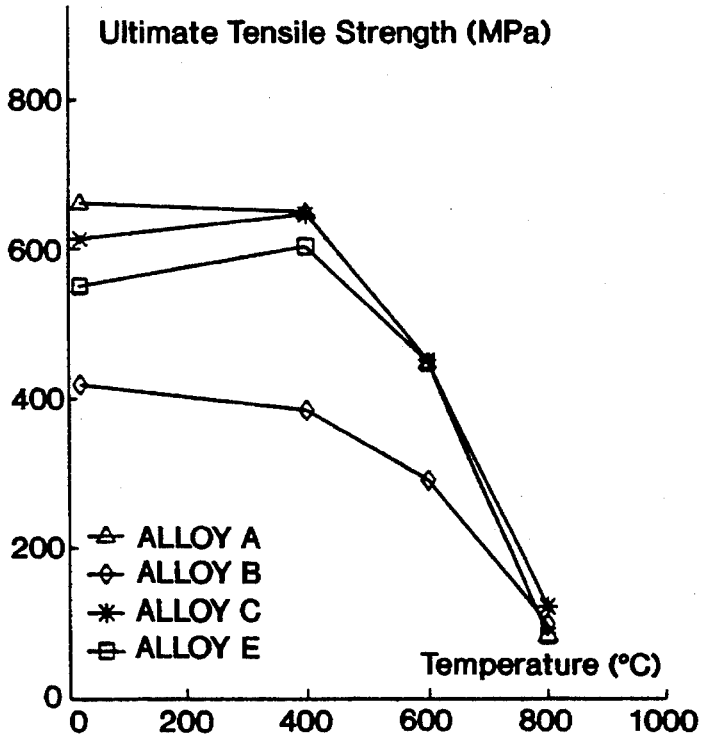
FIGS. 19*a–b* show ultimate tensile strength at tensile strain rates of $3\times10^{-4}$/s and $3\times10^{-2}$/s, respectively.
Figure 19B:
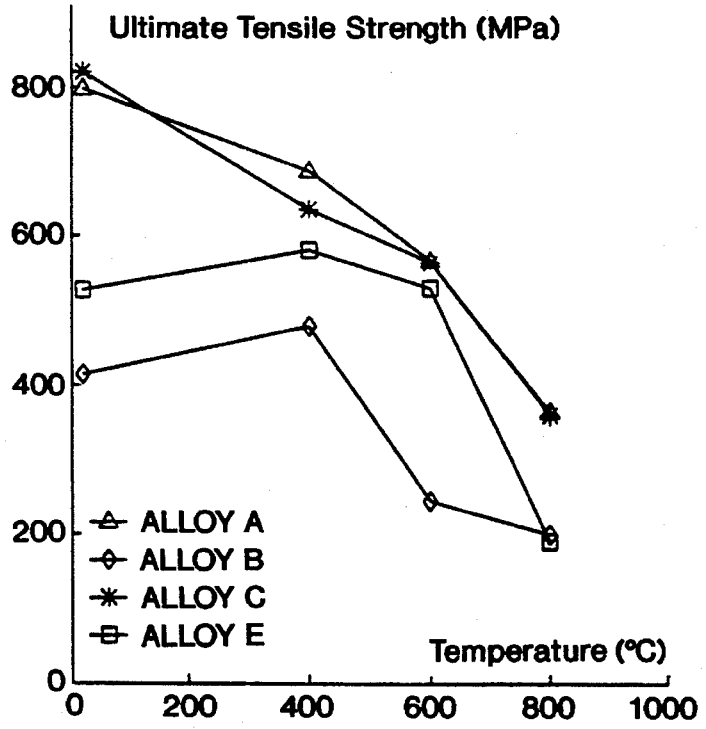
Figure 19C:
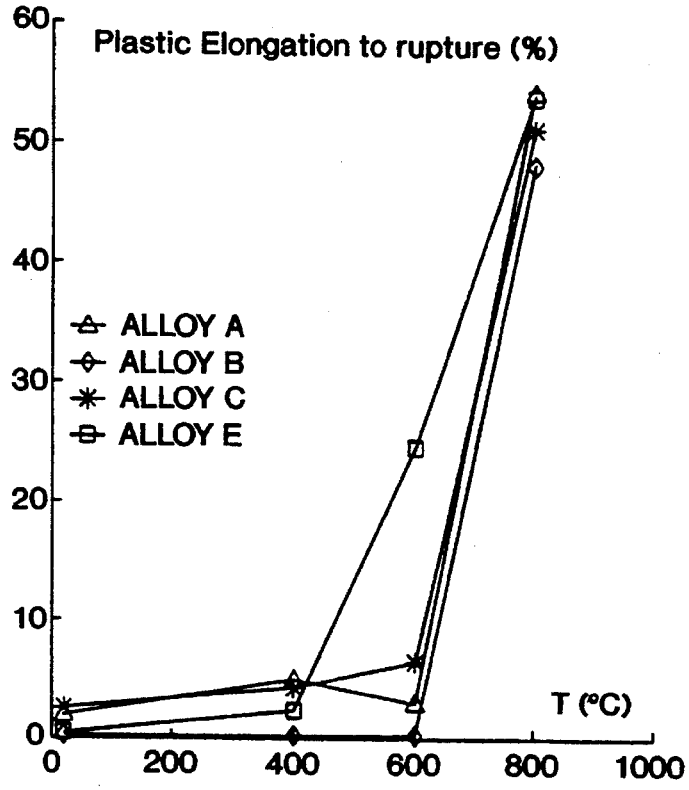
FIGS. 19*c–d* show plastic elongation to rupture at strain rates of $3\times10^{-4}$/s and $3\times10^{-2}$/s, respectively, for alloys 57, 58, 60 and 61.
Figure 19D:
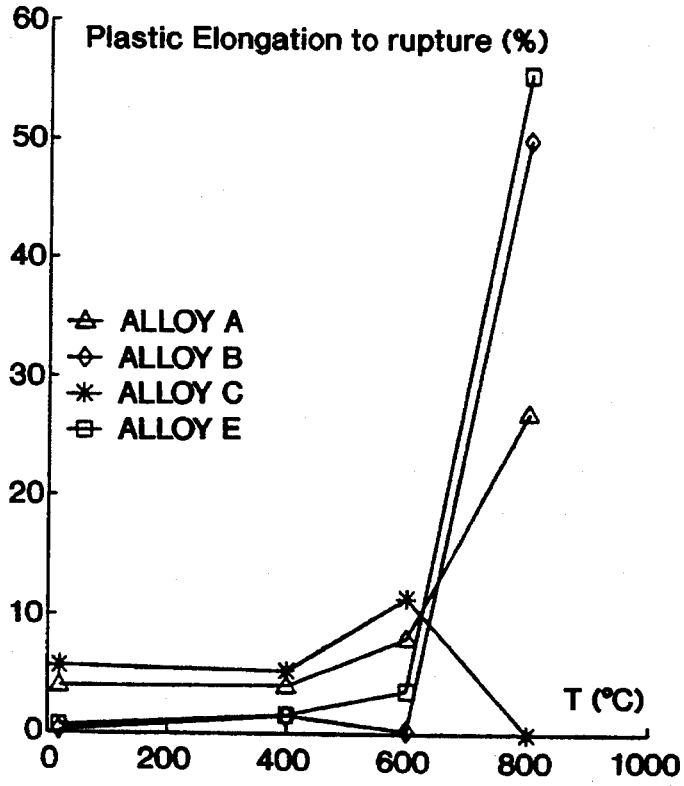
Figure 20A:
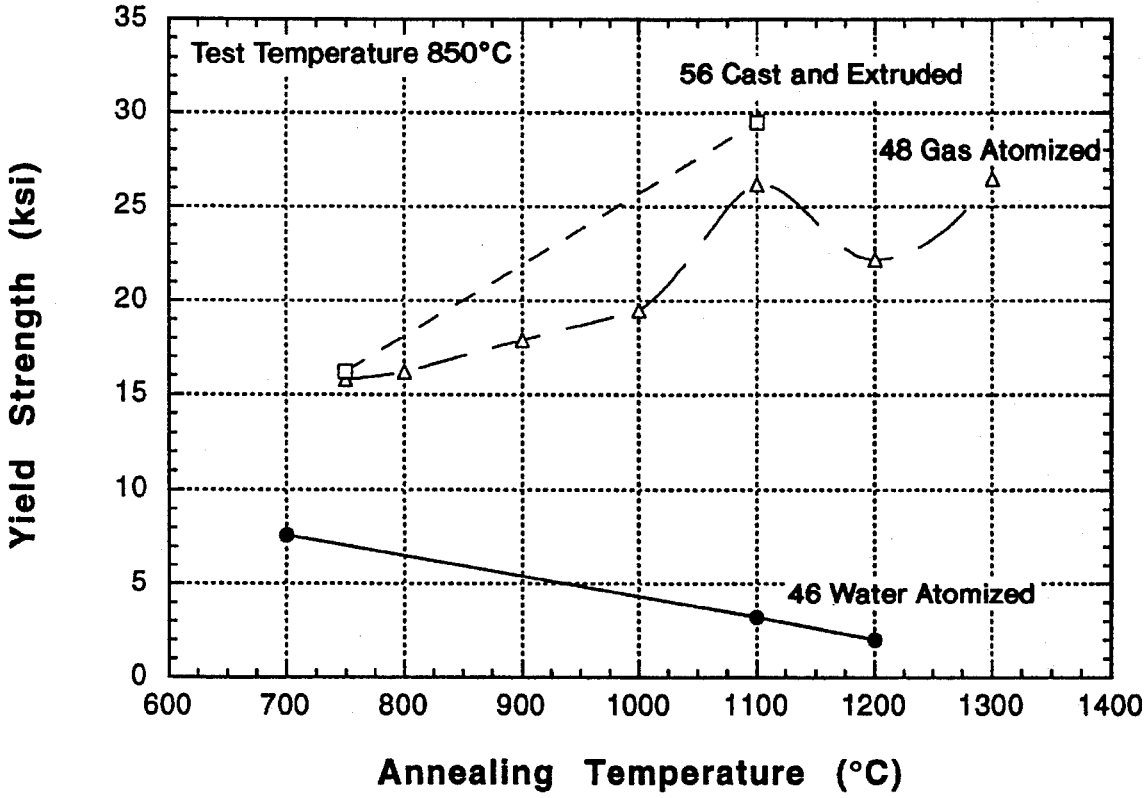
FIGS. 20*a–b* show yield strength and ultimate tensile strength, respectively, at 850° C. for alloys 46, 48 and 56, as a function of annealing temperatures.
Figure 20B:
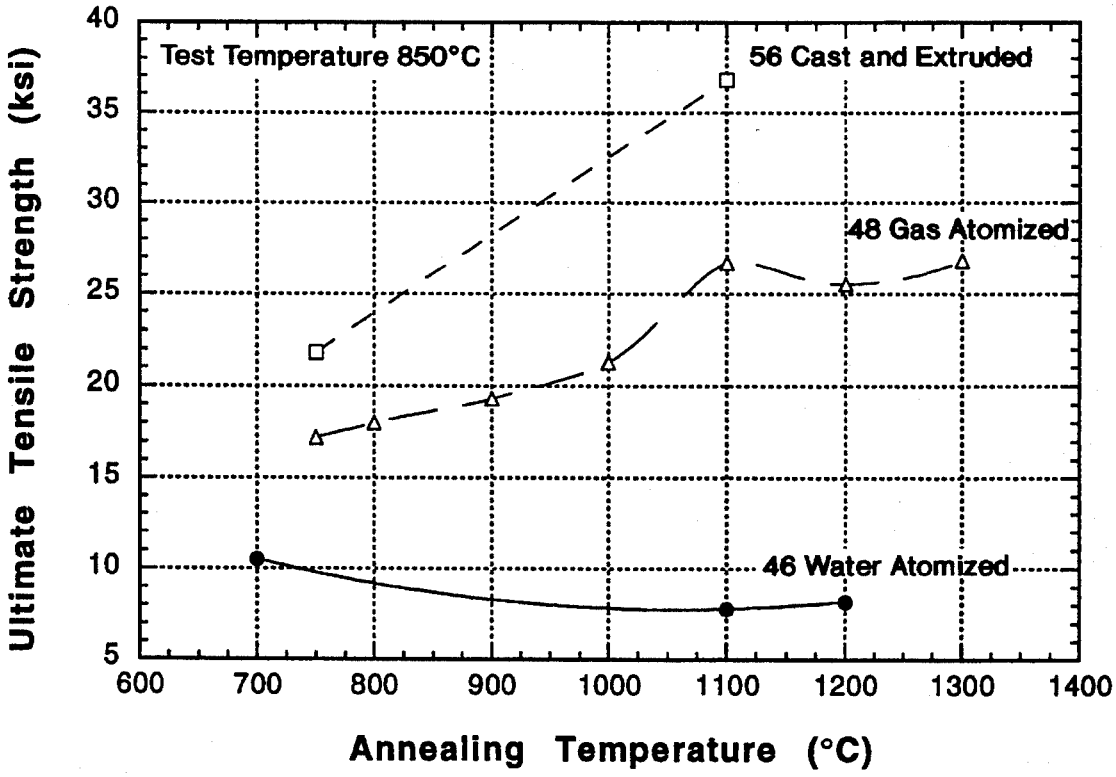
Figure 21A:
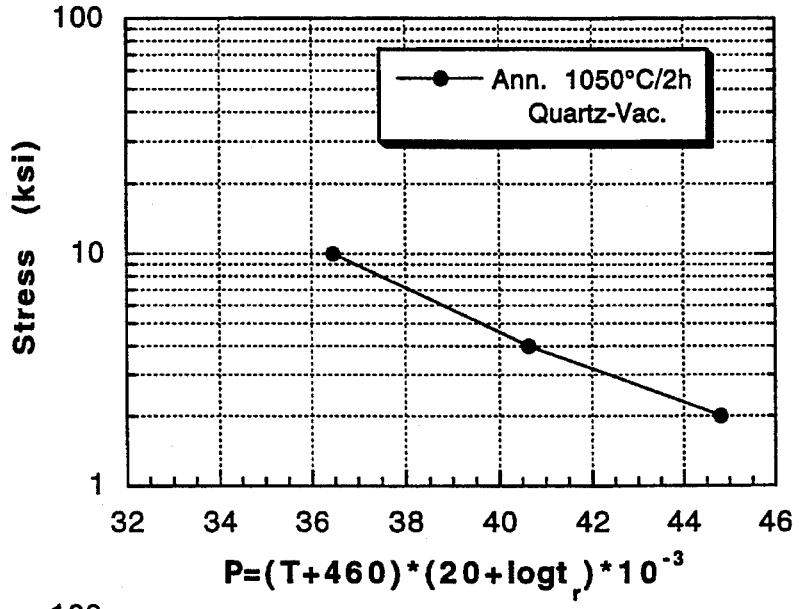
Figure 21B:
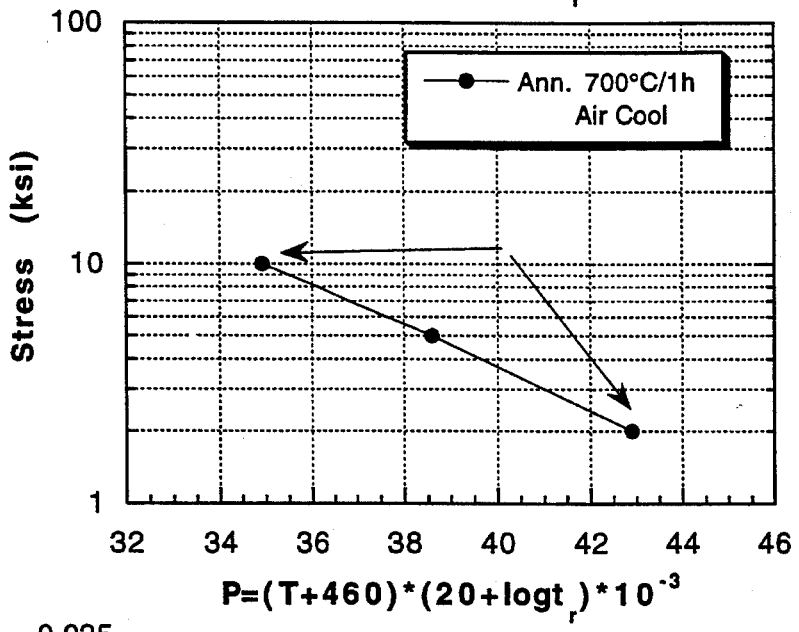
Figure 21C:
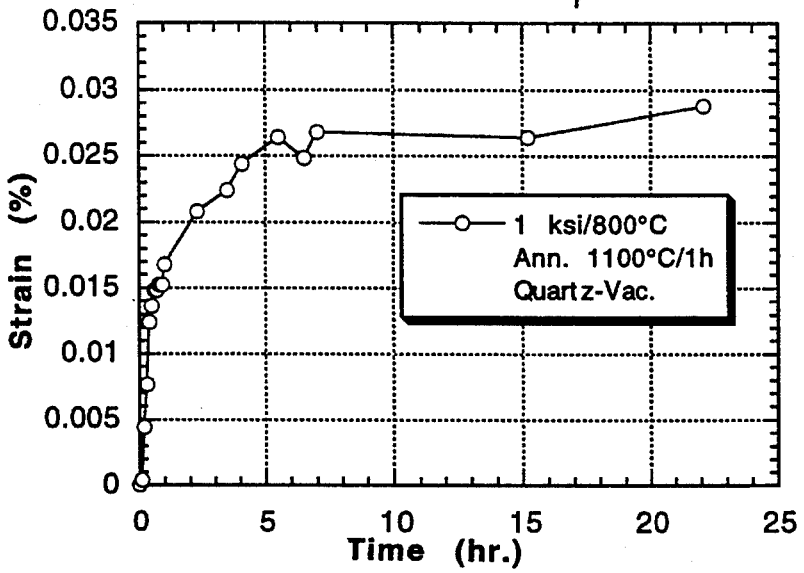
Figure 21D:
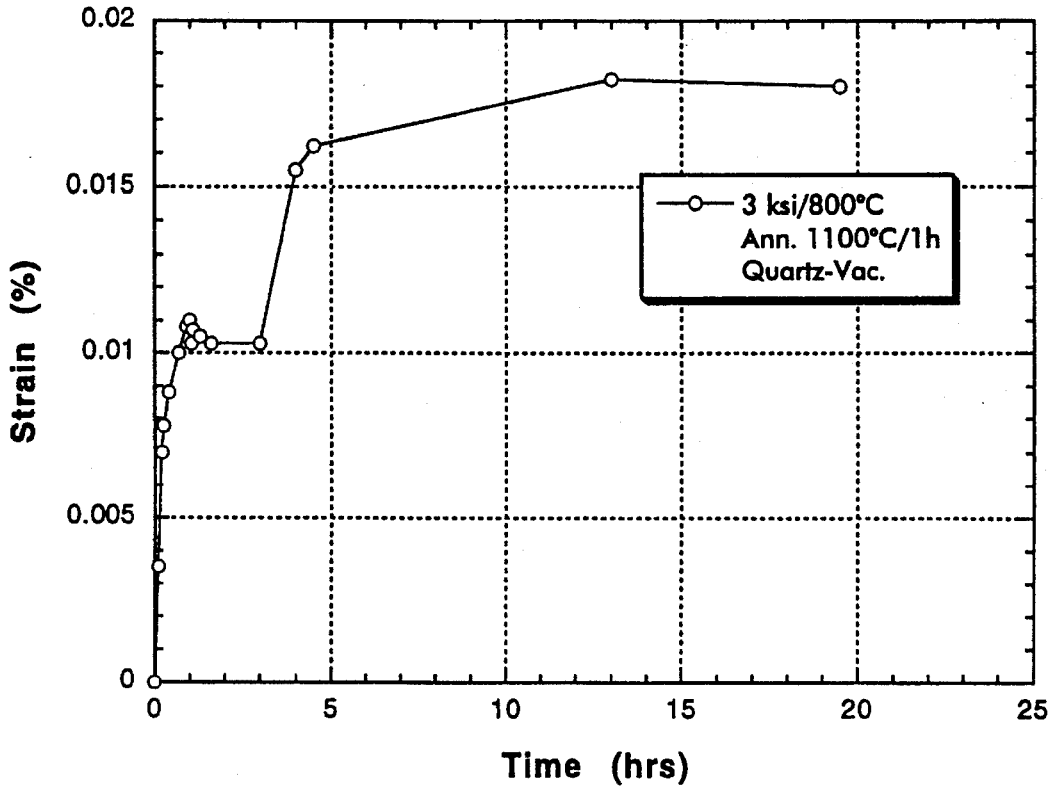
Figure 21E:
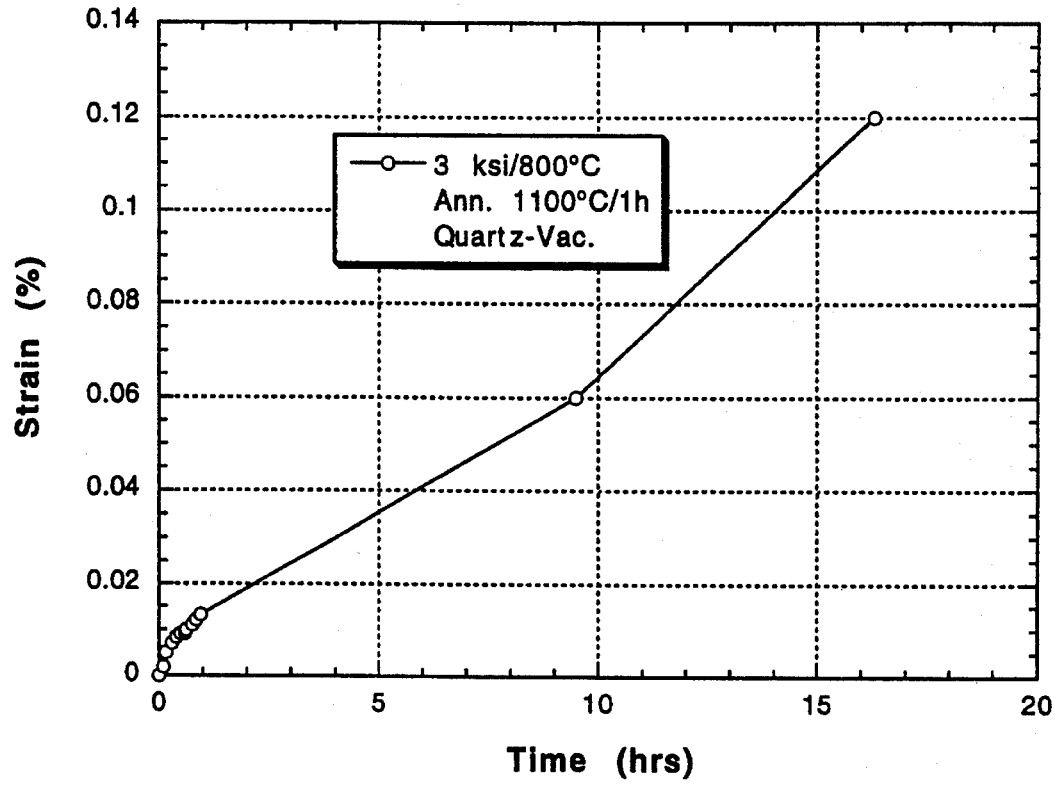

FIGS. 10*a–b* show the presence of oxide stringers in an as-extruded bar of water-atomized powder of iron-aluminide containing 16 wt % Al, balance Fe in an unetched, longitudinal section at magnifications of 100× and 1000×, respectively. FIGS. 11*a–b* show the microstructure of the as-extruded bar of FIG. 10 in an etched, near edge longitudinal section at magnifications of 100× and 1000×, respectively. FIGS. 12*a–b* show the as-extruded bar of FIG. 10 in an etched, near center longitudinal section at magnifications of 100× and 1000×, respectively. FIGS. 13*a–b* show the as-extruded bar of FIG. 10 in an unetched, transverse section at magnifications of 100× and 1000×, respectively. FIGS. 14*a–b* show the as-extruded bar of FIG. 10 in an etched, transverse section at magnifications of 100× and 1000×, respectively. FIGS. 15*a–b* show the as-extruded bar of FIG. 10 in an etched, near center transverse section at magnifications of 100× and 1000×, respectively. FIGS. 16*a–d* show photomicrographs of the as-extruded bar of FIG. 10 wherein FIG. 16*a* shows a back scattered electron image of the oxide features, FIG. 16*b* is an iron map where dark areas are low in iron, FIG. 16*c* is an aluminum map showing the areas that were low in iron and enriched in aluminum, and FIG. 16*d* is an oxygen map showing its concentration where aluminum is enriched and iron is low.

FIGS. 17–25 shows graphs of properties of alloys in Tables 1*a* and 1*b*. FIGS. 17*a–c* show yield strength, ultimate tensile strength and total elongation for alloy numbers 23, 35, 46 and 48. FIGS. 18*a–c* show yield strength, ultimate tensile strength and total elongation for alloys 46 and 48 compared to commercial alloy Haynes 214. FIGS. 19*a–b* show ultimate tensile strength at tensile strain rates of $3\times10^{-4}$/s and $3\times10^{-2}$/s, respectively; and FIGS. 19*c–d* show plastic elongation to rupture at strain rates of $3\times10^{-4}$/s and $3\times10^{-2}$/s, respectively, for alloys 57, 58, 60 and 61. FIGS. 20*a–b* show yield strength and ultimate tensile strength, respectively, at 850° C. for alloys 46, 48 and 56, as a function of annealing temperatures. FIGS. 21*a–e* show creep data for alloys 35, 46, 48 and 56. FIG. 21*a* shows creep data for alloy 35 after annealing at 1050° C. for two hours in vacuum. FIG. 21*b* shows creep data for alloy 46 after annealing at 700° C. for one hour and air cooling. FIG. 21*c* shows creep data for alloy 48 after annealing at 1100° C. for one hour in vacuum and wherein the test is carried out at 1 ksi at 800° C. FIG. 21*d* shows the sample of FIG. 21*c* tested at 3 ksi and 800° C. and FIG. 21*e* shows alloy 56 after annealing at 1100° C. for one hour in vacuum and tested at 3 ksi and 800° C.

Figure 22A:
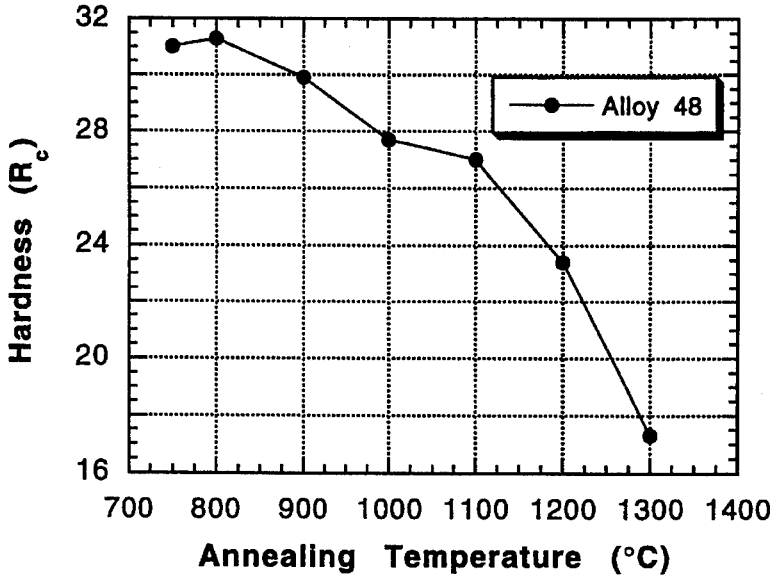
Figure 22B:
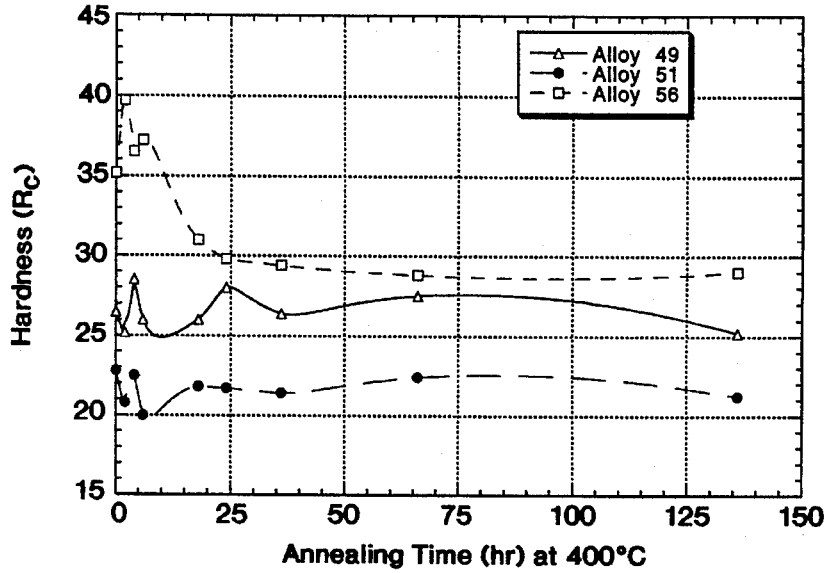
Figure 22C:
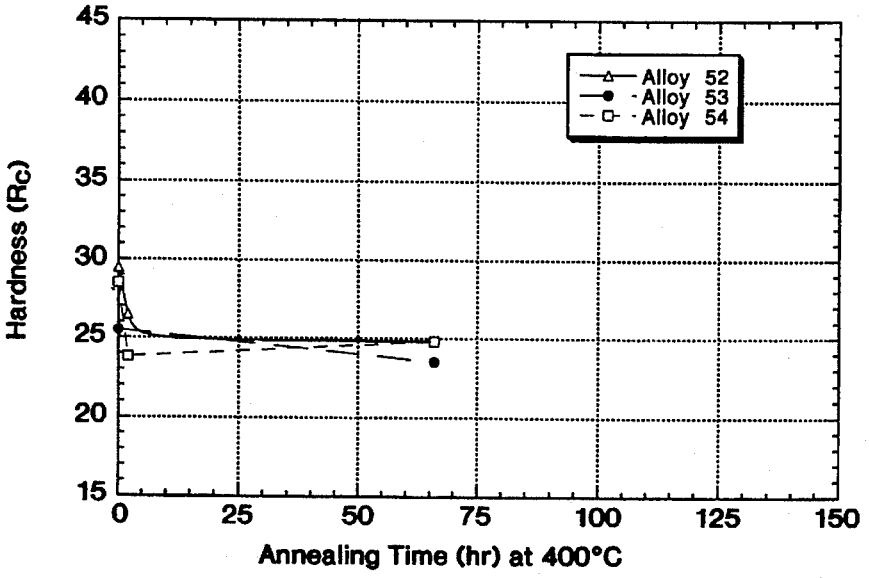
Figure 23A:
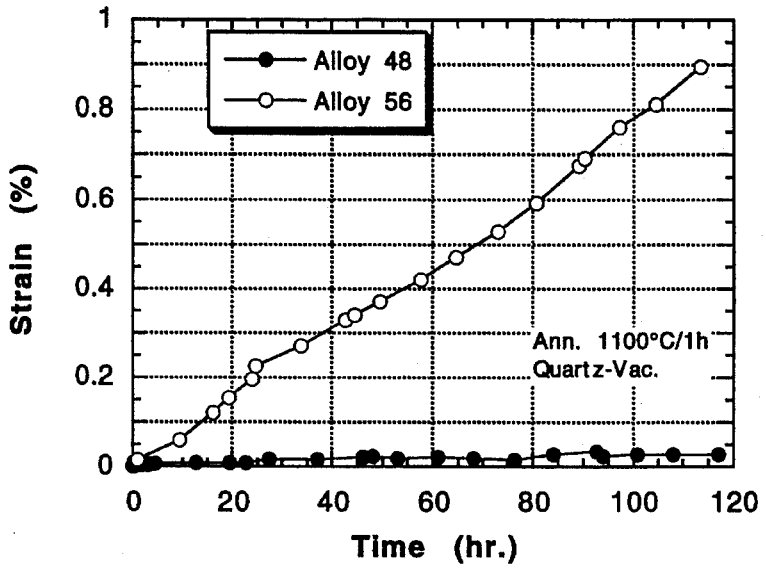
Figure 23B:
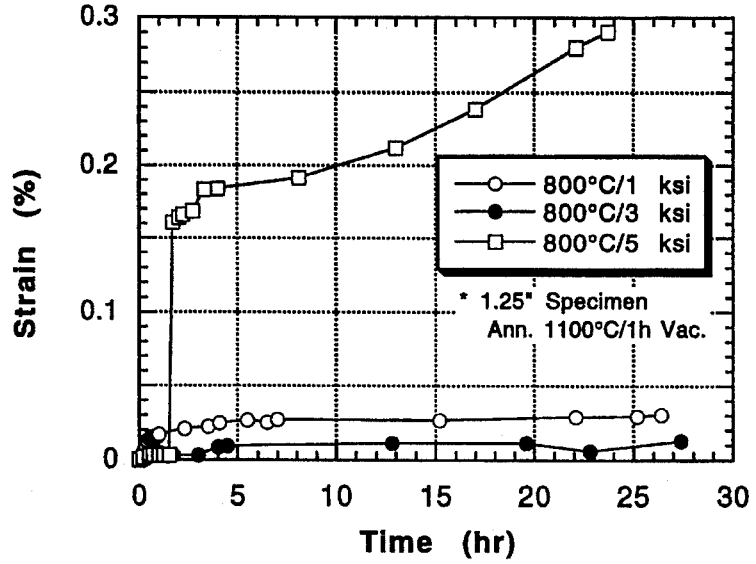
Figure 23C:
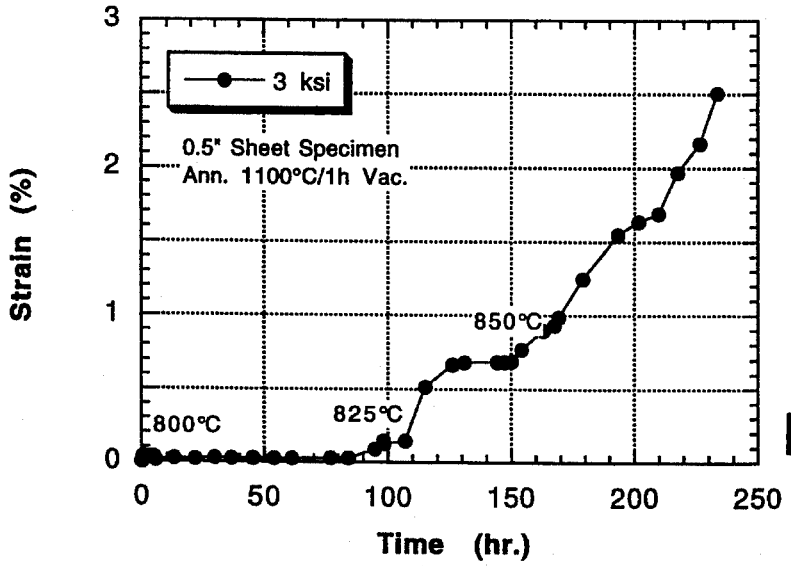
Figure 23D:
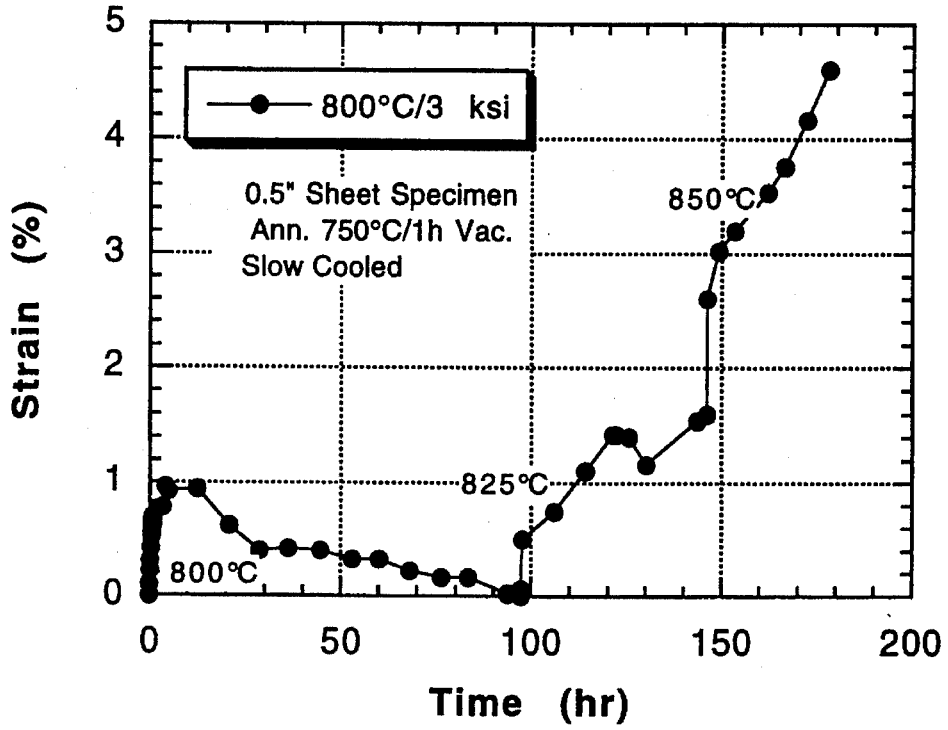
Figure 23E:
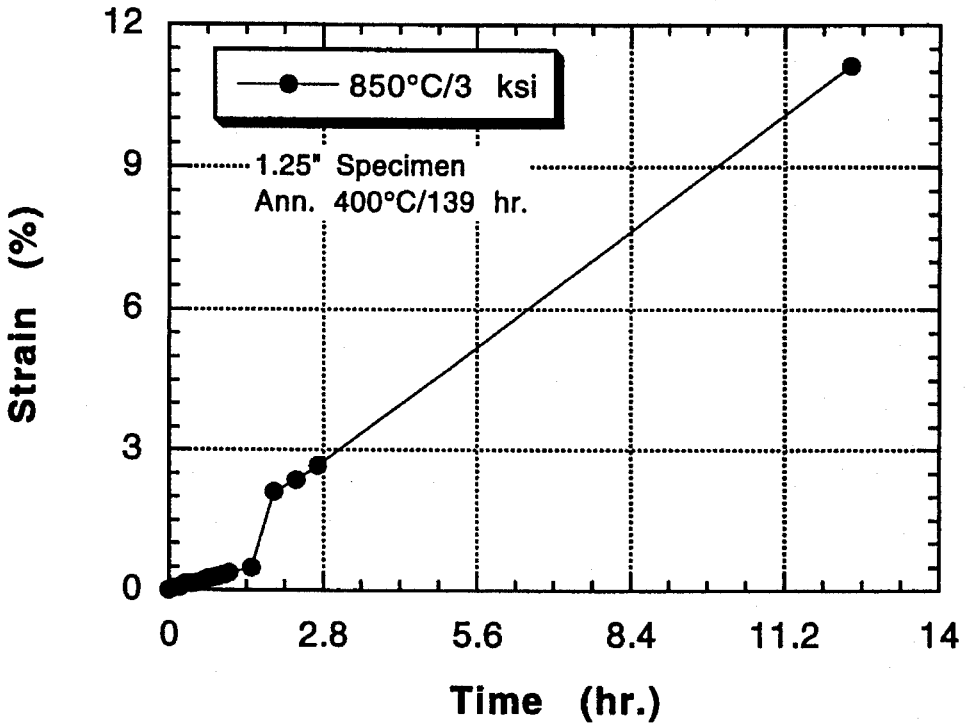
Figure 24A:
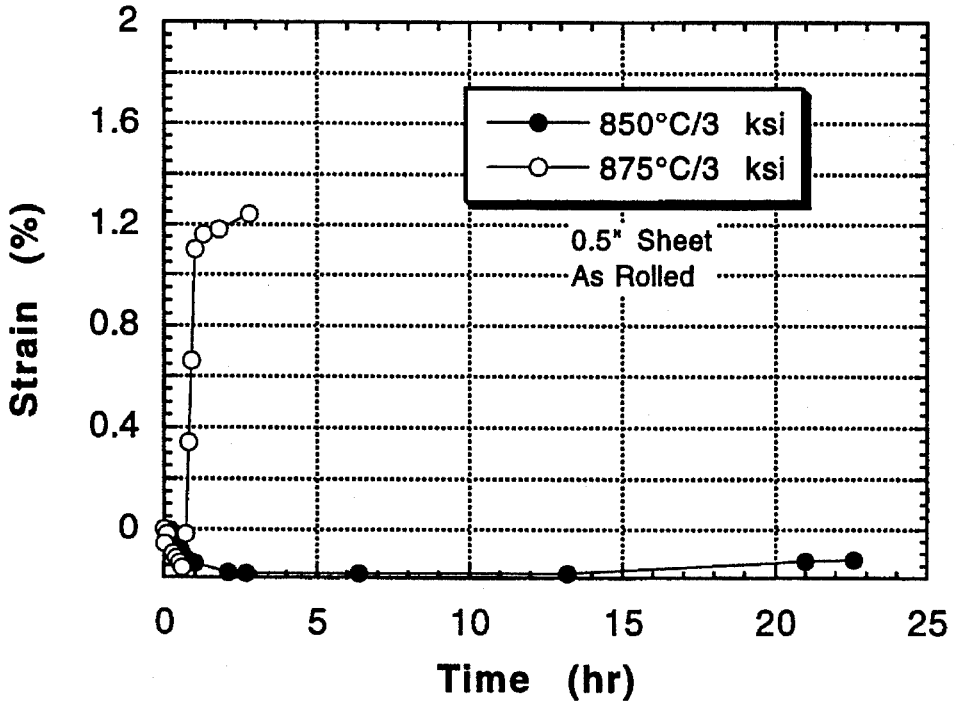
Figure 24B:
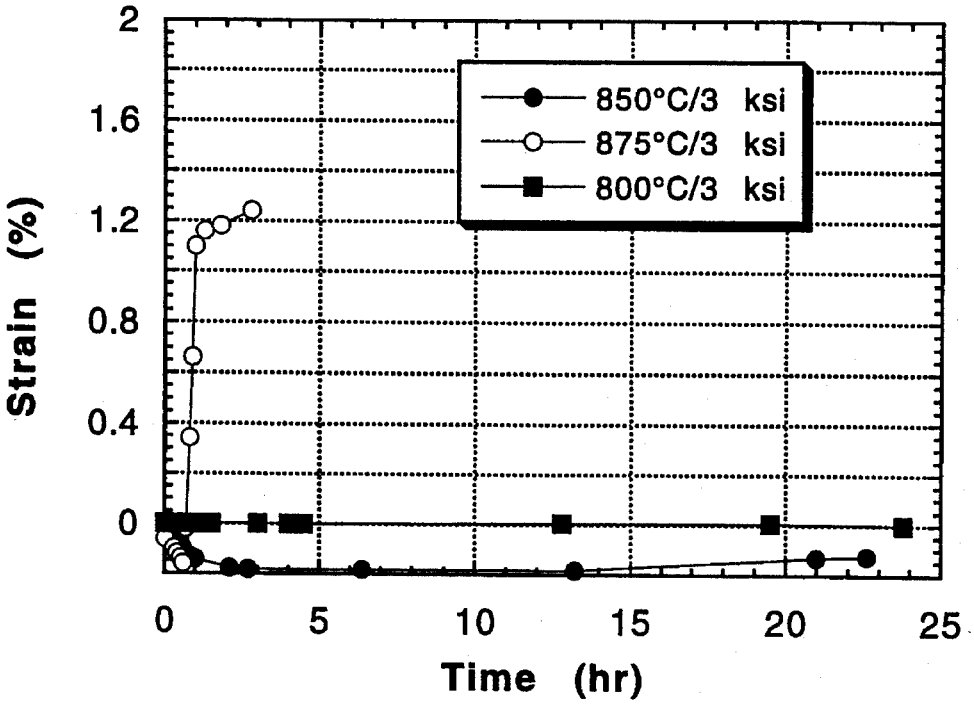
Figure 25A:
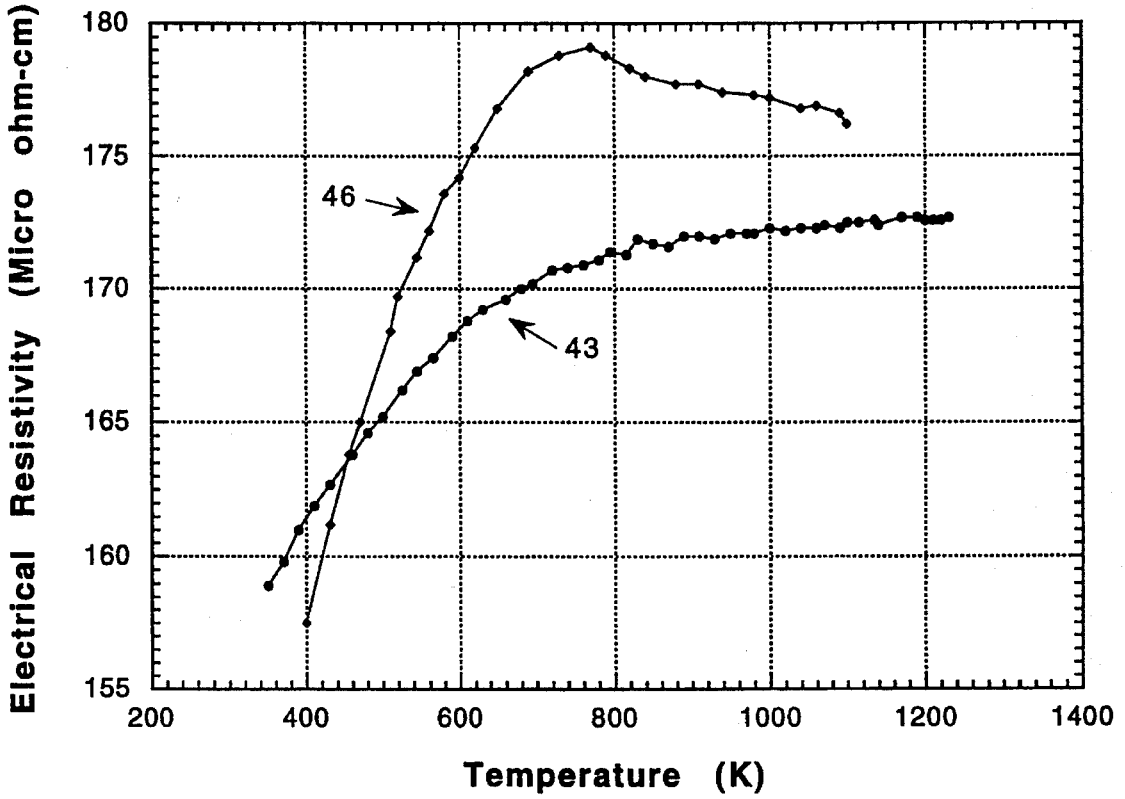
Figure 25B:
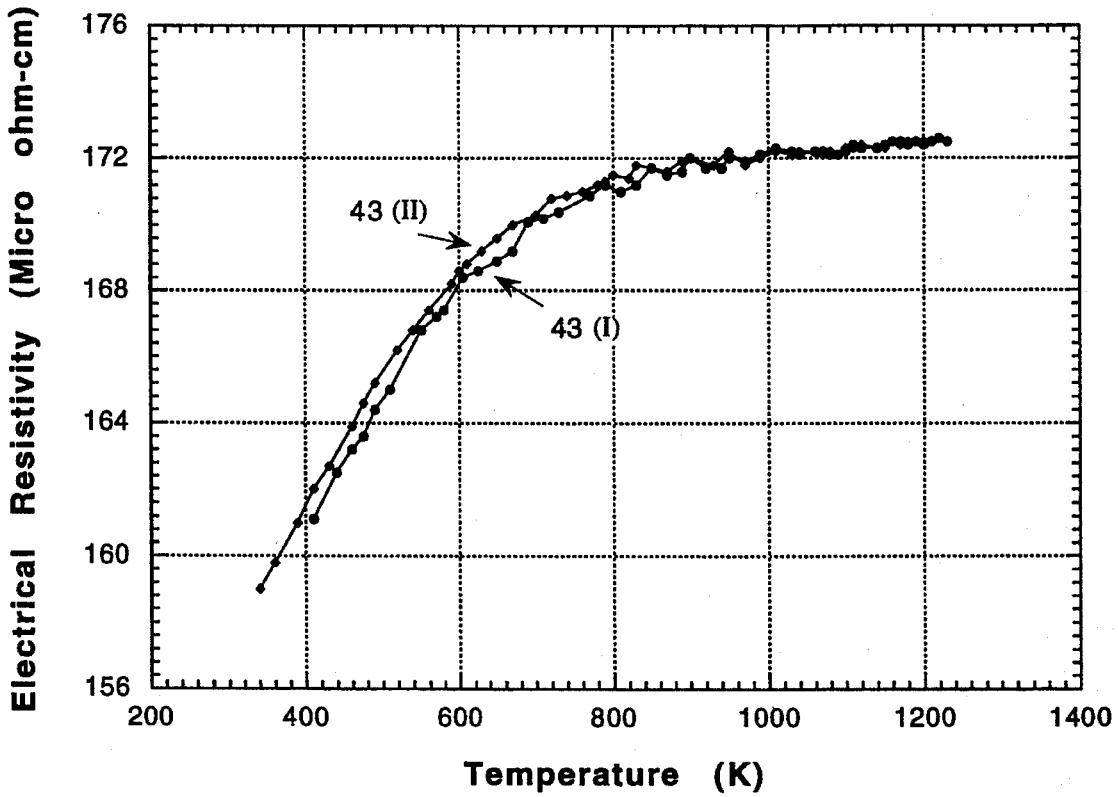

FIGS. 22*a–c* show graphs of hardness (Rockwell C) values for alloys 48, 49, 51, 52, 53, 54 and 56 wherein FIG. 22*a* shows hardness versus annealing for 1 hour at temperatures of 750°–1300° C. for alloy 48; FIG. 22*b* shows hardness versus annealing at 400° C. for times of 0–140 hours for alloys 49, 51 and 56; and FIG. 22*c* shows hardness versus annealing at 400° C. for times of 0–80 hours for alloys 52, 53 and 54. FIGS. 23 *a–e* show graphs of creep strain data versus time for alloys 48, 51 and 56, wherein FIG. 23*a* shows a comparison of creep strain at 800° C. for alloys 48 and 56, FIG. 23*b* shows creep strain at 800° C. for alloy 48, FIG. 23*c* shows creep strain at 800° C., 825° C. and 850° C. for alloy 48 after annealing at 1100° C. for one hour, FIG. 23*d* shows creep strain at 800° C., 825° C. and 850° C. for alloy 48 after annealing at 750° C. for one hour, and FIGS. 23*e* shows creep strain at 850° C. for alloy 51 after annealing at 400° C. for 139 hours. FIGS. 24*a–b* show graphs of creep strain data versus time for alloy 62 wherein FIG. 24*a* shows a comparison of creep strain at 850° C. and 875° C. for alloy 62 in the form of sheet and FIG. 24*b* shows creep strain at 800° C., 850° C. and 875° C. for alloy 62 in the form of bar. FIGS. 25*a–b* show graphs of electrical resistivity versus temperature for alloys 46 and 43 wherein FIG. 25*a* shows electrical resistivity of alloys 46 and 43 and FIG. 24*b* shows effects of a heating cycle on electrical resistivity of alloy 43.

The Fe—Al alloys of the present invention are preferably formed by powder metallurgical techniques or by the arc melting, air induction melting, or vacuum induction melting of powdered and/or solid pieces of the selected alloy constituents at a temperature of about 1600° C. in a suitable crucible formed of $ZrO_2$ or the like. The molten alloy is preferably cast into a mold of graphite or the like in the configuration of a desired product or for forming a heat of the alloy used for the formation of an alloy article by working the alloy.

The melt of the alloy to be worked is cut, if needed, into an appropriate size and then reduced in thickness by forging at a temperature in the range of about 900° to 1100° C., hot rolling at a temperature in the range of about 750 ° to 1100 ° C., warm rolling at a temperature in the range of about 600° to 700° C., and/or cold rolling at room temperature. Each pass through the cold rolls can provide a 20 to 30% reduction in thickness and is followed by heat treating the alloy in air, inert gas or vacuum at a temperature in the range of about 700° to 1,050° C., preferably about 800° C. for one hour.

Wrought alloy specimens set forth in the following tables were prepared by arc melting the alloy constituents to form heats of the various alloys. These heats were cut into 0.5 inch thick pieces which were forged at 1000° C. to reduce the thickness of the alloy specimens to 0.25 inch (50% reduction), then hot rolled at 800° C. to further reduce the thickness of the alloy specimens to 0.1 inch (60% reduction), and then warm rolled at 650° C. to provide a final thickness of 0.030 inch (70% reduction) for the alloy specimens described and tested herein. For tensile tests, the specimens were punched from 0.030 inch sheet with a ½inch gauge length of the specimen aligned with the rolling direction of the sheet.

Specimens prepared by powder metallurgical techniques are also set forth in the following tables. In general, powders were obtained by gas atomization or water atomization techniques. Depending on which technique is used, powder morphology ranging from spherical (gas atomized powder) to irregular (water atomized powder) can be obtained. The water atomized powder includes an aluminum oxide coating which is broken up into stringers of oxide particles during thermomechanical processing of the powder into useful shapes such as sheet, strip, bar, etc. The oxide particles modify the electrical resistivity of the alloy by acting as discrete insulators in a conductive Fe—Al matrix.

In order to compare compositions of alloys formed in accordance with the present invention with one another and other Fe—Al alloys, alloy compositions according to the invention and for comparison purposes are set forth in Tables 1a–b. Table 2 sets forth strength and ductility properties at low and high temperatures for selected alloy compositions in Tables 1 a–b.

Sag resistance data for various alloys is set forth in Table 3. The sag tests were carries out using strips of the various alloys supported at one end or supported at both ends. The amount of sag was measured after heating the strips in an air atmosphere at 900° C. for the times indicated.

Creep data for various alloys is set forth in Table 4. The creep tests were carried out using a tensile test to determine stress at which samples ruptured at test temperature in 10 h, 100 h and 1000 h.

Electrical resistivity at room temperature and crystal structure for selected alloys are set forth in Table 5. As shown therein, the electrical resistivity is affected by composition and processing of the alloy.

Table 6 sets forth hardness data of oxide dispersion strengthened alloys in accordance with the invention. In particular, Table 6 shows the hardness (Rockwell C) of alloys 62, 63 and 64. As shown therein, even with up to 20% $Al_2O_3$ (alloy 64), the hardness of the material can be maintained below Rc45. In order to provide workability, however, it is preferred that the hardness of the material be maintained below about Rc35. Thus, when it is desired to utilize oxide dispersion strengthened material as the resistance heater material, workability of the material can be improved by carrying out a suitable heat treatment to lower the hardness of the material.

Table 7 shows heats of formation of selected intermetallics which can be formed by reaction synthesis. While only aluminides and silicides are shown in Table 7 , reaction synthesis can also be used to form carbides, nitrides, oxides and borides. For instance, a matrix of iron aluminide and/or electrically insulating or electrically conductive covalent ceramics in the form of particles or fibers can be formed by mixing elemental powders which react exothermically during heating of such powders. Thus, such reaction synthesis can be carried out while extruding or sintering powder used to form the heater element according to the invention.

TABLE 1a

| | Composition In Weight % | | | | | | | | | | | | | | | |
|---|---|---|---|---|---|---|---|---|---|---|---|---|---|---|---|---|
| Alloy No. | Fe | Al | Si | Ti | Mo | Zr | C | Ni | Y | B | Nb | Ta | Cr | Ce | Cu | O |
| 1 | 91.5 | 8.5 | | | | | | | | | | | | | | |
| 2 | 91.5 | 6.5 | 2.0 | | | | | | | | | | | | | |
| 3 | 90.5 | 8.5 | | 1.0 | | | | | | | | | | | | |
| 4 | 90.27 | 8.5 | | 1.0 | | 0.2 | 0.03 | | | | | | | | | |
| 5 | 90.17 | 8.5 | 0.1 | 1.0 | | 0.2 | 0.03 | | | | | | | | | |
| 6 | 89.27 | 8.5 | | 1.0 | 1.0 | 0.2 | 0.03 | | | | | | | | | |
| 7 | 89.17 | 8.5 | 0.1 | 1.0 | 1.0 | 0.2 | 0.03 | | | | | | | | | |
| 8 | 93 | 6.5 | 0.5 | | | | | | | | | | | | | |
| 9 | 94.5 | 5.0 | 0.5 | | | | | | | | | | | | | |
| 10 | 92.5 | 6.5 | 1.0 | | | | | | | | | | | | | |
| 11 | 75.0 | 5.0 | | | | | | 20.0 | | | | | | | | |
| 12 | 71.5 | 8.5 | | | | | | 20.0 | | | | | | | | |
| 13 | 72.25 | 5.0 | 0.5 | 1.0 | 1.0 | 0.2 | 0.03 | 20.0 | 0.02 | | | | | | | |
| 14 | 76.19 | 6.0 | 0.5 | 1.0 | 1.0 | 0.2 | 0.03 | 15.0 | 0.08 | | | | | | | |
| 15 | 81.19 | 6.0 | 0.5 | 1.0 | 1.0 | 0.2 | 0.03 | 10.0 | 0.08 | | | | | | | |
| 16 | 86.23 | 8.5 | | 1.0 | 4.0 | 0.2 | 0.03 | | 0.04 | | | | | | | |
| 17 | 88.77 | 8.5 | | 1.0 | 1.0 | 0.6 | 0.09 | | 0.04 | | | | | | | |
| 18 | 85.77 | 8.5 | | 1.0 | 1.0 | 0.6 | 0.09 | 3.0 | 0.04 | | | | | | | |
| 19 | 83.77 | 8.5 | | 1.0 | 1.0 | 0.6 | 0.09 | 5.0 | 0.04 | | | | | | | |
| 20 | 88.13 | 8.5 | | 1.0 | 1.0 | 0.2 | 0.03 | | 0.04 | | 0.5 | 0.5 | | | | |
| 21 | 61.48 | 8.5 | | | | | | 30.0 | | 0.02 | | | | | | |
| 22 | 88.90 | 8.5 | 0.1 | 1.0 | 1.0 | 0.2 | 0.3 | | | | | | | | | |
| 23 | 87.60 | 8.5 | 0.1 | 2.0 | 1.0 | 0.2 | 0.6 | | | | | | | | | |
| 24 | bal | 8.19 | | | | | | | | | | | 2.13 | | | |
| 25 | bal | 8.30 | | | | | | | | | | | 4.60 | | | |
| 26 | bal | 8.28 | | | | | | | | | | | 6.93 | | | |
| 27 | bal | 8.22 | | | | | | | | | | | 9.57 | | | |
| 28 | bal | 7.64 | | | | | | | | | | | 7.46 | | | |
| 29 | bal | 7.47 | 0.32 | | | | | | | | | | 7.53 | | | |
| 30 | 84.75 | 8.0 | | | 6.0 | 0.8 | 0.1 | | | | 0.25 | | | | 0.1 | |
| 31 | 85.10 | 8.0 | | | 6.0 | 0.8 | 0.1 | | | | | | | | | |
| 32 | 86.00 | 8.0 | | | 6.0 | | | | | | | | | | | |

TABLE 1b

| | Composition In Weight % | | | | | | | | | | | | |
|---|---|---|---|---|---|---|---|---|---|---|---|---|---|
| Alloy No. | Fe | Al | Ti | Mo | Zr | C | Y | B | Cr | Ce | Cu | O | Ceramic |
| 33 | 78.19 | 21.23 | — | 0.42 | 0.10 | — | — | 0.060 | — | | | | |
| 34 | 79.92 | 19.50 | — | 0.42 | 0.10 | — | — | 0.060 | — | | | | |
| 35 | 81.42 | 18.00 | — | 0.42 | 0.10 | — | — | 0.060 | — | | | | |
| 36 | 82.31 | 15.00 | 1.0 | 1.0 | 0.60 | 0.09 | — | — | — | | | | |
| 37 | 78.25 | 21.20 | — | 0.42 | 0.10 | 0.03 | — | 0.005 | — | | | | |
| 38 | 78.24 | 21.20 | — | 0.42 | 0.10 | 0.03 | — | 0.010 | — | | | | |
| 39 | 84.18 | 15.82 | — | — | — | — | — | — | — | | | | |
| 40 | 81.98 | 15.84 | — | — | — | — | — | — | 2.18 | | | | |
| 41 | 78.66 | 15.88 | — | — | — | — | — | — | 5.46 | | | | |
| 42 | 74.20 | 15.93 | — | — | — | — | — | — | 9.87 | | | | |
| 43 | 78.35 | 21.10 | — | 0.42 | 0.10 | 0.03 | — | — | — | | | | |
| 44 | 78.35 | 21.10 | — | 0.42 | 0.10 | 0.03 | — | 0.0025 | — | | | | |
| 45 | 78.58 | 21.26 | — | — | 0.10 | — | — | 0.060 | — | | | | |
| 46 | 82.37 | 17.12 | | | | | | 0.010 | | | | 0.50 | |
| 47 | 81.19 | 16.25 | | | | | | 0.015 | 2.22 | | | 0.33 | |
| 48 | 76.450 | 23.0 | — | 0.42 | 0.10 | 0.03 | — | — | — | | — | — | |

TABLE 1b-continued

| Alloy No. | Fe | Al | Ti | Mo | Zr | C | Y | B | Cr | Ce | Cu | O | Ceramic |
|---|---|---|---|---|---|---|---|---|---|---|---|---|---|
| | Composition In Weight % | | | | | | | | | | | | |
| 49 | 76.445 | 23.0 | — | 0.42 | 0.10 | 0.03 | — | 0.005 | — | | — | — | |
| 50 | 76.243 | 23.0 | — | 0.42 | 0.10 | 0.03 | 0.2 | 0.005 | — | | — | — | |
| 51 | 75.445 | 23.0 | 1.0 | 0.42 | 0.10 | 0.03 | — | 0.005 | — | | — | — | |
| 52 | 74.8755 | 25.0 | — | — | 0.10 | 0.023 | — | 0.0015 | — | | — | — | |
| 53 | 72.8755 | 25.0 | — | — | 0.10 | 0.023 | — | 0.0015 | — | | 2.0 | — | |
| 54 | 73.8755 | 25.0 | 1.0 | — | 0.10 | 0.023 | — | 0.0015 | — | | — | — | |
| 55 | 73.445 | 26.0 | — | 0.42 | 0.10 | 0.03 | — | 0.0015 | — | | — | — | |
| 56 | 69.315 | 30.0 | — | 0.42 | 0.20 | 0.06 | — | 0.005 | | | | | |
| 57 | bal. | 25 | | | 0.10 | 0.023 | | 0.0015 | — | — | | | |
| 58 | bal. | 24 | | | — | 0.010 | | 0.0030 | 2 | — | | | |
| 59 | bal. | 24 | | | — | 0.015 | | 0.0030 | <0.1 | — | | | |
| 60 | bal. | 24 | | | — | 0.015 | | 0.0025 | 5 | 0.5 | | | |
| 61 | bal. | 25 | | | — | | | 0.0030 | 2 | 0.1 | | | |
| 62 | bal. | 23 | | 0.42 | 0.10 | 0.03 | | | | | | | 0.20 $Y_2O_3$ |
| 63 | bal. | 23 | | 0.42 | 0.10 | 0.03 | | | | | | | 10 $Al_2O_3$ |
| 64 | bal. | 23 | | 0.42 | 0.10 | 0.03 | | | | | | | 20 $Al_2O_3$ |
| 65 | bal. | 24 | | 0.42 | 0.10 | 0.03 | | | | | | | 2 $Al_2O_3$ |
| 66 | bal. | 24 | | 0.42 | 0.10 | 0.03 | | | | | | | 4 $Al_2O_3$ |
| 67 | bal. | 24 | | 0.42 | 0.10 | 0.03 | | | | | | | 2 TiC |
| 68 | bal. | 24 | | 0.42 | 0.10 | 0.03 | | | | | | | 2 $ZrO_2$ |

TABLE 2

| Alloy No. | Heat Treat-ment | Test Temp. (°C.) | Yield Strength (ksi) | Tensile Strength (ksi) | Elon-gation (%) | Re-duction In Area (%) |
|---|---|---|---|---|---|---|
| 1 | A | 23 | 60.60 | 73.79 | 25.50 | 41.46 |
| 1 | B | 23 | 55.19 | 68.53 | 23.56 | 31.39 |
| 1 | A | 800 | 3.19 | 3.99 | 108.76 | 72.44 |
| 1 | B | 800 | 1.94 | 1.94 | 122.20 | 57.98 |
| 2 | A | 23 | 94.16 | 94.16 | 0.90 | 1.55 |
| 2 | A | 800 | 6.40 | 7.33 | 107.56 | 71.87 |
| 3 | A | 23 | 69.63 | 86.70 | 22.64 | 28.02 |
| 3 | A | 800 | 7.19 | 7.25 | 94.00 | 74.89 |
| 4 | A | 23 | 70.15 | 89.85 | 29.88 | 41.97 |
| 4 | B | 23 | 65.21 | 85.01 | 30.94 | 35.68 |
| 4 | A | 800 | 5.22 | 7.49 | 144.70 | 81.05 |
| 4 | B | 800 | 5.35 | 5.40 | 105.96 | 75.42 |
| 5 | A | 23 | 73.62 | 92.68 | 27.32 | 40.83 |
| 5 | B | 800 | 9.20 | 9.86 | 198.96 | 89.19 |
| 6 | A | 23 | 74.50 | 93.80 | 30.36 | 40.81 |
| 6 | A | 800 | 9.97 | 11.54 | 153.00 | 85.56 |
| 7 | A | 23 | 79.29 | 99.11 | 19.60 | 21.07 |
| 7 | B | 23 | 75.10 | 97.09 | 13.20 | 16.00 |
| 7 | A | 800 | 10.36 | 10.36 | 193.30 | 84.46 |
| 7 | B | 800 | 7.60 | 9.28 | 167.00 | 82.53 |
| 8 | A | 23 | 51.10 | 66.53 | 35.80 | 27.96 |
| 8 | A | 800 | 4.61 | 5.14 | 155.80 | 55.47 |
| 9 | A | 23 | 37.77 | 59.67 | 34.20 | 18.88 |
| 9 | A | 800 | 5.56 | 6.09 | 113.50 | 48.82 |
| 10 | A | 23 | 64.51 | 74.46 | 14.90 | 1.45 |
| 10 | A | 800 | 5.99 | 6.24 | 107.86 | 71.00 |
| 13 | A | 23 | 151.90 | 185.88 | 10.08 | 15.98 |
| 13 | C | 23 | 163.27 | 183.96 | 7.14 | 21.54 |
| 13 | A | 800 | 9.49 | 17.55 | 210.90 | 89.01 |
| 13 | C | 800 | 25.61 | 29.90 | 62.00 | 57.66 |
| 16 | A | 23 | 86.48 | 107.44 | 6.46 | 7.09 |
| 16 | A | 800 | 14.50 | 14.89 | 94.64 | 76.94 |
| 17 | A | 23 | 76.66 | 96.44 | 27.40 | 45.67 |
| 17 | B | 23 | 69.68 | 91.10 | 29.04 | 39.71 |
| 17 | A | 800 | 9.37 | 11.68 | 111.10 | 85.69 |
| 17 | B | 800 | 12.05 | 14.17 | 108.64 | 75.67 |
| 20 | A | 23 | 88.63 | 107.02 | 17.94 | 28.60 |
| 20 | B | 23 | 77.79 | 99.70 | 24.06 | 37.20 |
| 20 | A | 800 | 7.22 | 11.10 | 127.32 | 80.37 |
| 20 | B | 800 | 13.58 | 14.14 | 183.40 | 88.76 |
| 21 | D | 23 | 207.29 | 229.76 | 4.70 | 14.25 |
| 21 | C | 23 | 85.61 | 159.98 | 38.00 | 32.65 |
| 21 | D | 800 | 45.03 | 55.56 | 37.40 | 35.08 |
| 21 | C | 800 | 48.58 | 57.81 | 8.40 | 8.34 |

TABLE 2-continued

| Alloy No. | Heat Treat-ment | Test Temp. (°C.) | Yield Strength (ksi) | Tensile Strength (ksi) | Elon-gation (%) | Re-duction In Area (%) |
|---|---|---|---|---|---|---|
| 22 | C | 23 | 67.80 | 91.13 | 26.00 | 42.30 |
| 22 | C | 800 | 10.93 | 11.38 | 108.96 | 79.98 |
| 24 | E | 23 | 71.30 | 84.30 | 23 | 33 |
| 24 | F | 23 | 69.30 | 84.60 | 22 | 40 |
| 25 | E | 23 | 73.30 | 85.20 | 34 | 68 |
| 25 | F | 23 | 71.80 | 86.90 | 27 | 60 |
| 26 | E | 23 | 61.20 | 83.25 | 15 | 15 |
| 26 | F | 23 | 61.20 | 84.20 | 21 | 27 |
| 27 | E | 23 | 59.60 | 86.90 | 13 | 15 |
| 27 | F | 23 | — | 88.80 | 18 | 19 |
| 28 | E | 23 | 60.40 | 77.70 | 35 | 74 |
| 28 | E | 23 | 59.60 | 79.80 | 26 | 58 |
| 29 | F | 23 | 62.20 | 76.60 | 17 | 17 |
| 29 | F | 23 | 61.70 | 86.80 | 12 | 12 |
| 30 | | 23 | 97.60 | 116.60 | 4 | 5 |
| 30 | | 650 | 26.90 | 28.00 | 38 | 86 |
| 31 | | 23 | 79.40 | 104.30 | 7 | 7 |
| 31 | | 650 | 38.50 | 47.00 | 27 | 80 |
| 32 | | 23 | 76.80 | 94.80 | 7 | 5 |
| 32 | | 650 | 29.90 | 32.70 | 35 | 86 |
| 35 | C | 23 | 63.17 | 84.95 | 5.12 | 7.81 |
| 35 | C | 600 | 49.54 | 62.40 | 36.60 | 46.25 |
| 35 | C | 800 | 18.80 | 23.01 | 80.10 | 69.11 |
| 46 | G | 23 | 77.20 | 102.20 | 5.70 | 4.24 |
| 46 | G | 600 | 66.61 | 66.61 | 26.34 | 31.86 |
| 46 | G | 800 | 7.93 | 16.55 | 46.10 | 32.87 |
| 46 | G | 850 | 7.77 | 10.54 | 38.30 | 32.91 |
| 46 | G | 900 | 2.65 | 5.44 | 30.94 | 31.96 |
| 46 | G | 23 | 62.41 | 94.82 | 5.46 | 6.54 |
| 46 | G | 800 | 10.49 | 13.41 | 27.10 | 30.14 |
| 46 | G | 850 | 3.37 | 7.77 | 33.90 | 26.70 |
| 46 | G | 23 | 63.39 | 90.34 | 4.60 | 3.98 |
| 46 | G | 800 | 11.49 | 14.72 | 17.70 | 21.65 |
| 46 | G | 850 | 14.72 | 8.30 | 26.90 | 23.07 |
| 43 | H | 23 | 75.2 | 136.2 | 9.2 | |
| 43 | H | 600 | 71.7 | 76.0 | 24.4 | |
| 43 | H | 700 | 58.8 | 60.2 | 16.5 | |
| 43 | H | 800 | 29.4 | 31.8 | 14.8 | |
| 43 | I | 23 | 92.2 | 167.5 | 14.8 | |
| 43 | I | 600 | 76.8 | 82.2 | 27.6 | |
| 43 | I | 700 | 61.8 | 66.7 | 21.6 | |
| 43 | I | 800 | 32.5 | 34.5 | 20.0 | |
| 43 | J | 23 | 97.1 | 156.1 | 12.4 | |
| 43 | J | 600 | 75.4 | 80.4 | 25.4 | |

TABLE 2-continued

| Alloy No. | Heat Treatment | Test Temp. (°C.) | Yield Strength (ksi) | Tensile Strength (ksi) | Elongation (%) | Reduction In Area (%) |
|---|---|---|---|---|---|---|
| 43 | J | 700 | 58.7 | 62.1 | 22.0 | |
| 43 | J | 800 | 22.4 | 27.8 | 21.7 | |
| 43 | N | 23 | 79.03 | 95.51 | 3.01 | 4.56 |
| 43 | K | 850 | 16.01 | 17.35 | 51.73 | 34.08 |
| 43 | L | 850 | 16.40 | 18.04 | 51.66 | 32.92 |
| 43 | M | 850 | 18.07 | 19.42 | 56.04 | 31.37 |
| 43 | N | 850 | 19.70 | 21.37 | 47.27 | 38.85 |
| 43 | O (bar) | 850 | 26.15 | 26.46 | 61.13 | 48.22 |
| 43 | K (sheet) | 850 | 12.01 | 15.43 | 35.96 | 28.43 |
| 43 | O (sheet) | 850 | 13.79 | 18.00 | 14.66 | 19.16 |

-continued

| Heat Treatments of Samples |
|---|
| G = 700° C./1 hr./Air Cool |
| H = Extruded at 1100° C. |
| I = Extruded at 1000° C. |
| J = Extruded at 950° C. |
| K = 750° C./1 hr. in vacuum |
| L = 800° C./1 hr. in vacuum |
| M = 900° C./1 hr. in vacuum |
| N = 1000° C./1 hr. in vacuum |
| O = 1100° C./1 hr. in vacuum |
| P = 1200° C./1 hr. in vacuum |
| Q = 1300° C./1 hr. in vacuum |
| R = 750° C./1 hr. slow cool |
| S = 400° C./139 hr. |
| T = 700° C./1 hr. oil quench |

Alloys 1–22, 35, 43, 46, 56, 65–68 tested with 0.2 inch/min. strain rate

Alloys 49, 51, 53 tested with 0.16 inch/min. strain rate

TABLE 3

| Ends of Sample Supported | Sample Thickness (mil) | Length of Heating (h) | Amount of Sag (inch) Alloy 17 | Alloy 20 | Alloy 22 | Alloy 45 | Alloy 47 |
|---|---|---|---|---|---|---|---|
| One[a] | 30 | 16 | ⅛ | — | — | ⅛ | — |
| One[b] | 30 | 21 | — | ⅜ | ⅛ | ¼ | — |
| Both | 30 | 185 | — | 0 | 0 | 1/16 | 0 |
| Both | 10 | 68 | — | — | ⅛ | 0 | 0 |

Additional Conditions

[a]= wire weight hung on free end to make samples have same weight

[b]= foils of same length and width placed on samples to make samples have same weight TABLE 2-continued

| Alloy No. | Heat Treatment | Test Temp. (°C.) | Yield Strength (ksi) | Tensile Strength (ksi) | Elongation (%) | Reduction In Area (%) |
|---|---|---|---|---|---|---|
| 43 | P | 850 | 22.26 | 25.44 | 26.84 | 19.21 |
| 43 | Q | 850 | 26.39 | 26.59 | 28.52 | 20.96 |
| 43 | O | 900 | 12.41 | 12.72 | 43.94 | 42.24 |
| 43 | S | 23 | 21.19 | 129.17 | 7.73 | 7.87 |
| 49 | S | 850 | 23.43 | 27.20 | 102.98 | 94.49 |
| 51 | S | 850 | 19.15 | 19.64 | 183.32 | 97.50 |
| 53 | S | 850 | 18.05 | 18.23 | 118.66 | 97.69 |
| 56 | R | 850 | 16.33 | 21.91 | 74.96 | 95.18 |
| 56 | S | 23 | 61.69 | 99.99 | 5.31 | 4.31 |
| 56 | K | 850 | 16.33 | 21.91 | 74.96 | 95.18 |
| 56 | O | 850 | 29.80 | 36.68 | 6.20 | 1.91 |
| 62 | D | 850 | 17.34 | 19.70 | 11.70 | 11.91 |
| 63 | D | 850 | 18.77 | 21.52 | 13.84 | 9.77 |
| 64 | D | 850 | 12.73 | 16.61 | 2.60 | 26.88 |
| 65 | T | 23 | 96.09 | 121.20 | 2.50 | 2.02 |
| | | 800 | 27.96 | 32.54 | 29.86 | 26.52 |
| 66 | T | 23 | 96.15 | 124.85 | 3.70 | 5.90 |
| | | 800 | 27.52 | 35.13 | 29.20 | 22.65 |
| 67 | T | 23 | 92.53 | 106.86 | 2.26 | 6.81 |
| | | 800 | 31.80 | 36.10 | 14.30 | 25.54 |
| 68 | T | 23 | 69.74 | 83.14 | 2.54 | 5.93 |
| | | 800 | 20.61 | 24.98 | 33.24 | 49.19 |

| Heat Treatments of Samples |
|---|
| A = 800° C./1 hr./Air Cool |
| B = 1050° C./2 hr./Air Cool |
| C = 1050° C./2 hr. in Vacuum |
| D = As rolled |
| E = 815° C./1 hr./oil Quench |
| F = 815° C./1 hr./furnace cool |

TABLE 4

| Sample | Test Temperature °F. | °C. | Creep Rupture Strength (ksi) 10 h | 100 h | 1000 h |
|---|---|---|---|---|---|
| 1 | 1400 | 760 | 2.90 | 2.05 | 1.40 |
| | 1500 | 816 | 1.95 | 1.35 | 0.95 |
| | 1600 | 871 | 1.20 | 0.90 | — |
| | 1700 | 925 | 0.90 | — | — |
| 4 | 1400 | 760 | 3.50 | 2.50 | 1.80 |
| | 1500 | 816 | 2.40 | 1.80 | 1.20 |
| | 1600 | 871 | 1.65 | 1.15 | — |
| | 1700 | 925 | 1.15 | — | — |
| 5 | 1400 | 760 | 3.60 | 2.50 | 1.85 |
| | 1500 | 816 | 2.40 | 1.80 | 1.20 |
| | 1600 | 871 | 1.65 | 1.15 | — |
| | 1700 | 925 | 1.15 | — | — |
| 6 | 1400 | 760 | 3.50 | 2.60 | 1.95 |
| | 1500 | 816 | 2.50 | 1.90 | 1.40 |
| | 1600 | 871 | 1.80 | 1.30 | — |
| | 1700 | 925 | 1.30 | — | — |
| 7 | 1400 | 760 | 3.90 | 2.90 | 2.15 |
| | 1500 | 816 | 2.80 | 2.00 | 1.65 |
| | 1600 | 871 | 2.00 | 1.50 | — |
| | 1700 | 925 | 1.50 | — | — |
| 17 | 1400 | 760 | 3.95 | 3.0 | 2.3 |
| | 1500 | 816 | 2.95 | 2.20 | 1.75 |
| | 1600 | 871 | 2.05 | 1.65 | 1.25 |
| | 1700 | 925 | 1.65 | 1.20 | — |
| 20 | 1400 | 760 | 4.90 | 3.25 | 2.05 |
| | 1500 | 816 | 3.20 | 2.20 | 1.65 |
| | 1600 | 871 | 2.10 | 1.55 | 1.0 |
| | 1700 | 925 | 1.56 | 0.95 | — |
| 22 | 1400 | 760 | 4.70 | 3.60 | 2.65 |
| | 1500 | 816 | 3.55 | 2.60 | 1.35 |
| | 1600 | 871 | 2.50 | 1.80 | 1.25 |
| | 1700 | 925 | 1.80 | 1.20 | 1.0 |

TABLE 5

| Alloy | Condition | Electrical Resistivity Room-temp μ Ω · cm. | Crystal Structure |
|---|---|---|---|
| 35 | | 184 | $DO_3$ |
| 46 | A | 167 | $DO_3$ |
| 46 | A + D | 169 | $DO_3$ |
| 46 | A + E | 181 | $B_2$ |
| 39 | | 149 | $DO_3$ |
| 40 | | 164 | $DO_3$ |
| 40 | B | 178 | $DO_3$ |
| 41 | C | 190 | $DO_3$ |
| 43 | C | 185 | $B_2$ |
| 44 | C | 178 | $B_2$ |
| 45 | C | 184 | $B_2$ |
| 62 | F | 197 | |
| 63 | F | 251 | |
| 64 | F | 337 | |
| 65 | F | 170 | |
| 66 | F | 180 | |
| 67 | F | 158 | |
| 68 | F | 155 | |

Condition of Samples
A = water atomized powder
B = gas atomized powder
C = cast and processed
D = ½ hr. anneal at 700° C. + oil quench
E = ½ hr. anneal at 750° C. + oil quench
F = reaction synthesis to form covalent ceramic addition

TABLE 6

HARDNESS DATA

| CONDITION | MATERIAL Alloy 62 | Alloy 63 | Alloy 64 |
|---|---|---|---|
| As extruded | 39 | 37 | 44 |
| Annealed 750° C. for 1 h followed by slow cooling | 35 | 34 | 44 |

Alloy 62: Extruded in carbon steel at 1100° C. to a reduction ratio of 16:1 (2 to ½-in. die);
Alloy 63 and Alloy 64: Extruded in stainless steel at 125° C. to a reduction ratio of 16:1 (2 to ½-in. die).

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An electrical resistance heating element of an iron-based alloy having improved room temperature ductility, resistance to cyclic oxidation, thermal fatigue resistance, electrical resistivity and high temperature sag resistance, and comprising, in weight %, 14 to 32% Al, ≦1% Cr, 0.05 to 1% Zr, balance Fe, the alloy further including Mo in an amount effective to promote solid solution hardening of the alloy and resistance to creep of the alloy when exposed to high temperatures.

2. The iron-based alloy of claim 1, wherein the alloy is Cr-free, Mn-free, Si-free and/or Ni-free.

3. The iron-based alloy of claim 1, wherein the alloy has a ferritic microstructure which is austenite-free.

4. The iron-based alloy of claim 1, wherein the alloy includes ≦30% electrically insulating and/or electrically conductive covalent ceramic particles or fibers.

5. The iron-based alloy of claim 1, wherein the alloy is free of ceramic particles.

6. The iron-based alloy of claim 1, wherein the alloy includes ≦2% Mo, ≦2% Ti, ≦2% Si, ≦30% Ni, ≦0.5% Y, ≦0.1% B, ≦1% Nb, ≦1% Ta, ≦3% Cu and ≦30% oxide dispersoid particles.

7. The iron-based alloy of claim 1, wherein the alloy consists essentially of 20.0–31.0% Al, ≦1% Mo, 0.05–0.15% Zr, ≦0.1% B, 0.01–0.1% C, balance Fe.

8. An electrical resistance heating element of an iron-based alloy having improved room temperature ductility, resistance to cyclic oxidation, thermal fatigue resistance, electrical resistivity and high temperature sac resistance, the alloy consisting essentially of 14.0–20.0% Al, ≦1% Cr, 0.3–1.5% Mo, 0.05–1.0% Zr, ≦0.1% B, ≦0.1% C, ≦2.0 Ti, balance Fe.

TABLE 7

| Intermetallic | ΔH° 298 (K cal/mole) | Intermetallic | ΔH° 298 (K cal/mole) | Intermetallic | ΔH° 298 (K cal/mole) |
|---|---|---|---|---|---|
| $NiAl_3$ | −36.0 | $Ni_2Si$ | −34.1 | $Ta_2Si$ | −30.0 |
| NiAl | −28.3 | $Ni_3Si$ | −55.5 | $Ta_5Si_3$ | −80.0 |
| $Ni_2Al_3$ | −67.5 | NiSi | −21.4 | TaSi | −28.5 |
| $Ni_3Al$ | −36.6 | $NiSi_2$ | −22.5 | — | — |
| — | — | — | — | $Ti_5Si_3$ | −138.5 |
| $FeAl_3$ | −18.9 | $Mo_3Si$ | −27.8 | TiSi | −31.0 |
| FeAl | −12.0 | $Mo_5Si_3$ | −74.1 | $TiSi_2$ | −32.1 |
| — | — | $MoSi_2$ | −31.5 | — | — |
| CoAl | −26.4 | — | — | $WSi_2$ | −22.2 |
| $CoAl_4$ | −38.5 | $Cr_3Si$ | −22.0 | $W_5Si_3$ | −32.3 |
| $Co_2Al_5$ | −70.0 | $Cr_5Si_3$ | −50.5 | — | — |
| — | — | CrSi | −12.7 | $Zr_2Si$ | −81.0 |
| $Ti_3Al$ | −23.5 | $CrSi_2$ | −19.1 | $Zr_5Si_3$ | −146.7 |
| TiAl | −17.4 | — | — | ZrSi | −35.3 |
| $TiAl_3$ | −34.0 | $Co_2Si$ | −28.0 | — | — |
| $Ti_2Al_3$ | −27.9 | CoSi | −22.7 | — | — |
| — | — | $CoSi_2$ | −23.6 | — | — |
| $NbAl_3$ | −28.4 | — | — | — | — |
| — | — | FeSi | −18.3 | — | — |
| TaAl | −19.2 | — | — | — | — |
| $TaAl_3$ | −26.1 | $NbSi_2$ | −33.0 | — | — |

9. An electrical resistance heating element of an iron-based alloy having improved room temperature ductility, resistance to cyclic oxidation, thermal fatigue resistance, electrical resistivity and high temperature sag resistance, the alloy consisting essentially of 20.0–31.0% Al, ≦1% Cr, 0.3–0.5% Mo, 0.05–0.3% Zr, ≦0.1% C, ≦0.1% B, ≦0.5% Y, balance Fe.

10. The iron-based alloy of claim 1, wherein the electrical resistance heating element has a room temperature resistivity of 80–400 μΩ·cm.

11. The iron-based alloy of claim 1, wherein the electrical resistance heating element heats to 900° C. in less than 1 second when a voltage up to 10 volts and up to 6 amps is passed through the alloy.

12. The iron-based alloy of claim 1, wherein the electrical resistance heating element exhibits a weight gain of less than 4% when heated in air to 1000° C. for three hours.

13. The iron-based alloy of claim 1, wherein the electrical resistance heating element has a resistance of 0.5 to 7 ohms throughout a heating cycle between ambient and 900° C.

14. The iron-based alloy of claim 1, wherein the electrical resistance heating element has a contact resistivity of 80 to 200 Ω·cm throughout a heating cycle between ambient and 900° C.

15. The iron-based alloy of claim 1, wherein the alloy exhibits a room temperature reduction in area of at least 14%, a room temperature elongation of at least 3%, a room temperature yield strength of at least 50 ksi, and a room temperature tensile strength of at least 80 ksi.

16. The iron-based alloy of claim 1, wherein the alloy exhibits a high temperature reduction in area at 800° C. of at least 30%, a high temperature elongation at 800° C. of at least 30%, a high temperature yield strength at 800° C. of at least 7 ksi, and a high temperature tensile strength at 800° C. of at least 10 ksi.

17. The iron-based alloy of claim 1, wherein the electrical resistance heating element exhibits thermal fatigue resistance of over 10,000 cycles without breaking when heated from room temperature to 1000° C. for 0.5 to 5 seconds in each of the cycles.

18. An electrical resistance heating element of an iron-based alloy having improved room temperature ductility, resistance to cyclic oxidation, thermal fatigue resistance, electrical resistivity and high temperature sag resistance, and comprising, in weight %, 4–32% Al, 0.1–30% oxide dispersoid particles, balance Fe, the alloy further including Mo in an amount effective to promote solid solution hardening of the alloy and resistance to creep of the alloy when exposed to high temperatures.

19. The iron-based alloy of claim 18, wherein the alloy is Cr-free, Mn-free, Si-free and/or Ni-free.

20. An electrical resistance heating element of an iron-based alloy having improved room temperature ductility, resistance to cyclic oxidation, thermal fatigue resistance, electrical resistivity and high temperature sag resistance, and comprising, in weight %, 4–32% Al, 0.1–30% oxide dispersoid particles, 0.001–0.1% B, 0.3–0.8% oxygen, balance Fe.

21. The iron-based alloy of claim 18, wherein the alloy includes ≦30% electrically insulating and/or electrically conductive covalent ceramic particles or fibers.

22. The iron-based alloy of claim 18, wherein the alloy includes ≦2% Mo, ≦2% Ti, ≦1% Zr, ≦2% Si, ≦30% Ni, ≦10% Cr, ≦0.1% C, ≦0.5% Y, ≦0.1% B, ≦1% Nb and ≦1% Ta.

23. An electrical resistance heating element of an iron-based alloy having improved room temperature ductility, resistance to cyclic oxidation, thermal fatigue resistance, electrical resistivity and high temperature sag resistance, the alloy consisting essentially of 20.0–31.0% Al, 0.3–0.5% Mo, 0.05–0.15% Zr, 0.01–0.05% C, 0.1–30% oxide dispersoid particles, ≦25% $Al_2O_3$particles, ≦1% $Y_2O_3$particles, balance Fe.

24. An electrical resistance heating element of an iron-based alloy having improved room temperature ductility, resistance to cyclic oxidation, thermal fatigue resistance, electrical resistivity and high temperature sag resistance, the alloy consisting essentially of 14.0–20.0% Al, ≦5.0% Cr, 0.01–0.10% B, 0.1–30% oxide dispersoid particles, ≦1% $Al_2O_3$particles, balance Fe.

25. An electrical resistance heating element of an iron-based alloy having improved room temperature ductility, resistance to cyclic oxidation, thermal fatigue resistance, electrical resistivity and high temperature sag resistance, the alloy consisting essentially of 20.0–31.0% Al, 0.3–0.5% Mo, 0.05–0.3% Zr, 0.01–0.1% C, 0.1–30% oxide dispersoid particles, ≦1% $Y_2O_3$, balance Fe.

26. The iron-based alloy of claim 18, wherein the electrical resistance heating element has a room temperature resistivity of 80–400 μΩ·cm.

27. The iron-based alloy of claim 18, wherein the electrical resistance heating element heats to 900° C. in less than 1 second when a voltage up to 10 volts and up to 6 amps is passed through the alloy.

28. The iron-based alloy of claim 18, wherein the electrical resistance heating element exhibits a weight gain of less than 4% when heated in air to 1000° C. for three hours.

29. The iron-based alloy of claim 18, wherein the electrical resistance heating element has a resistance of 0.5 to 7 ohms throughout a heating cycle between ambient and 900° C.

30. The iron-based alloy of claim 18, wherein the electrical resistance heating element has a resistivity of 80 to 200 Ω·cm throughout a heating cycle between ambient and 900° C.

31. The iron-based alloy of claim 18, wherein the electrical resistance heating element exhibits a room temperature reduction in area of at least 14%, a room temperature elongation of at least 3%, a room temperature yield strength of at least 50 ksi, and a room temperature tensile strength of at least 80 ksi.

32. The iron-based alloy of claim 18, wherein the electrical resistance heating element exhibits a high temperature reduction in area at 800° C. of at least 30%, a high temperature elongation at 800° C. of at least 30%, a high temperature yield strength at 800° C. of at least 7 ksi, and a high temperature tensile strength at 800° C. of at least 10 ksi.

33. The iron-based alloy of claim 18, wherein tile electrical resistance heating element exhibits thermal fatigue resistance of over 10,000 cycles without breaking when heated from room temperature to 1000° C. for 0.5 to 5 seconds in each of the cycles.

34. An electrical resistance heating element formed from an iron aluminide alloy, comprising, in weight %, 4–32% Al, ≦1% Cr and Zr in an amount effective to form zirconium oxide stringers extending perpendicular to an exposed surface of the heating element and pin surface oxide on the heating element during cycling between ambient and temperatures over 500° C., the alloy further including Mo in an amount effective to promote solid solution hardening of the alloy and resistance to creep of the alloy when exposed to high temperatures.

35. The iron-based alloy of claim 34, wherein the alloy is Cr-free, Mn-free, Si-free and/or Ni-free.

36. The iron-based alloy of claim 34, wherein the alloy has a ferritic microstructure which is austenite-free.

37. The iron-based alloy of claim 34, wherein the alloy includes ≦30% electrically insulating and/or electrically conductive covalent ceramic particles or fibers.

38. The iron-based alloy of claim 34, wherein the alloy is free of ceramic particles.

39. The iron-based alloy of claim 34, wherein the alloy includes ≦2% Mo, ≦2% Ti, ≦1% Zr, ≦2% Si, ≦30% Ni, ≦0.5% Y, ≦0.1% B, ≦1% Nb and ≦1% Ta.

40. The iron-based alloy of claim 34, wherein the alloy consists essentially of 20.0–31.0% Al, 0.05–0.15% Zr, ≦0.1% B, 0.01–0.1% C, balance Fe.

41. An electrical resistance heating element formed from an iron aluminide alloy including Zr in an amount effective to form zirconium oxide stringers extending perpendicular to an exposed surface of the heating element and pin surface oxide on the heating element during cycling between ambient and temperatures over 500° C., the alloy consisting essentially of 14.0–20.0% Al, ≦1% Cr, 0.3–1.5% Mo. 0.05–1.0% Zr, ≦0.1% C, ≦0.1% B, ≦2% Ti, balance Fe.

42. An electrical resistance heating element formed from an iron aluminide alloy including Zr in an amount effective to form zirconium oxide stringers extending perpendicular to an exposed surface of the heating element and pin surface oxide on the heating element during cycling between ambient and temperatures over 500° C. the alloy consisting essentially of 20.0–31.0% Al,≦1% Cr, 0.3–0.5% Mo, 0.05–0.3% Zr, ≦0.1% B, ≦0.1% C, ≦0.5% Y, balance Fe.

43. The iron-based alloy of claim 34, wherein the electrical resistance heating element has a room temperature resistivity of 80–400 μΩ·cm.

44. The iron-based alloy of claim 34, wherein the electrical resistance heating element heats to 900° C. in less than 1 second when a voltage up to 10 volts and up to 6 amps is passed through the alloy.

45. The iron-based alloy of claim 34, wherein the electrical resistance heating element exhibits a weight gain of less than 4% when heated in air to 1000° C. for three hours.

46. The iron-based alloy of claim 34, wherein the electrical resistance heating element has a resistance of 0.5 to 7 ohms throughout a heating cycle between ambient and 900° C.

47. The iron-based alloy of claim 34, wherein the electrical resistance heating element has a resistivity of 80 to 200 Ω·cm throughout a heating cycle between ambient and 900° C.

48. The iron-based alloy of claim 34, wherein the alloy exhibits a room temperature reduction in area of at least 14%, a room temperature elongation of at least 3%, a room temperature yield strength of at least 50 ksi, and a room temperature tensile strength of at least 80 ksi.

49. The iron-based alloy of claim 34; wherein the alloy exhibits a high temperature reduction in area at 800° C. of at least 30%, a high temperature elongation at 800° C. of at least 30%, a high temperature yield strength at 800° C. of at least 7 ksi, and a high temperature tensile strength at 800° C. of at least 10 ksi.

50. The iron-based alloy of claim 34, wherein the electrical resistance heating element exhibits thermal fatigue resistance of over 10,000 cycles without breaking when heated from room temperature to 1000° C. for 0.5 to 5 seconds in each of the cycles.

51. An electrical resistance heating element formed from an iron aluminide alloy, comprising, in weight %, 4–32% Al, ≦1% Cr and Zr in an amount effective to form zirconium oxide stringers extending perpendicular to an exposed surface of the heating element and pin surface oxide on the heating element during cycling between ambient and temperatures over 500° C., the alloy further including 0.2–2.0% Mo and 0.001–0.1% B.

52. An electrical resistance heating element of an iron-based alloy having improved room temperature ductility, resistance to cyclic oxidation, thermal fatigue resistance, electrical resistivity and high temperature sag resistance, the alloy consisting essentially of 21–25% Al, ≦1% Cr, 0.0025–0.01% B, 0.3–0.5% Mo, 0.05–0.15% Zr, 0.05–0.25% Y, 0.01–0.1% C, balance Fe.

53. An electrical resistance heating element of an iron-based alloy having improved room temperature ductility, resistance to cyclic oxidation, thermal fatigue resistance, electrical resistivity and high temperature sag resistance, the alloy consisting essentially of 25–30% Al, ≦1% Cr, 0.0025–0.01% B, 0.3–0.5% Mo, 0.05–0.15% Zr, 0.01–0.1% C, balance Fe.

54. An electrical resistance heating element formed from an iron aluminide alloy including Zr in an amount effective to form zirconium oxide stringers extending perpendicular to an exposed surface of the heating element and pin surface oxide on the heating element during cycling between ambient and temperatures over 500° C., the alloy consisting essentially of 21–25% Al, ≦1% Cr, 0.0025–0.01% B, 0.3–0.5% Mo, 0.05–0.15% Zr, 0.05–0.25% Y, 0.01–0.1% C, balance Fe.

55. An electrical resistance heating element formed from an iron aluminide alloy including Zr in an amount effective to form zirconium oxide stringers extending perpendicular to an exposed surface of the heating element and pin surface oxide on the heating element during cycling between ambient and temperatures over 500° C., the alloy consisting essentially of 25–30% Al, ≦1% Cr, 0.0025–0.01% B, 0.3–0.5% Mo, 0.05–0.15% Zr, 0.01–0.1% C, balance Fe.

* * * * *